US005572230A

United States Patent [19]

Takano et al.

[11] Patent Number: 5,572,230

[45] Date of Patent: Nov. 5, 1996

[54] METHOD FOR DRIVING GAS DISCHARGE DISPLAY PANEL AND GAS DISCHARGE DISPLAY EQUIPMENT IN WHICH THE GAS DISCHARGE DISPLAY PANEL IS DRIVEN ACCORDING TO THE METHOD

[75] Inventors: Yoshimichi Takano; Tetsuo Sakai, both of Tokyo; Hiroshi Murakami, Yokohama; Kazuo Takahashi, Osaka; Mutsumi Mimasu, Hikone; Utaro Miyagawa, Osaka; Makoto Takei, Osaka; Koichi Wani, Osaka, all of Japan

[73] Assignees: Nippon Hoso Kyokai, Tokyo; Matsushita Electronics Corporation, Osaka, both of Japan

[21] Appl. No.: 54,490

[22] Filed: Apr. 30, 1993

[30] Foreign Application Priority Data

Jun. 26, 1992 [JP] Japan ..... 4-169283

[51] Int. Cl.[6] ..... G09G 3/28

[52] U.S. Cl. ..... 345/68; 345/63

[58] Field of Search ..... 345/60–63, 66–71, 345/204, 208, 209, 210, 211; 315/169.4; 313/501, 505

[56] References Cited

U.S. PATENT DOCUMENTS

| | | | |
|---|---|---|---|
| 4,024,529 | 5/1977 | Sakai | 345/67 |
| 4,636,784 | 1/1987 | Delgrange et al. | 345/68 |
| 4,684,849 | 8/1987 | Otsuka et al. | 345/68 |
| 5,231,382 | 7/1993 | Tanaka | 345/60 |

FOREIGN PATENT DOCUMENTS

| | | |
|---|---|---|
| 57-86886 | 5/1982 | Japan . |
| 60-194495 | 10/1985 | Japan . |
| 63-127290 | 5/1988 | Japan . |
| 46734 | 1/1992 | Japan . |

OTHER PUBLICATIONS

"Pulse Memory Driving Type of Discharge Panel for Displaying Colored Figure" by H. Murakami et al; The Transactions of the Institute of Electronics, Information Engineers; C–II vol. J73–C–II No. 11, pp., 594–802, Nov. 1990.

*Primary Examiner*—Steven Saras

*Attorney, Agent, or Firm*—Lowe, Price, LeBlanc & Becker

[57] ABSTRACT

A method for driving a gas discharge display panel consists of the steps of applying a writing pulse on a specific display electrode line selected from display electrode lines arranged side by side in the panel, applying a scanning pulse on a specific scanning electrode line selected from scanning electrode lines which are arranged side by side and cross the display electrode lines to produce writing gas discharge in cooperation with the writing pulse in a specific discharge cell arranged at an intersection space between the specific display electrode and the specific scanning electrode line, and applying a series of maintaining pulses subsequent to the scanning pulse on the specific scanning electrode during only a maintaining period to produce maintaining gas discharge subsequent to the writing gas discharge in the specific discharge cell, the maintaining gas discharge being intermittently produced in synchronism with the maintaining pulses. The scanning pulse is applied in synchronism with the writing pulse. The maintaining gas discharge is stopped without applying any pulse after the maintaining period passes.

2 Claims, 33 Drawing Sheets

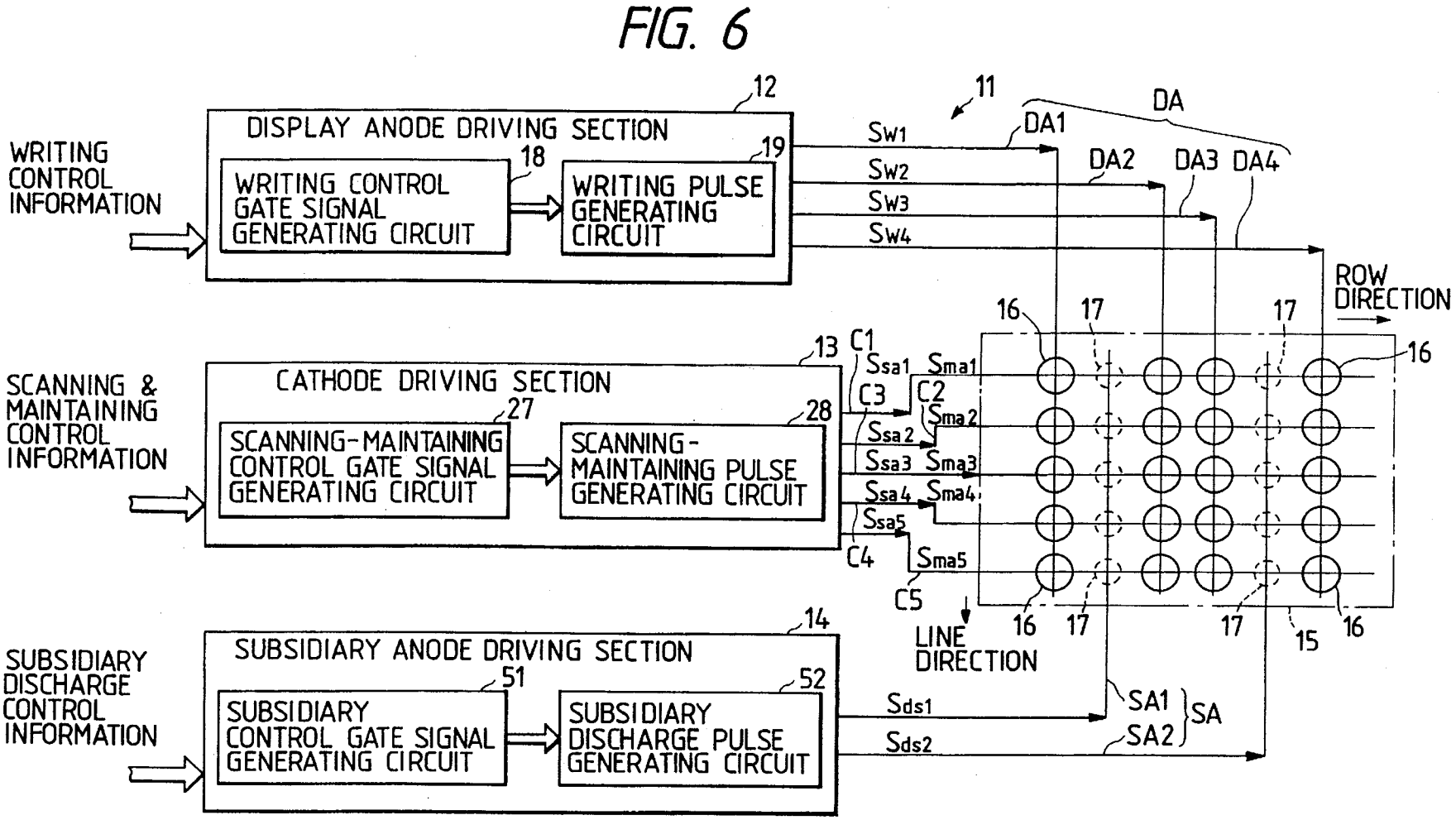
FIG. 6
11
12
13
14
15
16
17
18
19
27
28
51
52
DA
DA1
DA2
DA3
DA4
SA
SA1
SA2
ROW DIRECTION
LINE DIRECTION
Sw1
Sw2
Sw3
Sw4
Sma1
Sma2
Sma3
Sma4
Sma5
Ssa1
Ssa2
Ssa3
Ssa4
Ssa5
Sds1
Sds2
C1
C2
C3
C4
C5
DISPLAY ANODE DRIVING SECTION
WRITING PULSE GENERATING CIRCUIT
WRITING CONTROL GATE SIGNAL GENERATING CIRCUIT
CATHODE DRIVING SECTION
SCANNING-MAINTAINING PULSE GENERATING CIRCUIT
SCANNING-MAINTAINING CONTROL GATE SIGNAL GENERATING CIRCUIT
SUBSIDIARY ANODE DRIVING SECTION
SUBSIDIARY DISCHARGE PULSE GENERATING CIRCUIT
SUBSIDIARY CONTROL GATE SIGNAL GENERATING CIRCUIT
WRITING CONTROL INFORMATION
SCANNING & MAINTAINING CONTROL INFORMATION
SUBSIDIARY DISCHARGE CONTROL INFORMATION

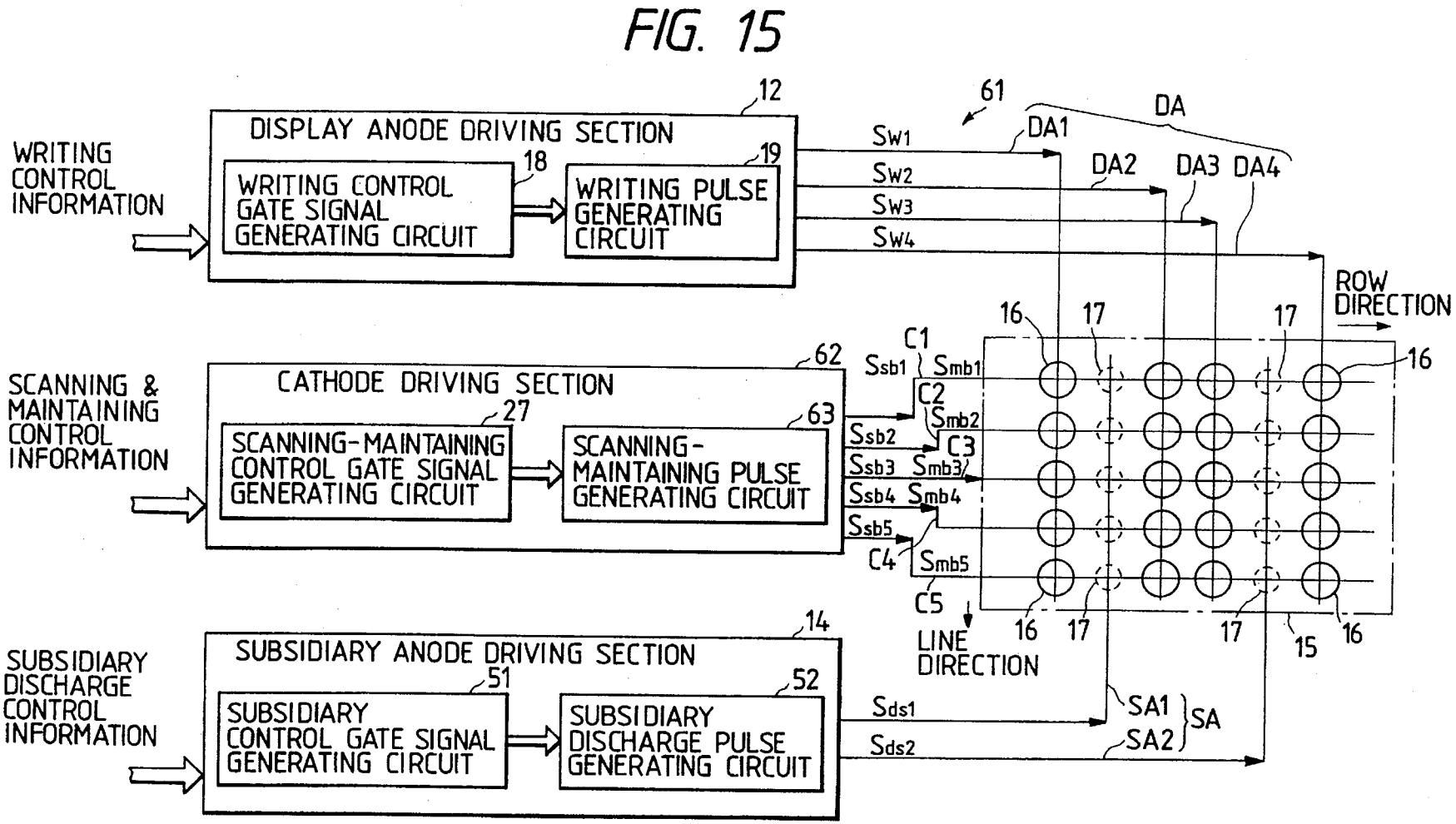
FIG. 15
DISPLAY ANODE DRIVING SECTION
WRITING CONTROL GATE SIGNAL GENERATING CIRCUIT
WRITING PULSE GENERATING CIRCUIT
CATHODE DRIVING SECTION
SCANNING-MAINTAINING CONTROL GATE SIGNAL GENERATING CIRCUIT
SCANNING-MAINTAINING PULSE GENERATING CIRCUIT
SUBSIDIARY ANODE DRIVING SECTION
SUBSIDIARY CONTROL GATE SIGNAL GENERATING CIRCUIT
SUBSIDIARY DISCHARGE PULSE GENERATING CIRCUIT
WRITING CONTROL INFORMATION
SCANNING & MAINTAINING CONTROL INFORMATION
SUBSIDIARY DISCHARGE CONTROL INFORMATION
ROW DIRECTION
LINE DIRECTION
DA
DA1
DA2
DA3
DA4
SA
SA1
SA2
Sw1
Sw2
Sw3
Sw4
Ssb1
Ssb2
Ssb3
Ssb4
Ssb5
Smb1
Smb2
Smb3
Smb4
Smb5
Sds1
Sds2
C1
C2
C3
C4
C5
12
14
15
16
17
18
19
27
51
52
61
62
63

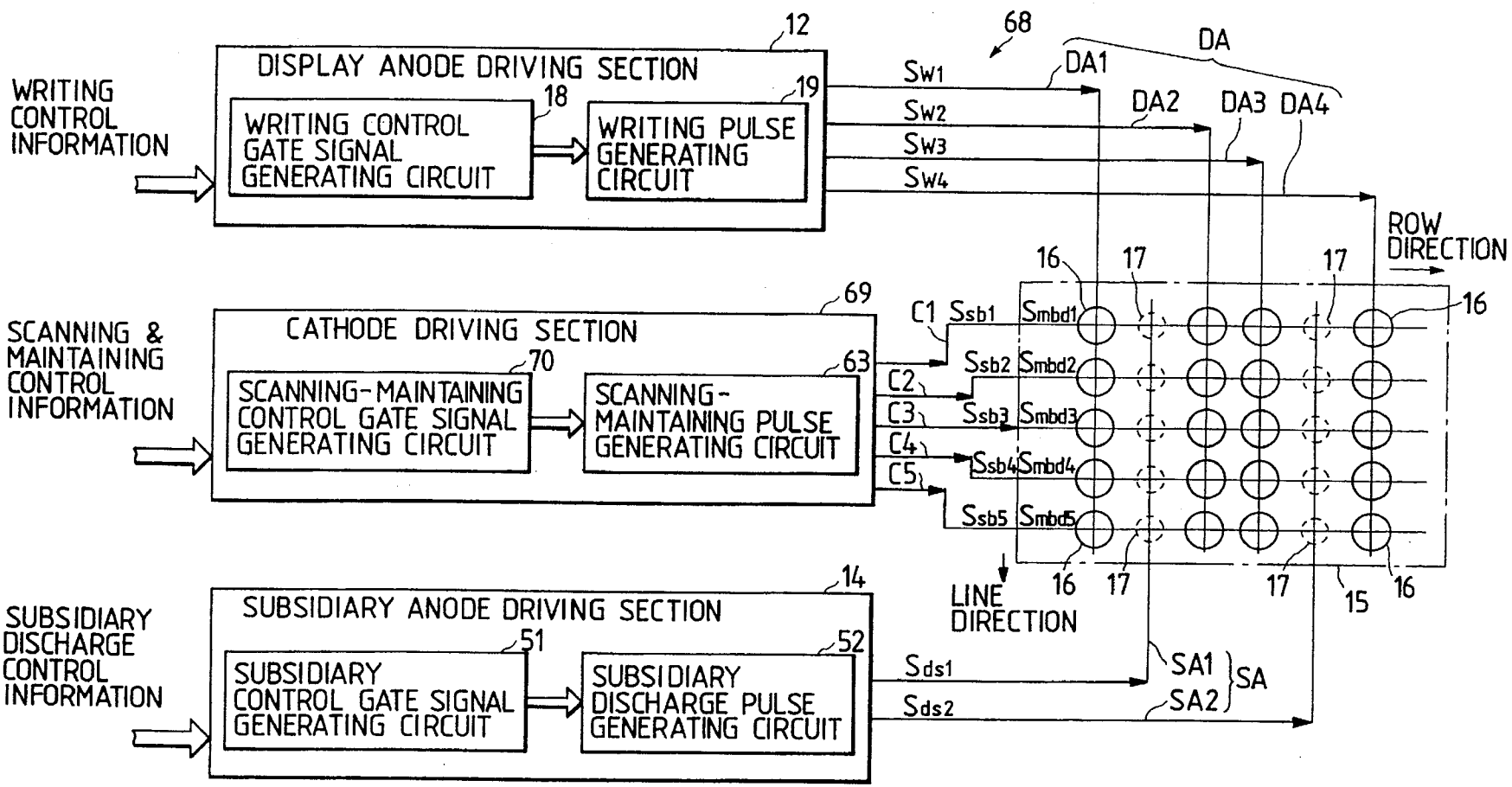
FIG. 18
DISPLAY ANODE DRIVING SECTION
WRITING PULSE GENERATING CIRCUIT
WRITING CONTROL GATE SIGNAL GENERATING CIRCUIT
CATHODE DRIVING SECTION
SCANNING-MAINTAINING PULSE GENERATING CIRCUIT
SCANNING-MAINTAINING CONTROL GATE SIGNAL GENERATING CIRCUIT
SUBSIDIARY ANODE DRIVING SECTION
SUBSIDIARY DISCHARGE PULSE GENERATING CIRCUIT
SUBSIDIARY CONTROL GATE SIGNAL GENERATING CIRCUIT
WRITING CONTROL INFORMATION
SCANNING & MAINTAINING CONTROL INFORMATION
SUBSIDIARY DISCHARGE CONTROL INFORMATION
ROW DIRECTION
LINE DIRECTION
DA
DA1
DA2
DA3
DA4
SA
SA1
SA2
Sw1
Sw2
Sw3
Sw4
Smbd1
Smbd2
Smbd3
Smbd4
Smbd5
Ssb1
Ssb2
Ssb3
Ssb4
Ssb5
Sds1
Sds2
C1
C2
C3
C4
C5
12
14
15
16
17
18
19
51
52
63
68
69
70

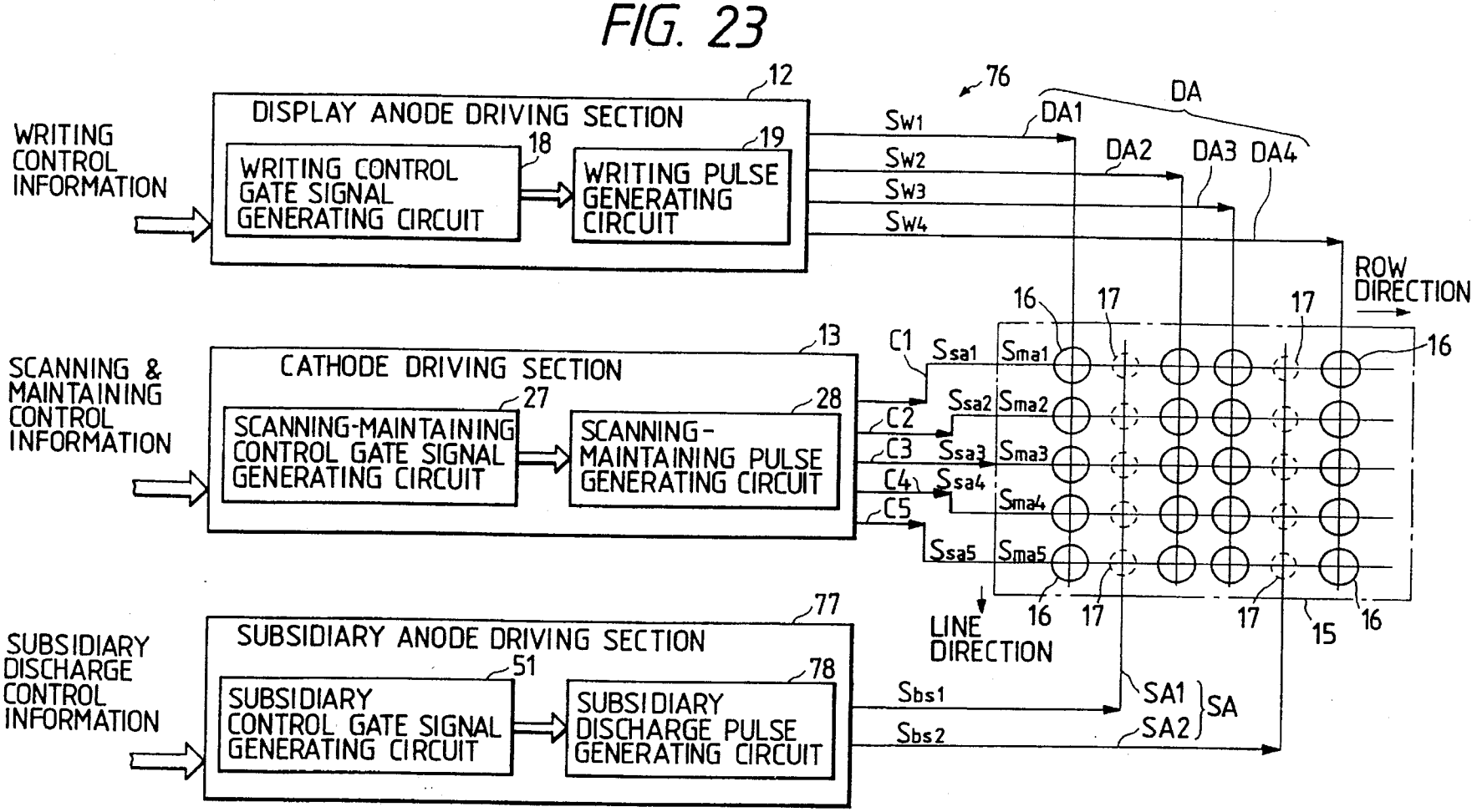
FIG. 23
DISPLAY ANODE DRIVING SECTION
WRITING CONTROL GATE SIGNAL GENERATING CIRCUIT
WRITING PULSE GENERATING CIRCUIT
CATHODE DRIVING SECTION
SCANNING-MAINTAINING CONTROL GATE SIGNAL GENERATING CIRCUIT
SCANNING-MAINTAINING PULSE GENERATING CIRCUIT
SUBSIDIARY ANODE DRIVING SECTION
SUBSIDIARY CONTROL GATE SIGNAL GENERATING CIRCUIT
SUBSIDIARY DISCHARGE PULSE GENERATING CIRCUIT
WRITING CONTROL INFORMATION
SCANNING & MAINTAINING CONTROL INFORMATION
SUBSIDIARY DISCHARGE CONTROL INFORMATION
ROW DIRECTION
LINE DIRECTION
DA
DA1
DA2
DA3
DA4
SA
SA1
SA2
Sw1
Sw2
Sw3
Sw4
Sma1
Sma2
Sma3
Sma4
Sma5
Ssa1
Ssa2
Ssa3
Ssa4
Ssa5
Sbs1
Sbs2
C1
C2
C3
C4
C5
12
13
15
16
17
18
19
27
28
51
76
77
78

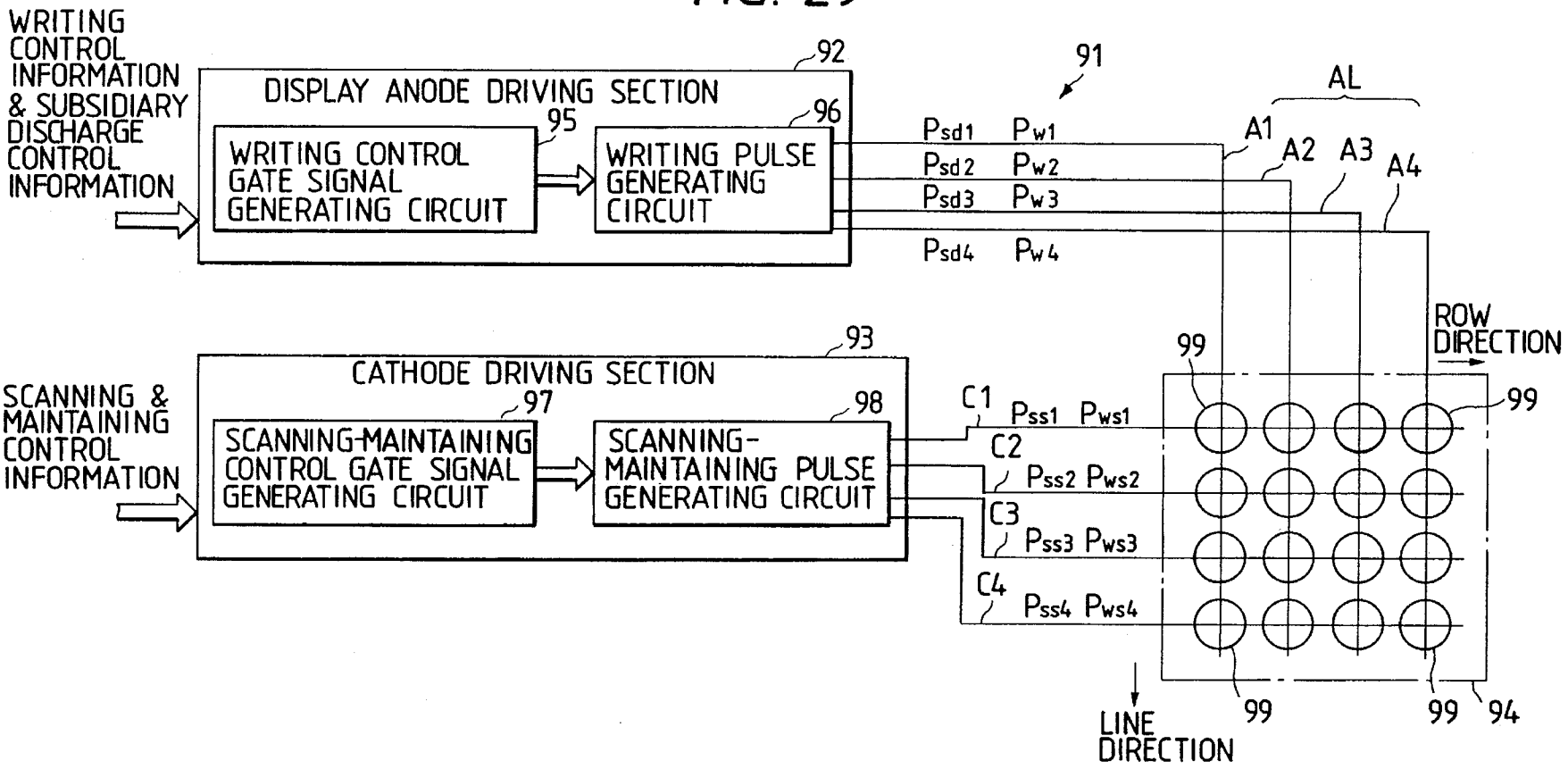
FIG. 29
91
92
93
94
95
96
97
98
99
AL
A1
A2
A3
A4
ROW DIRECTION
LINE DIRECTION
$P_{w1}$
$P_{w2}$
$P_{w3}$
$P_{w4}$
$P_{sd1}$
$P_{sd2}$
$P_{sd3}$
$P_{sd4}$
$P_{ws1}$
$P_{ws2}$
$P_{ws3}$
$P_{ws4}$
$P_{ss1}$
$P_{ss2}$
$P_{ss3}$
$P_{ss4}$
C1
C2
C3
C4
DISPLAY ANODE DRIVING SECTION
WRITING PULSE GENERATING CIRCUIT
WRITING CONTROL GATE SIGNAL GENERATING CIRCUIT
CATHODE DRIVING SECTION
SCANNING-MAINTAINING PULSE GENERATING CIRCUIT
SCANNING-MAINTAINING CONTROL GATE SIGNAL GENERATING CIRCUIT
WRITING CONTROL INFORMATION & SUBSIDIARY DISCHARGE CONTROL INFORMATION
SCANNING & MAINTAINING CONTROL INFORMATION

METHOD FOR DRIVING GAS DISCHARGE DISPLAY PANEL AND GAS DISCHARGE DISPLAY EQUIPMENT IN WHICH THE GAS DISCHARGE DISPLAY PANEL IS DRIVEN ACCORDING TO THE METHOD

BACKGROUND OF THE INVENTION

1. Field of the Invention

The present invention relates generally to a method for driving a gas discharge display panel utilized to drive a matrix type of gas discharge display panel, and more particularly to a method for driving a gas discharge display panel in which gas discharge is continued during a maintaining period for a viewer to feel visible light. Also, the present invention relates to a gas discharge display equipment in which the gas discharge display panel is driven according to the method.

2. Description of the Related Art

A color cathode-ray tube (CRT) has been utilized for a color television. Also, a gas discharge display panel has been recently required in place of the CRT to minimize the color television. As is well known, there are two types of gas discharge display panels. One is an alternate current type of gas discharge display panel, and another is a direct current type of gas discharge display panel. The direct current type of gas discharge display panel is superior for practical use as compared with the alternate current type of gas discharge display panel.

2.1. Previously Proposed Art

A conventional method for driving a gas discharge display panel according to a pulse memory process is described. The conventional method has been proposed by Murakami in a paper J73-C-11 published by Institute of Telecommunications Engineers.

FIG. 1 is a plan view of a gas discharge display panel driven according to a pulse memory process.

As shown in FIG. 1, a gas discharge display panel 151 is provided with a group of scanning electrodes 152 formed of a plurality of cathode lines C1 to Cm arranged in parallel, a group of display electrodes 153 formed of a plurality of anode lines A1 to An which are arranged in parallel and cross over the scanning electrodes 152, and a plurality of display cells 154 arranged at intersection spaces between the cathode lines and the anode lines. Each of the display cells 154 is filled with discharge gas such as helium-xenon gas, and fluorescent material is applied on a surface of each of the display cells 154. Therefore, when a comparatively high electric potential difference is generated between the cathode line and the anode line, gas discharge is produced in the discharge gas so that ultraviolet light is radiated from the discharge gas. The ultraviolet light is changed to visible light by the action of the fluorescent material so that a viewer can feel the visible light.

In the above configuration, as shown in FIG. 2, a series of maintaining pulses Pm having a positive voltage $V_A$ is always applied on each of the anode lines A1 to An, and a scanning pulse Ps having a negative voltage Vsc is applied on each of the cathode lines C1 to Cm according to pieces of display information.

When a piece of display information is, for example, transferred to a display control section (not shown) to produce visible light in a specific display cell 154*a* arranged at the intersection space between the cathode line C2 and the anode line A2, a scanning pulse Ps is applied on the cathode line C2 in non-synchronism with the maintaining pulses Pm, and a writing pulse Pw having a positive voltage Vw is applied on the anode line A2 in synchronism with the scanning pulse Ps. Therefore, writing gas discharge is produced in the discharge gas filled in the specific display cell 154*a*. In this case, a gas discharge starting electric potential difference required to initially produce gas discharge in the display cells 154 is comparatively high. Therefore, the writing gas discharge is produced while applying the scanning pulse Pw. After the writing gas discharge is produced, excited particles are temporarily generated in the specific gas cell. Therefore, gas discharge subsequent to the writing gas discharge is easily produced at a comparatively low electric potential difference.

Thereafter, a series of maintaining pulses Pm is applied on the anode line A2 to intermittently produce maintaining gas discharge during a maintaining period in the specific display cell 154*a*. In this case, a maintaining negative voltage Vca higher than the negative voltage Vsc of the scanning pulse Ps is continuously applied on the cathode line C2. Therefore, a viewer can feel visible light.

After the maintaining period passes, an erasing pulse Per having an erasing negative voltage $V_E$ is applied on the cathode line C2 to stop the maintaining gas discharge. The erasing voltage $V_E$ of the erasing pulse Per is higher than the maintaining voltage Vca. Therefore, the maintaining gas discharge is stopped. Thereafter, even though the maintaining pulses Pm is applied on the anode line A2 and the maintaining voltage Vca is continuously applied on the cathode line C2, any gas discharge is not produced in the specific display cell 154*a* because the gas discharge starting electric potential difference is comparatively high.

Accordingly, because the maintaining gas discharge is intermittently produced during the maintaining period, the brightness of the visible light can be sufficiently high. For example, the maximum brightness of the visible light reaches a practical level 100 candela/$m^2$.

2.2. Another Previously Proposed Art

FIG. 3 is a plan view of a matrix type of gas discharge display panel having an electrode structure conventionally utilized. A matrix type of gas discharge display panel 200 shown in FIG. 3 has been conventionally developed as one of gas discharge display panels. The display panel 200 was laid open to public inspection under Provisional Publication No. S57-86886 (Japanese Patent Application No. S55-162709).

FIG. 4 shows waveforms of various signals transmitted in the display panel shown in FIG. 3.

As shown in FIG. 3, the gas discharge display panel 200 is provided with a plurality of cathode lines 201 arranged in a row direction at first and second regular intervals, a plurality of display anode lines 203 arranged in a line direction while crossing over the cathode lines 201 at third regular intervals, a plurality of display cells 202 arranged at intersection spaces between the cathode lines 201 and the display anode lines 203, a plurality of subsidiary anode lines 205 arranged in parallel to the display anode lines 203 and between the display anode lines 203, and a plurality of subsidiary cells 204 arranged at intersection spaces between the cathode lines 201 and the subsidiary anode lines 205.

Each of the subsidiary anode lines 205 is positioned every two display anode lines 203 so that each of the display cells 202 faces only one of the subsidiary cells 204.

Each of the subsidiary anode lines 205 is always applied at a subsidiary anode voltage Vsa through a resistor (not shown) having a high resistance. Each of the cathode lines 201 is normally applied at a maintaining cathode voltage Vca. Maintaining anode pulse signals Sap are always transmitted on each of the display anode lines 203 at a regular cycle T. Each of the maintaining anode pulse signals Sap has a pulse width τap and a peak voltage Vap.

In the above configuration, a scanning pulse signal Scp is applied to each of the cathode lines 201. The scanning pulse signal Scp has a pulse width τcp and a peak voltage Vcp. As shown in FIG. 4, when a first scanning pulse signal Scp is initially transmitted on a first line C1 of the cathode lines 201, a subsidiary cell current $Is_1$ flows from the subsidiary anode lines 205 to the first line C1 through first subsidiary cells 204 arranged at the intersection spaces between the first line C1 and the subsidiary anode lines 205. Therefore, subsidiary gas discharge is produced in the first subsidiary cells 204. In contrast, because all of the display anode lines 203 are maintained at a zero voltage, a first display cell current $Id_1$ does not flow through any of the display cells 202. Therefore, writing gas discharge is not produced in any of the display cells 202.

When a second scanning pulse signal Scp is thereafter transmitted on a second line C2 of the cathode lines 201, a writing pulse signal Sw is applied on a second line DA2 of the display anode lines 203 in synchronism with the second scanning pulse signal Scp. The writing pulse signal Sw has a pulse width τw and a peak voltage Vw. Therefore, a subsidiary cell current $Is_2$ flows from the subsidiary anode lines 205 to the second line C2 through second subsidiary cells 204 arranged at the intersection spaces between the second line C2 and the subsidiary anode lines 205. Therefore, subsidiary gas discharge is produced in the second subsidiary cells 204. Also, because the writing pulse signal Sw is applied on the second line DA2 in synchronism with the second scanning pulse signal Scp, a second display cell current $Id_2$ flows through a specific display cell 202 arranged at the intersection space between the second line C2 and the second line DA2. Therefore, writing gas discharge is produced in the specific display cell 202, and visible light is radiated from the specific display cell 202 to a viewer.

In this case, because excited particles are produced in both the specific display cell 202 and the second subsidiary cell 204 facing the specific display cell 202, the specific display cell 202 and the second subsidiary cell 204 facing the specific display cell 202 are coupled to each other through the excited particles which function as priming. As a result, the writing gas discharge is produced in the specific display cell 202 at sufficiently high speed.

Thereafter, because the maintaining anode pulse signal Sap is always transmitted on the second line C2 of the display anode lines 203, subsequent display cell currents Ids subsequent to the second display cell current $Id_2$ intermittently flow through the specific display cell 202 in synchronism with pulses of the maintaining anode pulse signal Sap. In this case, maintaining gas discharge is intermittently produced in the specific display cell 202 during a maintaining period. Accordingly the viewer can continuously feel the visible light during the maintaining period. After the maintaining period passes, an erasing period subsequent to the maintaining period is started. Therefore, an erasing signal Ser having a voltage Ver is transmitted on the second line C2 of the cathode lines 201 to stop the maintaining gas discharge produced in the specific display cell 202. Therefore, the visible light radiated from the specific display cell 202 is stopped by the erasing signal Ser.

When a third scanning pulse signal Scp is thereafter transmitted on a third line C3 of the cathode lines 201, a subsidiary cell current $Is_3$ flows from the subsidiary anode lines 205 to the third line C3 through third subsidiary cells 204 arranged at the intersection spaces between the third line C3 and the subsidiary anode lines 205. Therefore, subsidiary gas discharge is produced in the third subsidiary cells 204. In contrast, because all of the display anode lines 203 are maintained at a zero voltage, writing gas discharge is not produced in the display cells 202 in the same manner as in the first scanning pulse signal Scp. Therefore, even though the maintaining anode pulse signals Sap are transmitted on the display anode lines 203 after the third scanning pulse signal Scp is transmitted on the third line C3, a third display cell current $Id_3$ does not flow through any of the display cells 202.

Accordingly, in cases where a writing pulse signal Sw is applied on a display anode line 203 in synchronism with a scanning pulse signal Scp, visible light can be radiated from the display cell 202.

Also, because excited particles are produced between the display cell 202 and a subsidiary cell 204 facing the specific display cell 202, the visible light can be radiated at sufficiently high speed.

2.3. Problems to be solved by the Invention

However, there are many drawbacks in the conventional method for driving the gas discharge display panel 151

That is, two circuits are additionally required to drive the gas discharge display panel 151 according to the conventional method. One of the circuits is required to generate the maintaining pulses Pm and the writing pulses Pw. The other circuit is required to generate the scanning pulses Ps and the erasing pulses Per. As a result, the circuits are complicated. Also, because the maintaining pulses Pm are always applied on the anode lines, an electric power required to generate the maintaining pulses Pm is consumed in vain during a non-display period subsequent to the maintaining period without radiating the visible light.

Also, there are many drawbacks in the conventional method for driving the gas discharge display panel 200.

That is, the maintaining anode pulse signals Sap are always transmitted on each of the display anode lines 203 regardless of whether the maintaining gas discharge is produced in the specific display cell 202. Therefore, after the maintaining gas discharge is stopped, an electric power required to continuously generate the maintaining anode pulse signals Sap is unavailingly consumed as an electric power loss because the electric power is not contributed to the maintaining gas discharge in the gas discharge display panel 200.

In detail, because the maintaining anode pulse signals Sap are always applied on the display anode lines 203 without producing the maintaining gas discharge, an electric power loss P is substantially expressed by an equation (1).

$$P=(m*n*C_o*Vap^2)/T \quad (2)$$

where the symbol m denotes the number of cathode lines 201, the symbol n denotes the number of display anode lines 203, the symbol $C_o$ denotes a capacitance of one of the display cells 202 arranged between the cathode lines 201 and the display anode lines 203, the symbol Vap denotes a peak voltage of the maintaining anode pulse signals Sap, and the symbol T is a cycle of the maintaining anode pulse signals Sap.

As is formulated in the equation (1), in cases where the gas discharge display panel 200 is manufactured in large-sized one, the electric power loss P is increased in proportion as the number of cathode lines 201 and/or the number of display anode lines 203 are increased. Also, the electric power loss P is increased in proportion as the cycle T of the maintaining anode pulse signals Sap is shortened. As a result, a driving efficiency in the gas discharge display panel 200 deteriorates.

Also, because the writing pulse signal Sw and the maintaining anode pulse signals Sap are transmitted on the display anode lines 203, the preparation of three types of voltages such as 0, Vw, and Vap are required. Also, because the maintaining cathode voltage Vca, the scanning pulse signal Scp, and the erasing pulse signal Ser are transmitted on the cathode lines 201, the preparation of three types of voltages such as Vca, Vcp, and Ver are required. As a result, a driving circuit in which those signals are produced is complicated and becomes large.

SUMMARY OF THE INVENTION

A first object of the present invention is to provide, with due consideration to the drawbacks of such a conventional method for driving a gas discharge display panel, a method for driving a gas discharge display panel in which an overall driving efficiency including a driving efficiency of the display panel and another driving efficiency of a driving circuit does not deteriorate even though the display panel is manufactured in large size or a cycle of a maintaining anode pulse signals is shortened. Also, the first object is to provide the method in which the driving circuit is simplified.

A second object is to provide a gas discharge display equipment in which the gas discharge display panel is driven according to the method.

The first object is achieved by the provision of a method for driving a gas discharge display panel comprising a plurality of display electrode lines arranged side by side, a plurality of scanning electrode lines which are arranged side by side and cross the display electrode lines, and a plurality of discharge cells arranged at intersection spaces between the display electrode lines and the scanning electrode lines, comprising the steps of:

applying a writing pulse on a specific display electrode line selected from the display electrode lines according to a piece of display information; applying a scanning pulse on a specific scanning electrode line selected from the scanning electrode lines in synchronism with the writing pulse to produce writing gas discharge in cooperation with the writing pulse in a specific discharge cell arranged at an intersection space between the specific display electrode and the specific scanning electrode line; and applying a series of maintaining pulses on the specific scanning electrode during only a maintaining period to produce maintaining gas discharge subsequent to the writing gas discharge in the specific discharge cell, the maintaining gas discharge being intermittently produced in synchronism with the maintaining pulses subsequent to the scanning pulse.

In the above steps, when a writing pulse is applied on the specific display electric line, a scanning pulse is also applied on the specific scanning electrode line in synchronism with the writing pulse. Therefore, a high electric potential difference is generated between the specific display electric line and the specific scanning electrode line. As a result, writing gas discharge is produced in the specific discharge cell arranged at the intersection space between the specific display electric line and the specific scanning electrode line. In this case, excited particles are generated in the specific discharge cell so that gas discharge subsequent to the writing gas discharge can be easily produced in the specific discharge cell by generating a comparatively low electric potential difference between the specific display electric line and the specific scanning electrode line.

Thereafter, a large number of maintaining pulses are intermittently applied on the specific scanning electrode line without applying any pulse on the specific display electrode line. In this case, because gas discharge subsequent to the writing gas discharge can be easily produced in the specific discharge cell, maintaining gas discharge subsequent to the writing gas discharge is intermittently produced in the specific discharge cell in synchronism with the maintaining pulses during a maintaining period even though no pulse is applied on the specific discharge electrode line. Therefore, a viewer can feel visible light radiated from the specific discharge cell.

After the maintaining period passes, the transmission of the maintaining pulses to the specific scanning electrode line is stopped. Therefore, the maintaining gas discharge is stopped without applying any pulse on the scanning or display electrode lines.

Accordingly, because no pulse is applied on the scanning or display electrode lines after the maintaining period passes, an electric power required to produce the maintaining pulses can be effectively consumed to produce the maintaining gas discharge in the maintaining period. In other words, the electric power is not consumed in a non-display period subsequent to the maintaining period so that all of the electric power can be contributed to the writing gas discharge or the maintaining gas discharge produced in the gas discharge display apparatus.

Also, because no pulse is required to stop the maintaining gas discharge, a pulse generating circuit required to drive the panel can be simplified.

Also, the first object is achieved by the provision of a method for driving a gas discharge panel comprising a plurality of display electrode lines arranged side by side, a plurality of scanning electrode lines which are arranged side by side and cross the display electrode lines, a plurality of display cells arranged at intersection spaces between the display electrode lines and the scanning electrode lines, and a plurality of subsidiary electrode lines which are arranged side by side between the scanning electrode lines, and a plurality of subsidiary cells which are arranged at intersection spaces between the subsidiary electrode lines and the scanning electrode lines and are respectively positioned between the display cells, comprising the step of:

applying a scanning pulse signal on a specific scanning electrode line selected from the scanning electrode lines according to a piece of scanning information;

applying a writing pulse signal on a specific writing electrode line selected from the writing electrode lines in synchronism with the scanning pulse signal according to a piece of writing information to produce writing gas discharge in cooperation with the scanning pulse signal in a specific display cell arranged at an intersection space between the specific display electrode line and the specific scanning electrode line;

applying a subsidiary pulse signal on a specific subsidiary electrode line selected from the subsidiary electrode lines in synchronism with the scanning pulse signal according to a piece of subsidiary discharge information to produce subsidiary gas discharge in cooperation with the scanning pulse signal in a specific subsidiary cell which is arranged at an intersection space between the specific subsidiary electrode line and the specific scanning electrode line and is positioned adjacent to the specific display cell, the subsidiary gas discharge quickening the writing gas discharge produced in the specific display cell; and applying a maintaining pulse signal subsequent to the scanning pulse signal on the specific scanning electrode line during only a maintaining period according to a piece of maintaining information to produce maintaining gas discharge subsequent to the writing gas discharge in the specific display cell, the maintaining gas discharge being intermittently produced in synchronism with pulses of the maintaining pulse signal.

In the above steps, when a pulse of the writing pulse signal is applied on the specific display electrode line, a pulse of the scanning pulse signal is applied on the specific scanning electrode line in synchronism with the writing pulse signal. Therefore, a high electric potential difference is generated between the specific display electrode line and the specific scanning electrode line. As a result, writing gas discharge is produced in the specific display cell arranged between the specific display electrode line and the specific scanning electrode line. Also, visible light resulting from the writing gas discharge is momentarily radiated to a viewer. However, the viewer cannot generally feel the momentary visible light.

Also, a pulse of the subsidiary pulse signal is applied on the specific subsidiary electrode line in synchronism with the writing pulse signal. Therefore, a high electric potential difference is generated between the specific subsidiary electrode line and the specific scanning electrode line. As a result, subsidiary gas discharge is produced in the specific subsidiary cell arranged between the specific subsidiary electrode line and the specific scanning electrode line. In this case, because the specific subsidiary cell is adjacent to the specific display cell, the writing gas discharge produced in the specific display cell is quickened by the production of the subsidiary gas discharge. Also, excited particles are generated in the specific display cell so that gas discharge subsequent to the writing gas discharge can be easily produced in the specific display cell by generating a comparatively low electric potential difference between the specific display electric line and the specific scanning electrode line.

Thereafter, a series of pulses of the maintaining pulse signal is applied on the scanning electrode line during a maintaining period. At this time, no pulse is applied on the display electrode line or the subsidiary electrode line. Therefore, a comparatively low electric potential difference is generated between the specific writing electrode line and the specific scanning electrode line. As a result, because gas discharge subsequent to the writing gas discharge can be easily produced in the specific display cell, maintaining gas discharge subsequent to the writing gas discharge is produced in the specific display cell during the maintaining period even though the low electric potential difference is generated between the specific writing electrode line and the specific scanning electrode line. Accordingly, because the maintaining gas discharge is produced during the maintaining period, visible light resulting from the maintaining gas discharge is intermittently radiated to the viewer during the maintaining period. Therefore, the viewer can feel the visible light.

After the maintaining period passes, the transmission of the maintaining pulse signal is stopped without applying any erasing pulse on the display electrode line or the scanning electrode line. Therefore, no electric potential difference is generated between the specific writing electrode line and the specific scanning electrode line. As a result, the maintaining gas discharge is stopped.

Accordingly, because no pulse is applied on the scanning or display electrode lines after the maintaining period passes, an electric power required to produce the maintaining pulse signal can be effectively consumed to produce the maintaining gas discharge in the maintaining period. In other words, the electric power is not consumed in an erasing period subsequent to the maintaining period so that all of the electric power can be contributed to the writing gas discharge or the maintaining gas discharge produced in the gas discharge display apparatus.

Also, because no pulse is required to stop the maintaining gas discharge, a pulse generating circuit required to drive the panel can be simplified.

Also, the first object is achieved by the provision of a method for driving a gas discharge display panel comprising a plurality of display electrode lines arranged side by side, a plurality of scanning electrode lines which are arranged side by side and cross the display electrode lines, and a plurality of display cells arranged at intersection spaces between the display electrode lines and the scanning electrode lines, comprising the step of:

applying a subsidiary scanning pulse on a specific scanning electrode line selected from the scanning electrode lines;

applying a subsidiary pulse on a specific display electrode line selected from the display electrode lines in synchronism with the subsidiary scanning pulse to produce subsidiary gas discharge in cooperation with the subsidiary scanning pulse in a specific display cell which is arranged at an intersection space between the specific display electrode line and the specific scanning electrode line;

applying a writing scanning pulse on the specific scanning electrode line;

applying a writing pulse on the specific display electrode line in synchronism with the writing scanning pulse to produce writing gas discharge in the specific display cell in cooperation with the writing scanning pulse, the writing gas discharge being quickened by the subsidiary gas discharge;

applying a maintaining pulse signal subsequent to the writing scanning pulse signal on the specific scanning electrode line during only a maintaining period to produce maintaining gas discharge subsequent to the writing gas discharge in the specific display cell, the maintaining gas discharge being intermittently produced in synchronism with pulses of the maintaining pulse signal.

In the above steps, the subsidiary gas discharge and the writing gas discharge are produced in the same specific display cell. Therefore, even though no subsidiary cell is provided in the gas discharge display panel, the writing gas discharge can be produced at high speed by the influence of the subsidiary gas discharge.

The second object is achieved by the provision of a gas discharge display equipment, comprising:

a gas discharge display panel comprising a plurality of display electrode lines arranged side by side, a plurality of scanning electrode lines which are arranged side by side and cross the display electrode lines, a plurality of display cells arranged at intersection spaces between the display electrode lines and the scanning electrode lines, a plurality of subsidiary electrode lines which are arranged side by side between the scanning electrode lines, and a plurality of subsidiary cells which are arranged at intersection spaces between the subsidiary electrode lines and the scanning electrode lines and are respectively positioned between the display cells;

a writing pulse generating circuit for generating a writing pulse signal applied on a specific writing electrode line selected from the writing electrode lines of the gas discharge display panel;

a scanning-maintaining pulse generating circuit for generating a scanning pulse signal applied on a specific scanning electrode line selected from the scanning electrode lines of the gas discharge display panel to produce writing gas discharge in a specific display cell of the gas discharge display panel which is arranged at an intersection space between the specific display electrode line and the specific scanning electrode line, the writing gas discharge being produced in cooperation with the writing pulse signal generated in the writing pulse generating circuit, and generating a maintaining pulse signal subsequent to the scanning pulse signal applied on the specific scanning electrode line during only a maintaining period to produce maintaining gas discharge subsequent to the writing gas discharge in the specific display cell, the maintaining gas discharge being intermittently produced in synchronism with pulses of the maintaining pulse signal; and a subsidiary discharge pulse generating circuit for generating a subsidiary pulse signal applied on a specific subsidiary electrode line selected from the subsidiary electrode lines of the gas discharge display panel in synchronism with the scanning pulse signal generated in the scanning-maintaining pulse generating circuit to produce subsidiary gas discharge in a specific subsidiary cell of the gas discharge display panel which is arranged at an intersection space between the specific subsidiary electrode line and the specific scanning electrode line and is positioned adjacent to the specific display cell, the subsidiary gas discharge quickening the writing gas discharge produced in the specific display cell.

In the above configuration, the writing pulse signal is generated in the writing pulse generating circuit and is applied on the specific writing electrode line of the gas discharge display panel. Also, the scanning pulse signal is generated in the scanning-maintaining pulse generating circuit and is applied on the specific scanning electrode line of the gas discharge display panel. Also, the subsidiary pulse signal is generated in the subsidiary discharge pulse generating circuit and is applied on the specific subsidiary electrode line of the gas discharge display panel.

Therefore, the gas discharge display panel can be reliably driven according to the method mentioned above.

BRIEF DESCRIPTION OF THE DRAWINGS

The objects, features and advantages of the present invention will be apparent from the following description taken in conjunction with the accompanying drawings, in which:

FIG. 6 is a composite view of a block diagram of driving circuits and a plan view of a gas discharge display panel according to a second embodiment of the present invention, a gas discharge display apparatus consisting of the driving circuits and the gas discharge display panel;

FIG. 15 is a composite view of a block diagram of driving circuits and the plan view of the gas discharge display panel shown in FIG. 6 according to a third embodiment of the present invention, a gas discharge display apparatus consisting of the driving circuits and the gas discharge display panel;

FIG. 18 is a composite view of a block diagram of driving circuits and the plan view of the gas discharge display panel shown in FIG. 6 according to a fourth embodiment of the present invention, a gas discharge display apparatus consisting of the driving circuits and the gas discharge display panel;

FIG. 23 is a composite view of a block diagram of driving circuits and the plan view of the gas discharge display panel shown in FIG. 6 according to a sixth embodiment of the present invention, a gas discharge display apparatus consisting of the driving circuits and the gas discharge display panel;

FIG. 29 is a composite view of a block diagram of driving circuits and the plan view of a gas discharge display panel according to an eighth embodiment of the present invention, a gas discharge display apparatus consisting of the driving circuits and the gas discharge display panel;

DETAIL DESCRIPTION OF THE PREFERRED EMBODIMENTS

Preferred embodiments of a method for driving a gas discharge display panel according to the present invention are described with reference to drawings.

Figure 1:
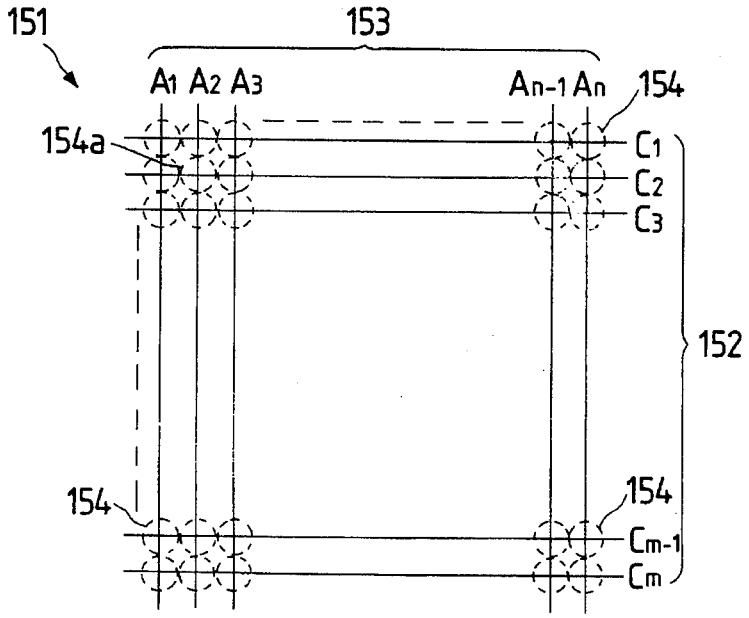
FIG. 1 PRIOR ART
FIG. 1 is a plan view of a gas discharge display panel.
Figure 2:
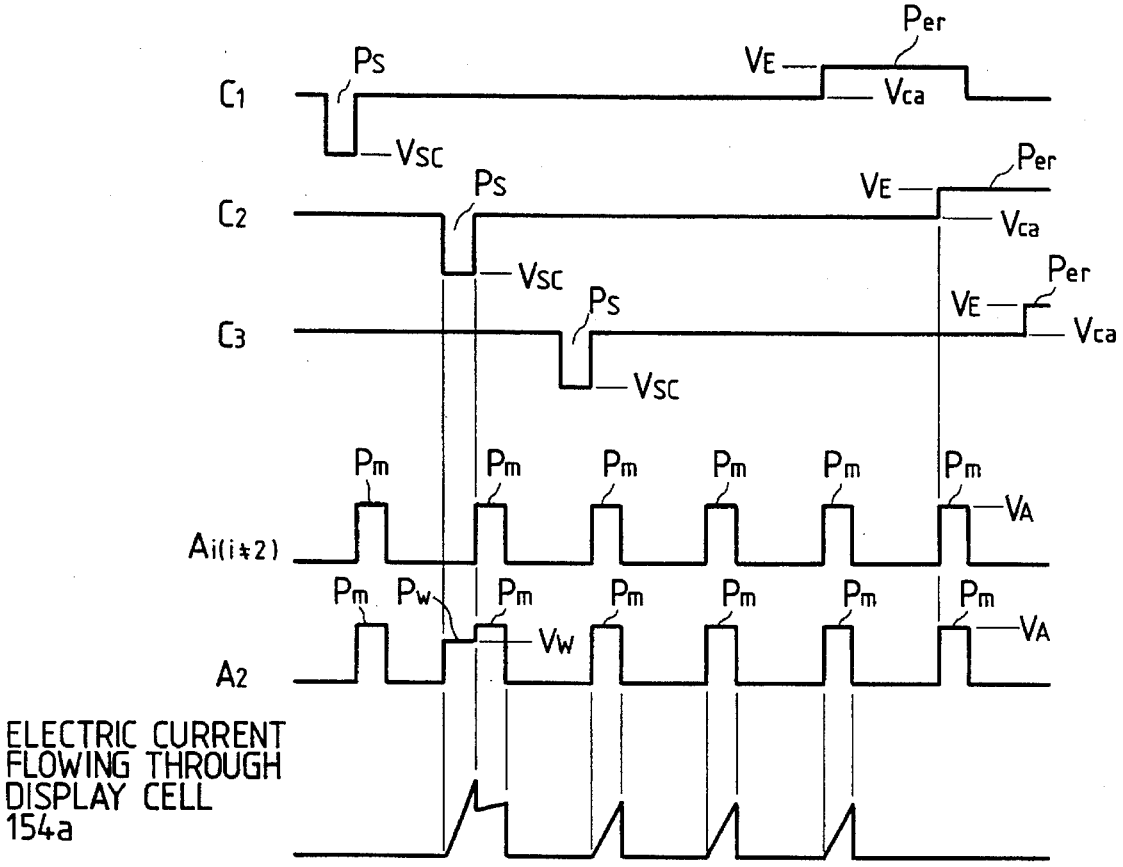
FIG. 2 PRIOR ART
FIG. 2 shows waveforms of various signals transmitted in the display panel shown in FIG. 1, the panel being driven according to a pulse memory process of a conventional method.
Figure 5:
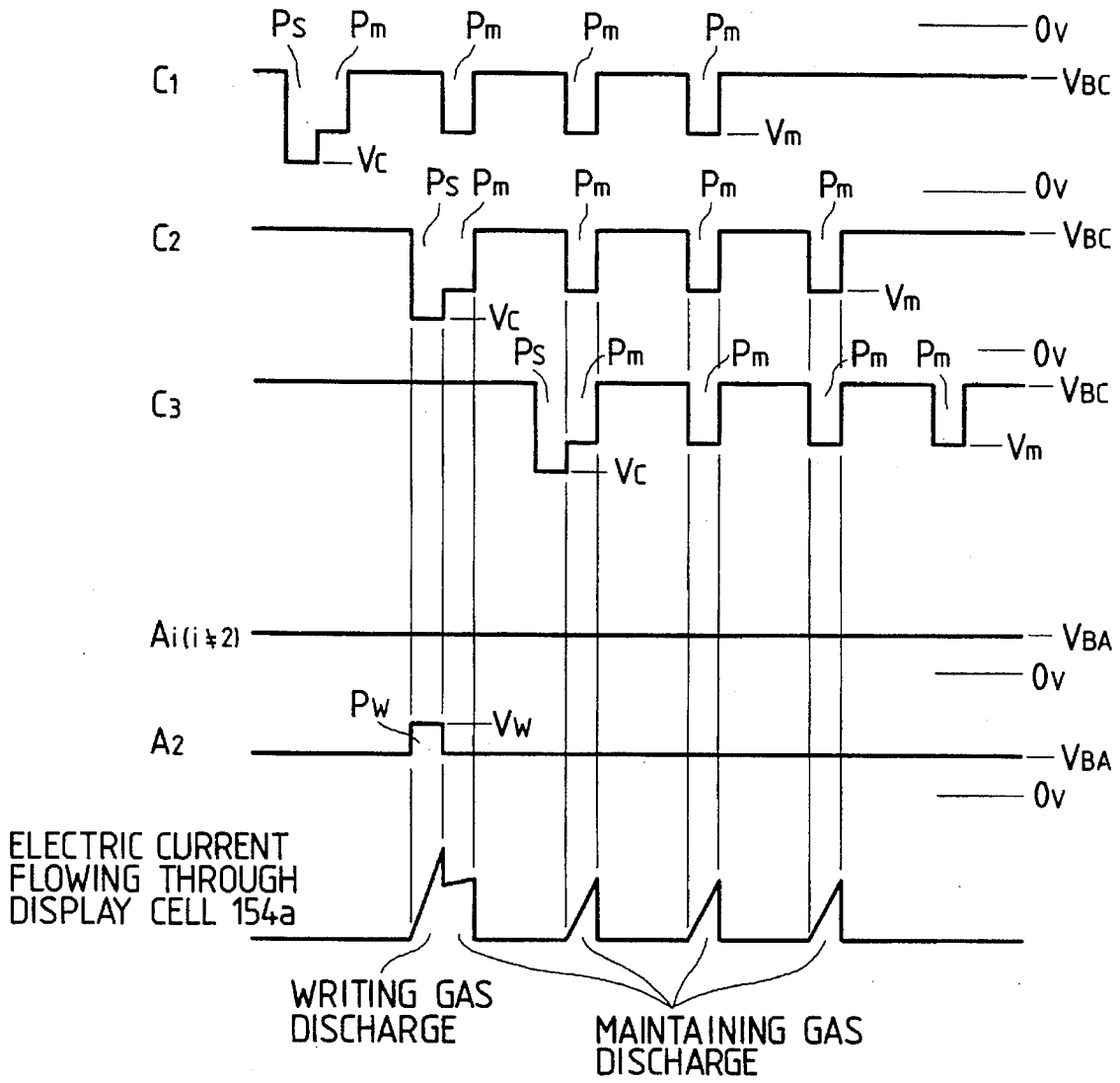
FIG. 5 shows waveforms of various signals transmitted in the display panel shown in FIG. 1, the panel being driven according to a first embodiment of the present invention.

FIG. 5 shows waveforms of various signals transmitted in the display panel shown in FIG. 1, the panel being driven according to a first embodiment of the present invention;

As shown in FIGS. 1, 5, a cathode bias voltage $V_{BC}$ having a negative value is always applied on each of the cathode lines C1 to Cm. Also, an anode bias voltage $V_{BA}$ having a positive value is always applied on each of the anode lines A1 to An.

When a piece of display information is, for example, transferred to a display control section (not shown) to produce visible light in a specific display cell 154*a* arranged at the intersection space between the cathode line C2 and the anode line A2, a scanning pulse Ps having a negative scanning voltage Vc is applied on the cathode line C2, and a writing pulse Pw having a positive writing voltage Vw is applied on the anode line A2 in synchronism with the scanning pulse Ps. Therefore, writing gas discharge is produced in the discharge gas filled in the specific display cell 154*a*.

In this case, because the cathode bias voltage $V_{BC}$ is always applied on the cathode line C2, the absolute value of the scanning voltage Vc is comparatively high. Also, because the anode bias voltage $V_{BA}$ is always applied on the anode line A2, the writing voltage Vw is comparatively high. Accordingly, an electric potential difference between the scanning voltage Vc and the writing voltage Vw is easily over the gas discharge starting electric potential difference required to produce gas discharge in the display cells 154. After the writing gas discharge is produced, excited particles are temporarily subsequent to the writing gas discharge is easily produced at a comparatively low electric potential difference.

Thereafter, a series of maintaining pulses Pm subsequent to the scanning pulse Ps is applied on the cathode line C2 to intermittently produce maintaining gas discharge during a maintaining period in the specific display cell 154*a*. In this case, even though a maintaining negative voltage Vm of the maintaining pulses Pm is higher than the scanning voltage Vc, a maintaining gas discharge is intermittently produced in the specific display cell 154*a* during a maintaining period because the gas discharge starting electric potential difference is reduced by the writing gas discharge. Therefore, a viewer can feel visible light.

After the maintaining period passes, the transmission of the maintaining pulses Pm on the cathode line C2 is stopped. Therefore, the maintaining gas discharge is stopped. Accordingly, because the transmission of the maintaining pulses Pm on the cathode lines is stopped after the maintaining period passes, an electric power required to generate the maintaining pulses Pm is not required during a non-display period subsequent to the maintaining period. Therefore, the electric power can be efficiently consumed.

Also, because any erasing pulse Per is not required to stop the maintaining gas discharge, a pulse generating circuit required for the gas discharge display panel 151 can be simplified.

In the first embodiment, the maintaining negative voltage Vm of the maintaining pulses Pm is higher than the scanning voltage Vc of the scanning pulse Ps. However, because no pulse is applied on the anode lines A1 to An in synchronism with the maintaining pulses Pm, it is preferred that the maintaining negative voltage Vm of the maintaining pulses Pm be the same as the scanning voltage Vc of the scanning pulse Ps.

Next, a second embodiment of the present invention is described with reference to drawings.

Figure 7:
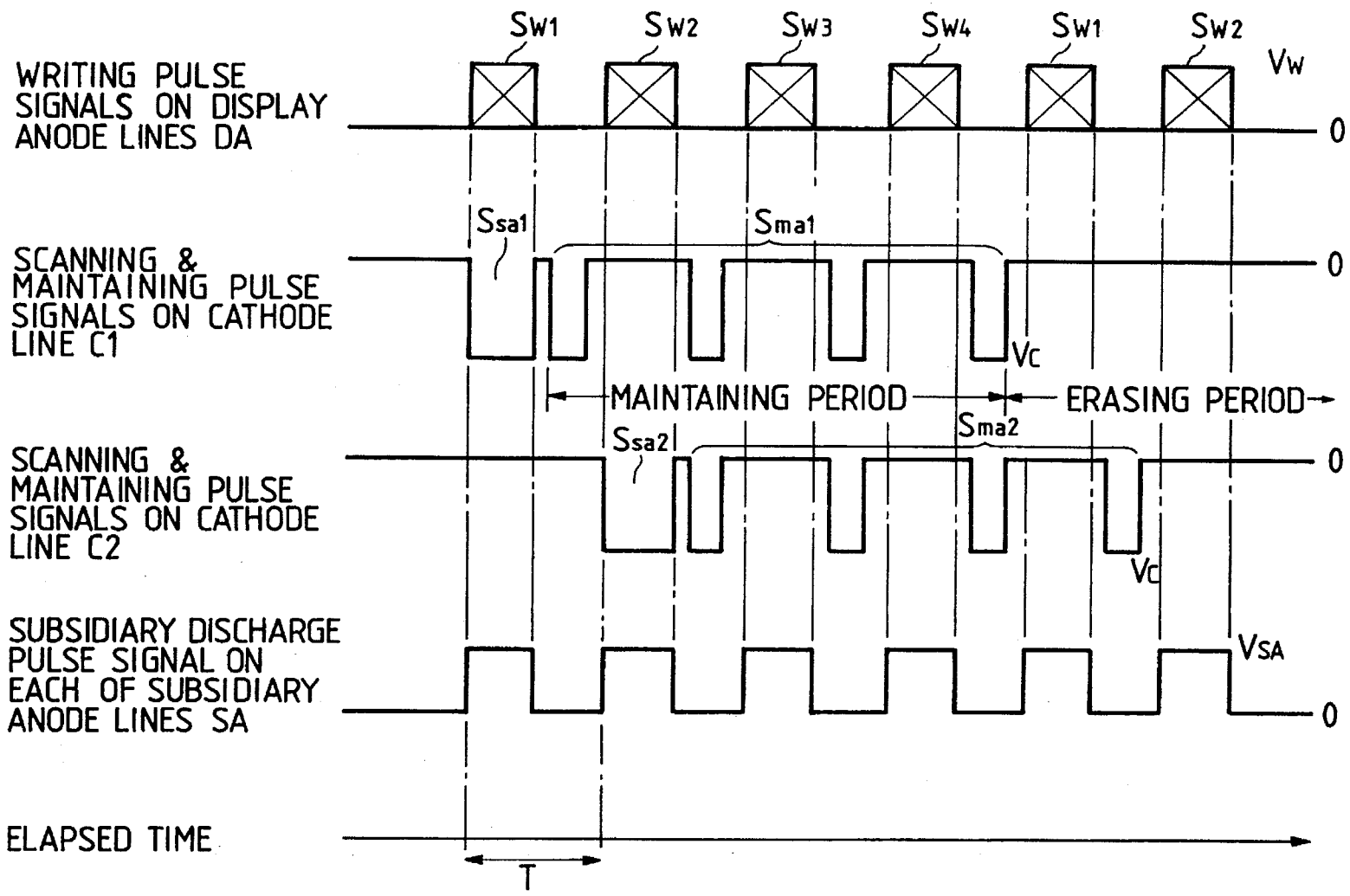
FIG. 7 shows waveforms of various signals transmitted in the gas discharge display apparatus shown in FIG. 3.

FIG. 6 is a composite view of a block diagram of driving circuits and a plan view of a gas discharge display panel according to a second embodiment of the present invention, a gas discharge display apparatus consisting of the driving circuits and the gas discharge display panel. FIG. 7 shows waveforms of various signals transmitted in the gas discharge display apparatus shown in FIG. 6.

As shown in FIG. 6, a gas discharge display apparatus 11 comprises a display anode driving section 12 for generating four types of writing pulse signals Sw ($Sw_1$, $Sw_2$, $Sw_3$, and $Sw_4$) cyclically transmitted on display anode lines DA according to pieces of writing control information, a cathode driving section 13 for generating five types of scanning pulse signals Ssa ($Ssa_1$, $Ssa_2$, $Ssa_3$, $Ssa_4$, and $Ssa_5$) cyclically transmitted on cathode lines CL according to pieces of scanning control information and maintaining pulse signals Sma ($Sma_1$, $Sma_2$, $Sma_3$, $Sma_4$, and $Sma_5$) transmitted on each of the cathode lines CL according to pieces of maintaining control information, a subsidiary anode driving section 14 for generating subsidiary discharge pulse signals Sds ($Sds_1$, $Sds_2$) transmitted on each of subsidiary anode lines SA according to pieces of subsidiary discharge control information, and a gas discharge display panel 15 in which writing gas discharge and maintaining gas discharge subsequent to the writing gas discharge is produced to radiate visible light according to the writing pulse signals Sw generated in the display anode driving section 12, the scanning pulse signals Ssa and the maintaining pulse signals Sma generated in the cathode driving section 13, and the subsidiary discharge pulse signals Sds generated in the subsidiary anode driving section 14.

The gas discharge display panel 15 comprises four display anode lines DA (DA1, DA2, DA3, and DA4) arranged in a row direction at regular intervals, five cathode lines CL (C1, C2, C3, C4, and C5) arranged in a line direction while crossing over the display anode lines DA, a plurality of display cells 16 arranged at intersection spaces between the cathode lines CL and the display anode lines DA, two subsidiary anode lines SA (SA1, SA2) which are arranged in parallel to the display anode lines DA and arranged between the display anode lines DA, and a plurality of subsidiary cells 17 arranged at intersection spaces between the cathode lines CL and the subsidiary anode lines SA.

Each of the subsidiary anode lines SA1, SA2 is positioned every two display anode lines DA1 to DA4 so that each of the display cells 16 faces only one of the subsidiary cells 17.

The number of cathode lines is not limited to five, the number of display anode lines is not limited to four, and the number of subsidiary anode lines is not limited to two.

In the above configuration of the gas discharge display panel 15, the subsidiary discharge pulse signals Sds are transmitted on each of the subsidiary anode lines SA1, SA2. Each of the subsidiary discharge pulse signals Sds has pulses at a regular cycle T. Thereafter, each time the scanning pulse signal $Ssa_1$, $Ssa_2$, $Ssa_3$, $Ssa_4$ is cyclically transmitted on each of the cathode lines C1 to C5 in synchronism with the subsidiary discharge pulse signals Sds, subsidiary gas discharge is produced in each of the subsidiary cells 17. The subsidiary cell 17 relating to the subsidiary gas discharge shifts in the line direction. Also, each time the writing pulse signal $Sw_1$, $Sw_2$, $Sw_3$, or $Sw_4$ is cyclically and selectively transmitted on each of the display anode lines DA1 to DA4 in synchronism with the subsidiary discharge pulse signals Sds, writing gas discharge is produced in each of the display cells 16. The display cell 16 relating to the writing gas discharge shifts in the line and row directions (in a lower right direction in FIG. 6). Thereafter, maintaining gas discharge is produced in each of the display cells 16 during a maintaining period by applying the maintaining pulse signals Sma subsequent to the scanning pulse signals Ssa on the display cells 16.

The display anode driving section 12 comprises a writing control gate signal generating circuit 18 for generating four types of n-channel writing control gate signals Sgwn and four types of p-channel writing control gate signals Sgwp according to the writing control information, and a writing pulse generating circuit 19 for generating the writing pulse signals Sw cyclically transmitted on the display anode lines DA1 to DA4 according to the writing control gate signals generated in the writing control gate signal generating circuit 18.

In the above configuration of the display anode driving section 12, the n-channel and p-channel writing control gate signals Sgwn, Sgwp are generated according to the writing control information in the writing control gate signal generating circuit 18. Thereafter, as shown in FIG. 7, the writing pulse signals Sw are generated according to the writing control gate signals Sgwn, Sgwp in the writing pulse generating circuit 19 to cyclically transmit the writing pulse signals Sw on the display anode lines DA1 to DA4.

Figure 8:
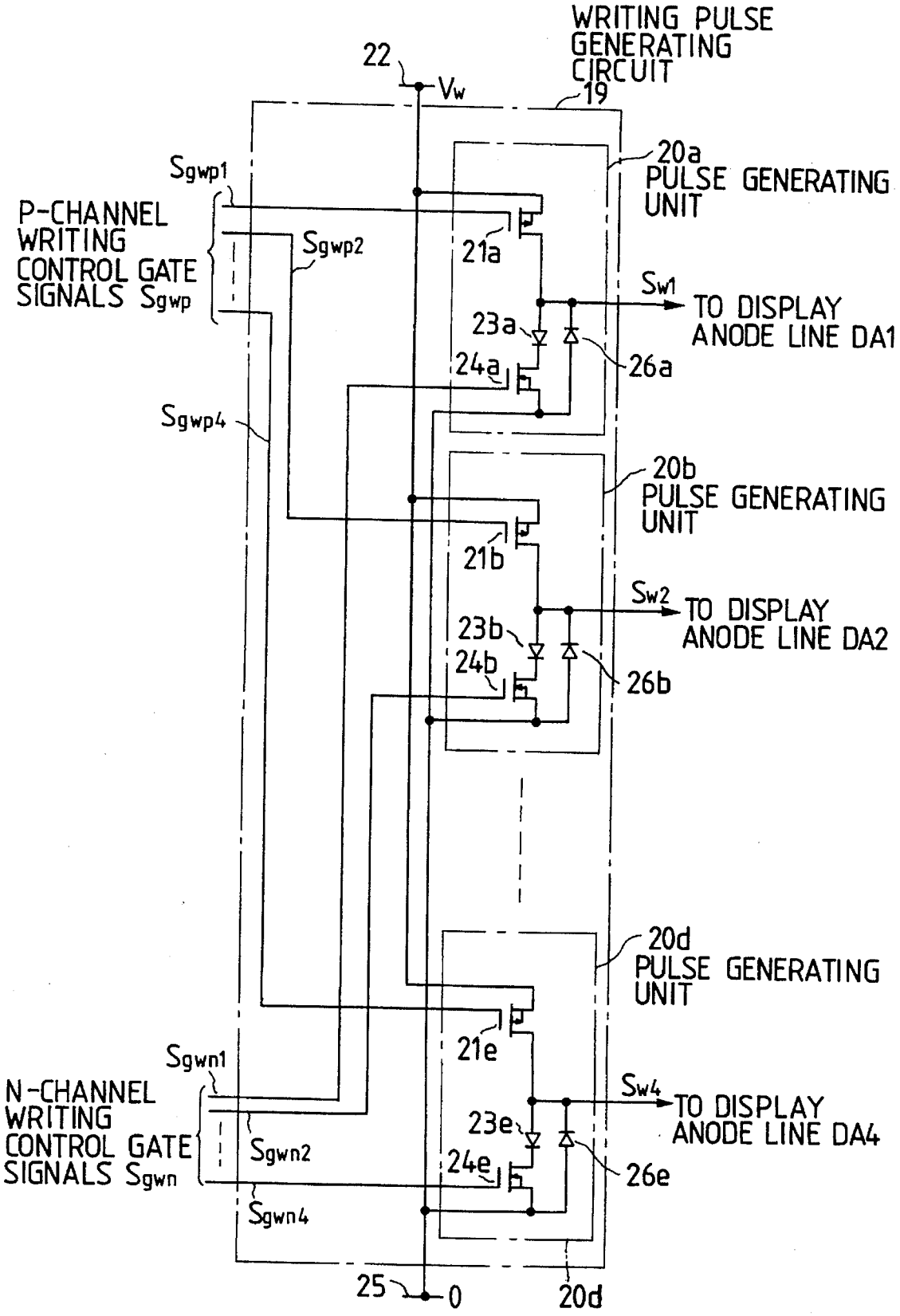
FIG. 8 is a circuit diagram of the writing pulse generating circuit shown in FIG. 6.

FIG. 8 is a circuit diagram of the writing pulse generating circuit 19 shown in FIG. 6.

As shown in FIG. 8, the writing pulse generating circuit 19 comprises four writing pulse generation units 20 (20*a*, 20*b*, 20*c*, and 20*d*) for selectively generating the writing signals Sw according to the n-channel writing control gate signals Sgwn and the p-channel writing control gate signals Sgwp.

Each of the writing pulse generation units 20 comprises a p-channel field effect transistor (FET) 21 (21*a*, 21*b*, 21*c*, or 21*d*) of which a source is connected to an electric source line 22 applied to a positive voltage Vw and a gate is connected to one of p-channel output terminals to receive the p-channel writing control gate signal Sgwp ($Sgwp_1$, $Sgwp_2$, $Sgwp_3$, $Sgwp_4$, or $Sgwp_5$) from the writing control gate signal generating circuit 18, a first diode 23 (23*a*, 23*b*, 23*c*, or 23*d*) of which an anode is connected to a drain of the p-channel FET 21, an n-channel field effect transistor (FET) 24 (24*a*, 24*b*, 24*c*, or 24*d*) of which a source is connected to a grounded line 25 maintained at a voltage 0 v, a gate is connected to one of n-channel output terminals to receive the n-channel writing control gate signal Sgwn ($Sgwn_1$, $Sgwn_2$, $Sgwn_3$, $Sgwn_4$, or $Sgwn_5$) from the writing control gate signal generating circuit 18, and a drain is connected to a cathode of the first diode 23, and a maintaining gas discharge diode 26 (26*a*, 26*b*, 26*c*, or 26*d*) of which an anode is connected to the grounded line 25 and a cathode is connected to the drain of the p-channel FET 21.

Each of the maintaining gas discharge diodes 26 is utilized to supply a maintaining electric current having a zero voltage from the grounded line 25 to a display anode line DA when a pulse of a subsidiary discharge pulse signal Sds is transmitted on a subsidiary anode line SA to produce maintaining gas discharge in a display cell 16.

In the above configuration of the writing pulse generating circuit 19, the n-channel and p-channel writing control gate signals Sgwp, Sgwp generated in the writing control gate signal generating circuit 18 are output to the writing pulse generating circuit 19 to control the writing pulse signals Sw transferred from the writing pulse generation units 20 to the display anode lines DA.

When the p-channel FET 21*a* is selectively turned on in synchronism with the p-channel writing control gate signal $Sgwp_1$, the n-channel FET 24*a* is selectively turned off in synchronism with the n-channel writing control gate signal $Sgwn_1$. Thereafter, a writing electric current having the positive voltage Vw flows from the electric source line 22 to the display anode line DA1 through the p-channel FET 21*a*. Therefore, a writing pulse signal $Sw_1$ is transferred to a display cell 16 to produce writing gas discharge in the display cell 16. In contrast, when the p-channel FET 21*a* is selectively turned off in synchronism with the p-channel writing control gate signal $Sgwp_1$, the n-channel FET 24*a* is selectively turned on in synchronism with the n-channel writing control gate signal $Sgwn_1$. Thereafter, an electric current flows from the display anode line DA1 to the grounded line 25 through the first diode 25*a* and the n-channel FET 24*a*. Therefore, the voltage of the display anode line DA1 is kept to the zero voltage. Thereafter, when a pulse of the subsidiary discharge pulse signal $Sds_1$ is transmitted on the subsidiary anode line $SA_1$, a maintaining electric current having a zero voltage flows from the grounded line 25 to the display anode line DA1 through the maintaining gas discharge diode 26*a*. Therefore, maintaining gas discharge is produced in the display cell 16.

The cathode driving section 13 comprises a scanning-maintaining control gate signal generating circuit 27 for generating n-channel scanning-maintaining control gate signals Sgwm and p-channel scanning-maintaining control gate signals Sgmp according to the scanning and maintaining control information, and a scanning-maintaining pulse generating circuit 28 for generating the scanning and maintaining pulse signals Ssa. Sma transmitted on the cathode lines CL according to the scanning-maintaining control gate signals Sgmn, Sgmp generated in the scanning-maintaining control gate signal generating circuit 27.

Figure 9:
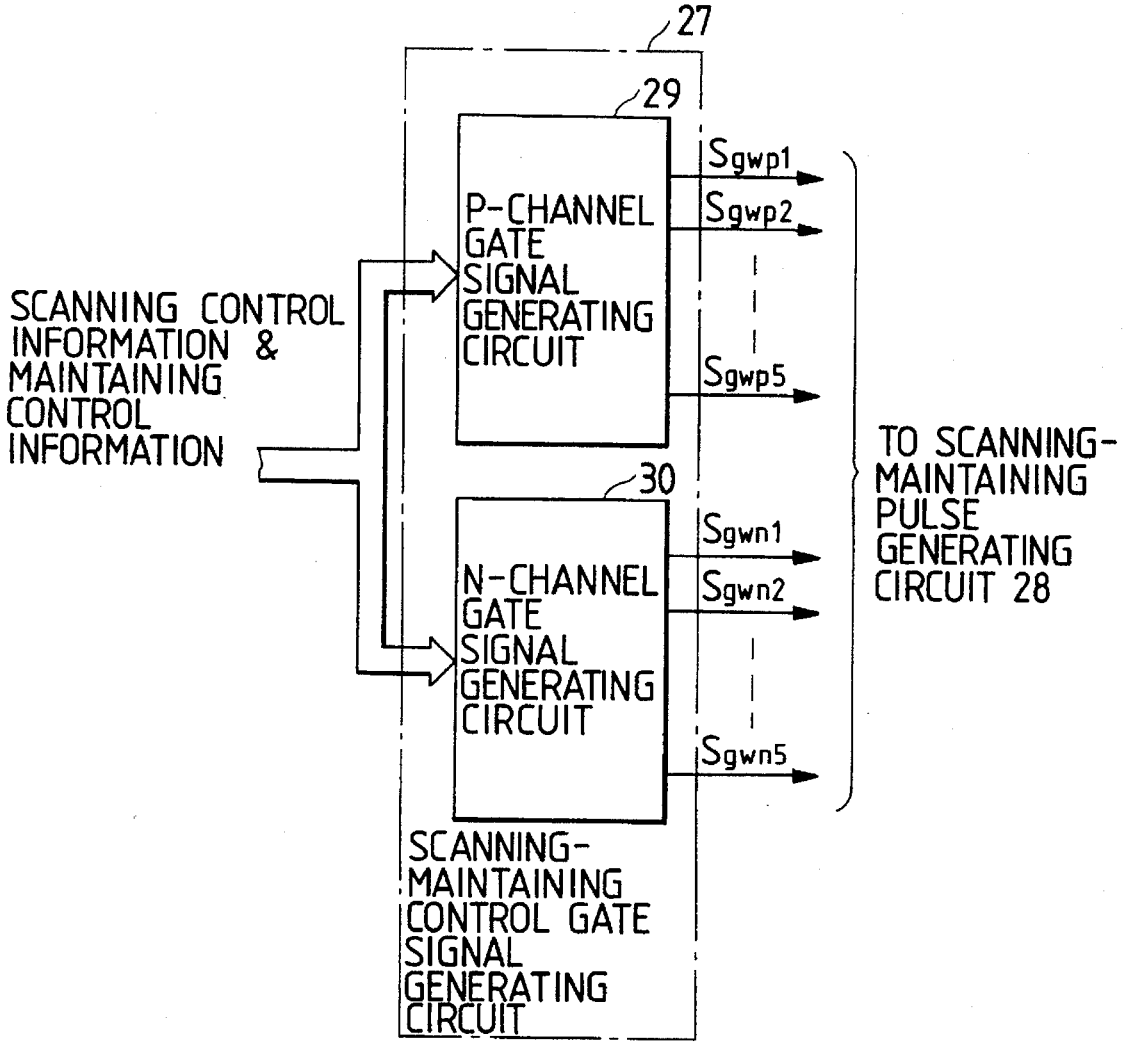
FIG. 9 is a circuit diagram of the scanning-maintaining control gate signal generating circuit shown in FIG. 6.

FIG. 9 is a circuit diagram of the scanning-maintaining control gate signal generating circuit 27 shown in FIG. 6.

As shown in FIG. 9, the scanning-maintaining control gate signal generating circuit 27 comprises a p-channel gate signal generating circuit 29 and an n-channel gate signal generating circuit 30 arranged in parallel.

In the above configuration of the cathode driving section 13, the p-channel scanning-maintaining control gate signals Sgmp are generated according to the scanning control information and the maintaining control information in the p-channel gate signal generating circuit 29 of the scanning-maintaining control gate signal generating circuit 27, and the n-channel scanning-maintaining control gate signals Sgmn are generated according to the scanning control information and the maintaining control information in the n-channel gate signal generating circuit 30 of the scanning-maintaining control gate signal generating circuit 27. Thereafter, as shown in FIG. 7, the scanning and maintaining pulse signals Ssa, Sma are generated according to the scanning-maintaining control gate signals Sgmn, Sgmp in the scanning-maintaining pulse generating circuit 28 to transmit the scanning and maintaining pulse signals Ssa, Sma on the cathode lines CL.

Figure 10:
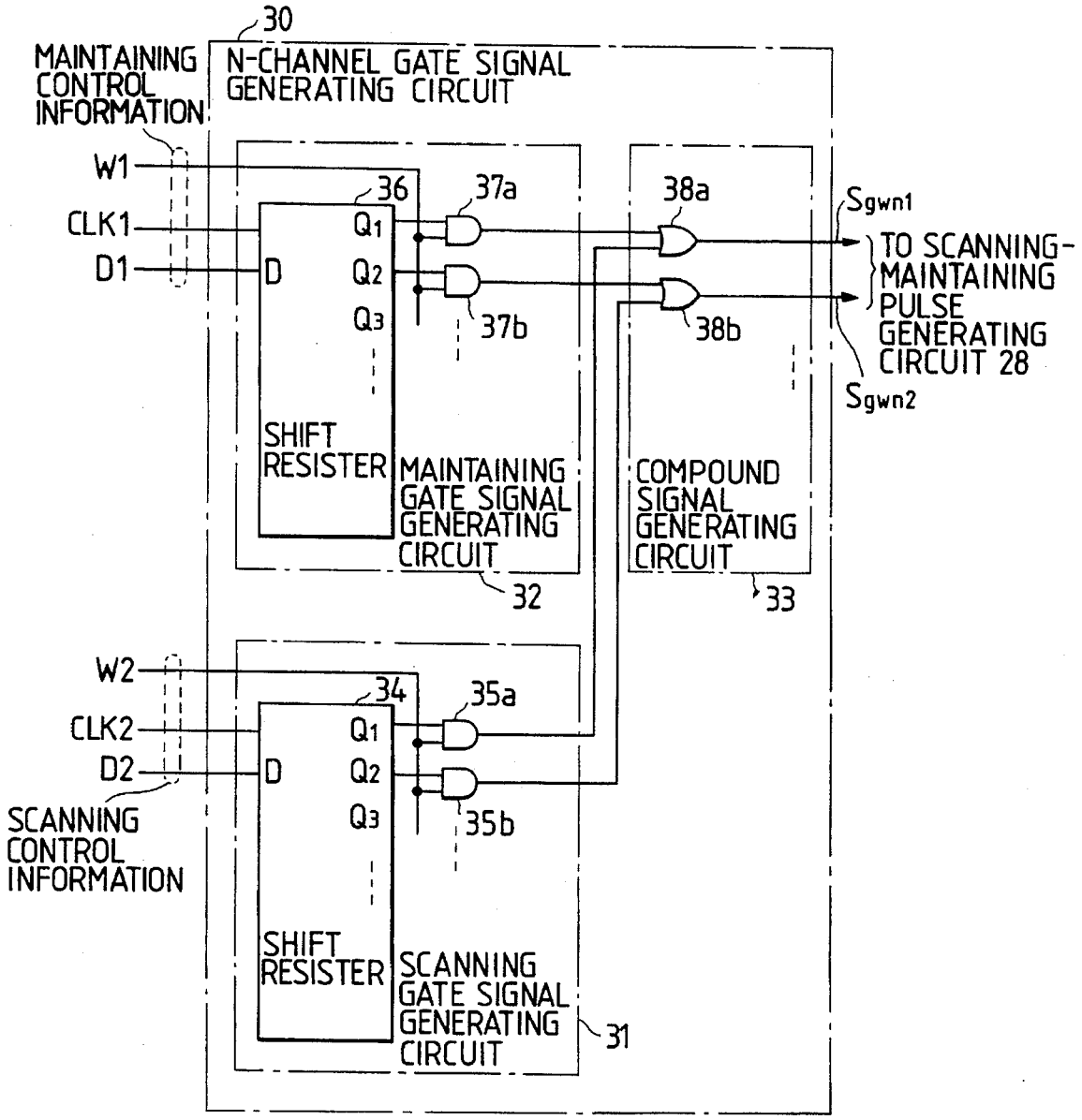
FIG. 10 is a circuit diagram of the n-channel gate signal generating circuit shown in FIG. 9.
Figure 11:
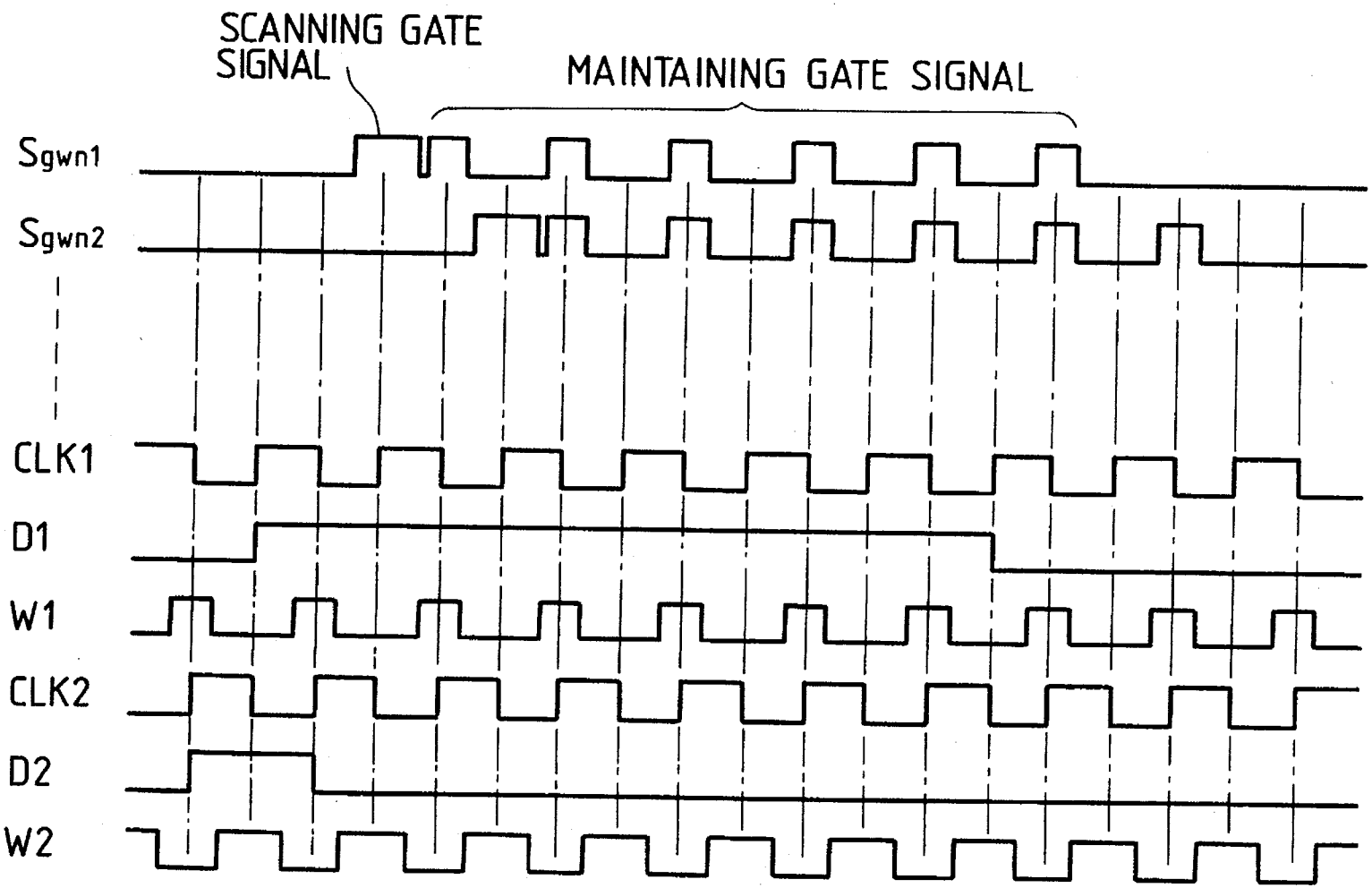
FIG. 11 shows waveforms of various signals transmitted in the n-channel gate signal generating circuit shown in FIG. 10.

FIG. 10 is a circuit diagram of the n-channel gate signal generating circuit 30 shown in FIG. 9, and FIG. 11 shows waveforms of various signals transmitted in the n-channel gate signal generating circuit 30 shown in FIG. 10.

As shown in FIG. 10, the n-channel gate signal generating circuit 30 comprises a scanning gate signal generating circuit 31 for generating scanning control gate signals, a maintaining gate signal generating circuit 32 for generating maintaining control gate signals, and a compound signal generating circuit 33 for compounding the scanning control gate signals generated in the scanning gate signal generating circuit 31 with the maintaining control gate signals generated in the maintaining gate signal generating circuit 32 to produce the n-channel scanning-maintaining control gate signals Sgmn.

The scanning gate signal generating circuit 31 comprises a shift register 34 for fetching a scanning designation signal D2 in synchronism with a clock signal CLK2 and delaying the scanning designation signal D2 by various delay times to output scanning signals, five AND gates 35 (35*a*, 35*b*, 35*c*, 35*d*, and 35*e*) for fetching the scanning signals provided from output terminals Q of the shift register 34 and outputting scanning gate signals in cases where a pulse designation signal W2 is in a high level "1". The scanning designation signal D2, the clock signal CLK2, and the pulse designation signal W2 are included in the scanning control information. The pulse designation signal W2 has pulses arranged at the regular cycle T in series.

In the above configuration of the scanning gate signal generating circuit 31, as shown in FIG. 11, when the scanning designation signal D2 is transferred to an input terminal of the shift register 34, the scanning designation signal D2 is fetched in synchronism with the clock signal CLK2 and delayed in the shift register 34 by the various delay times. Therefore, the scanning signals are output from the output terminals Q of the shift register 34 to the AND gates 35. Thereafter, when the pulse designation signal W2 is in a high level "1", the scanning gate signals are output from the AND gates 35 to the compound signal generating circuit 33. Therefore, the scanning gate signals are synchronized with the pulse designation signal W2 and are cyclically output from the AND gates 35 at scanning intervals T1.

The maintaining gate signal generating circuit 32 comprises a shift register 36 for fetching a maintaining designation signal D1 in synchronism with a clock signal CLK1 and delaying the maintaining designation signal D1 by various delay times to produce maintaining signals, five AND gates 37 (37*a*, 37*b*, 37*c*, 37*d*, and 37*e*) for fetching the maintaining signals provided from output terminals Q of the shift register 36 and outputting maintaining gate signals in cases where a pulse designation signal W1 is in a high level "1". The maintaining designation signal D1, the clock signal CLK1, and the pulse designation signal W1 are included in the maintaining control information. The pulse designation signal W1 has pulses arranged at the regular cycle T in series.

In the above configuration of the maintaining gate signal generating circuit 32, as shown in FIG. 11, when the maintaining designation signal D1 is transferred to an input terminal of the shift register 36, the maintaining designation signal D1 is fetched in synchronism with the clock signal CLK1 and is delayed in the shift register 36 by the various delay times according to the clock signal CLK1. Therefore, a plurality of maintaining signals obtained by delaying the maintaining designation signal D1 by the various delay times are output from the output terminals Q of the shift register 36 to the AND gates 37. Thereafter, when the pulse designation signal W1 is in a high level "1", the maintaining signals are output from the AND gates 37 as maintaining gate signals. Therefore, the maintaining gate signals are synchronized with the pulse designation signal W1 and are transferred to the compound signal generating circuit 33. Also, a first pulse of the maintaining gate signal output from the AND gate 37 (37*a*, 37*b*, 37*c*, 37*d*, or 37*e*) is delayed by a small time as compared with the scanning gate signal output from the AND gate 35 (35*a*, 35*b*, 35*c*, 35*d*, or 35*e*).

Accordingly, a width of each of the maintaining gate signals is determined by a pulse width $\pi m$ the maintaining designation signal D1. The maintaining period of the writing gas discharge produced in the display cells 16 is determined by the width of each of the maintaining gate signals so that the maintaining period is designated by the pulse width $\pi m$ of the maintaining designation signal D1.

The compound signal generating circuit 33 comprises five OR gate 38 (38*a*, 38*b*, 38*c*, 38*d*, or 38*e*) for multiplexing each of the scanning gate signals cyclically output from the scanning gate signal generating circuits 31 and each of the maintaining gate signals output from the maintaining gate signal generating circuits 32. In the above configuration of the compound signal generating circuit 33, the scanning gate signals cyclically output from the scanning gate signal generating circuits 31 and the maintaining gate signals output from the maintaining gate signal generating circuits 32 are input to the OR gates 38. Therefore, as shown in FIG. 11, each of the scanning gate signals and each of the maintaining gate signals are multiplexed in each of the OR gates 38. As a result, the n-channel scanning-maintaining control gate signals Sgmn ($Sgmn_1$, $Sgmn_2$, $Sgmn_3$, $Sgmn_4$, and $Sgmn_5$) is produced. Each of the n-channel scanning-maintaining control gate signals Sgwn is formed of the scanning gate signal and the maintaining gate signal subsequent to the scanning gate signal. Thereafter, the n-channel scanning-maintaining control gate signals Sgwn are transferred from the OR gates 38 to the scanning-maintaining pulse generating circuit 28.

The p-channel gate signal generating circuit 29 is manufactured in the same manner as the n-channel gate signal generating circuit 30 shown in FIG. 10, and the p-channel gate signal generating circuit 29 is operated in the same manner as the n-channel gate signal generating circuit 30 as shown in FIG. 11. Therefore, the p-channel scanning-maintaining control gate signals Sgmp ($Sgmp_1$, $Sgmp_2$, $Sgmp_3$, $Sgmp_4$, or $Sgmp_5$) are transferred from the circuit 29 to the scanning-maintaining pulse generating circuit 28.

Figure 12:
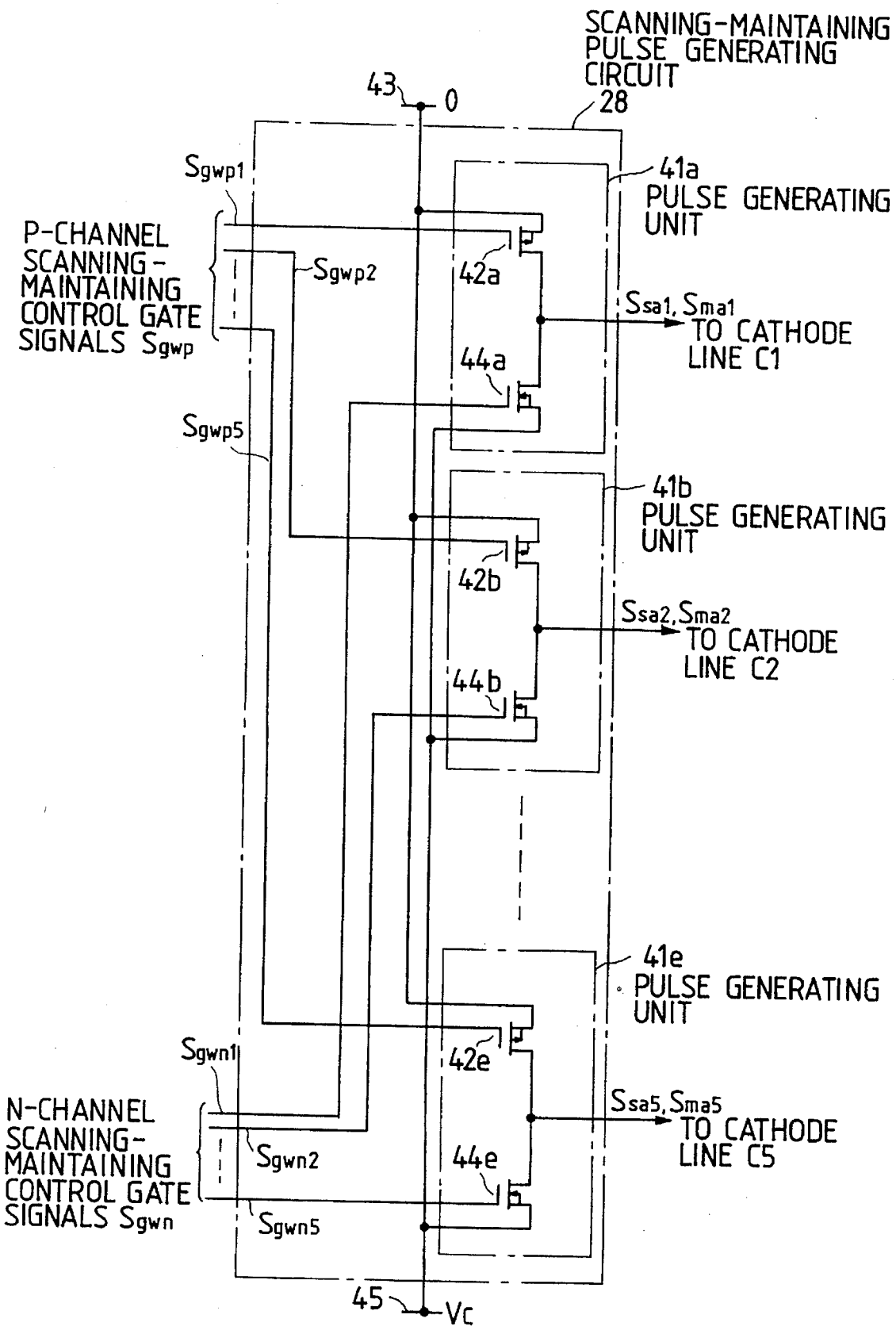
FIG. 12 is a circuit diagram of the scanning-maintaining pulse generating circuit shown in FIG. 6.
Figure 13:
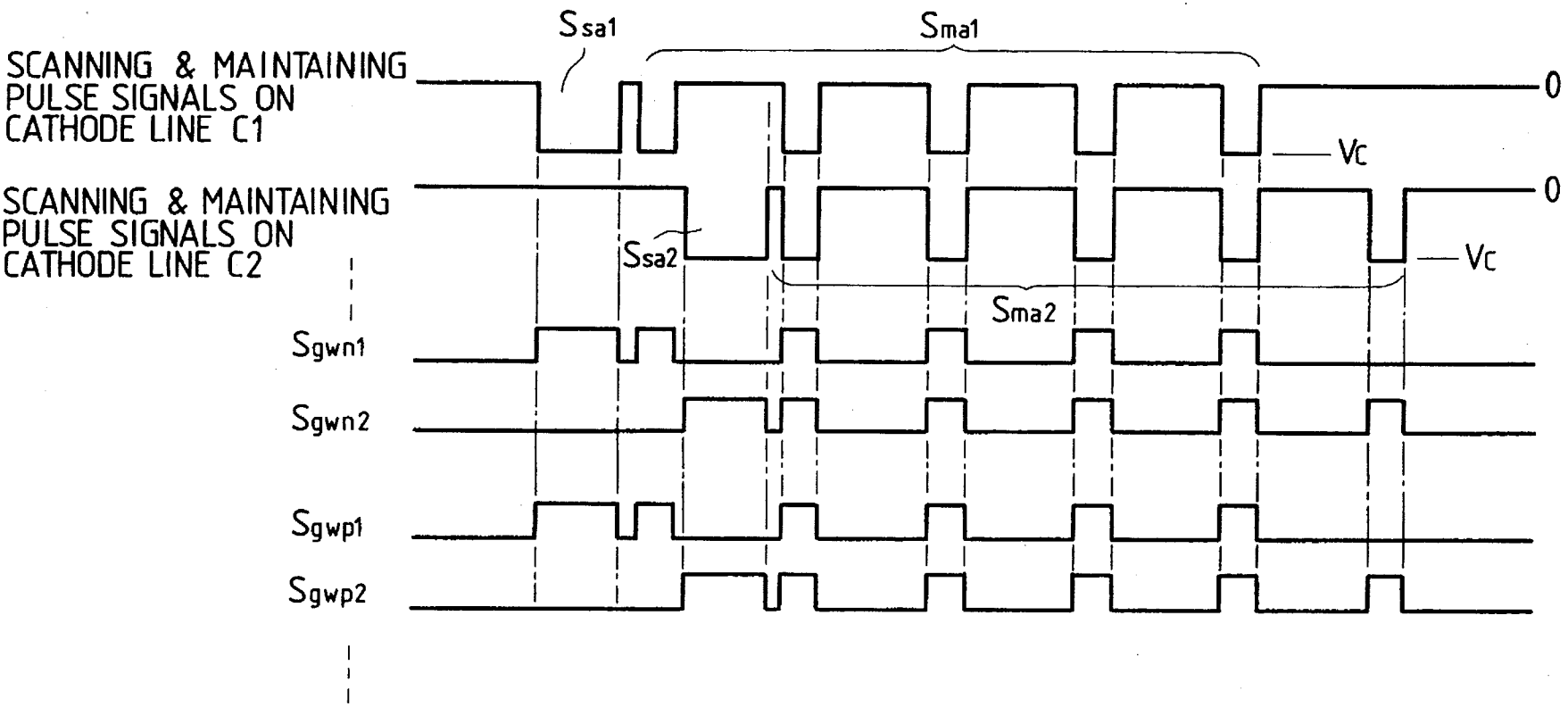
FIG. 13 shows waveforms of various signals transmitted in the scanning-maintaining pulse generating circuit shown in FIG. 12.

FIG. 12 is a circuit diagram of the scanning-maintaining pulse generating circuit 28 shown in FIG. 6. FIG. 13 shows waveforms of various signals transmitted in the scanning-maintaining pulse generating circuit 28 shown in FIG. 12.

As shown in FIG. 12, the scanning-maintaining pulse generating circuit 28 comprises five scanning-maintaining pulse generation units 41 (41*a*, 41*b*, 41*c*, 41*d*, and 41*e*) for selectively generating the scanning signals Ssa and the maintaining signals Sma according to the n-channel scanning-maintaining control gate signals Sgwn and the p-channel scanning-maintaining control gate signals Sgwp.

Each of the scanning-maintaining pulse generation units 41 comprises a p-channel field effect transistor (FET) 42 (42*a*, 42*b*, 42*c*, 42*d*, or 42*e*) of which a source is connected to a grounded line 43 maintained at a voltage 0 v and a gate is connected to one of p-channel output terminals to receive the p-channel scanning-maintaining control gate signal Sgwp ($Sgwp_1$, $Sgwp_2$, $Sgwp_3$, $Sgwp_4$, or $Sgwp_5$) from the scanning-maintaining control gate signal generating circuit 27, and an n-channel field effect transistor (FET) 44 (44*a*, 44*b*, 44*c*, 44*d*, 44*e*) of which a source is connected to an electric source line 45 applied to a negative voltage Vc, a gate is connected to one of n-channel output terminals to receive the n-channel scanning-maintaining control gate signal Sgwn ($Sgwn_1$, $Sgwn_2$, $Sgwn_3$, $Sgwn_4$, or $Sgwn_5$) from the scanning-maintaining control gate signal generating circuit 27, and a drain is connected to a drain of the p-channel FET 42.

In the above configuration of the scanning-maintaining pulse generating circuit 28, the n-channel and p-channel scanning-maintaining control gate signals Sgwn, Sgwp generated in the scanning-maintaining control gate signal generating circuit 27 are synchronized with each other and are output to the scanning-maintaining pulse generating circuit 28 to control the scanning pulse signals Ssa and the maintaining pulse signals Sma which are transferred from the scanning-maintaining pulse generation units 41 to the cathode lines CL. That is, as shown in FIG. 13, the scanning pulse signals $Ssa_1$, $Ssa_2$, $Ssa_3$, $Ssa_4$, and $Ssa_5$ are cyclically output from the scanning-maintaining pulse generation units 41 to the cathode lines CL in synchronism with the n-channel and p-channel scanning-maintaining control gate signals Sgwn, Sgwp. Also, the maintaining pulse signals $Sma_1$, $Sma_2$, $Sma_3$, $Sma_4$, and $Sma_5$ subsequent to the scanning pulse signals Ssa are output from the scanning-maintaining pulse generation units 41 to the cathode lines CL in synchronism with the n-channel and p-channel scanning-maintaining control gate signals Sgwn, Sgwp. Scanning pulses of the scanning pulse signals Ssa and maintaining pulses of the maintaining pulse signals Sma respectively have the negative voltage Vc.

The subsidiary anode driving section 14 comprises a subsidiary control gate signal generating circuit 51 for generating two types of n-channel subsidiary control gate signals Sgsn and two types of p-channel subsidiary control gate signals Sgsp according to the subsidiary discharge control information, and a subsidiary discharge pulse generating circuit 52 for generating the subsidiary discharge pulse signals Sds ($Sds_1$, $Sds_2$) transmitted on the subsidiary anode lines SA according to the subsidiary control gate signals Sgsn, Sgsp generated in the subsidiary control gate signal generating circuit 51. Each of the subsidiary discharge pulse signals Sds has pulses arranged at the regular cycle T in series.

In the above configuration of the subsidiary anode driving section 14, the n-channel and p-channel subsidiary discharge control gate signals Sgsn ($Sgsn_1$, $Sgsn_2$), Sgsp ($Sgsp_1$, $Sgsp_2$) are generated according to the subsidiary discharge control information in the subsidiary control gate signal generating circuit 51. Thereafter, as shown in FIG. 7, the subsidiary discharge pulse signals Sds are generated according to the subsidiary discharge control gate signals Sgsn, Sgsp in the subsidiary discharge pulse generating circuit 52 to transmit the subsidiary discharge pulse signals Sds on the subsidiary anode lines SA.

Figure 14:
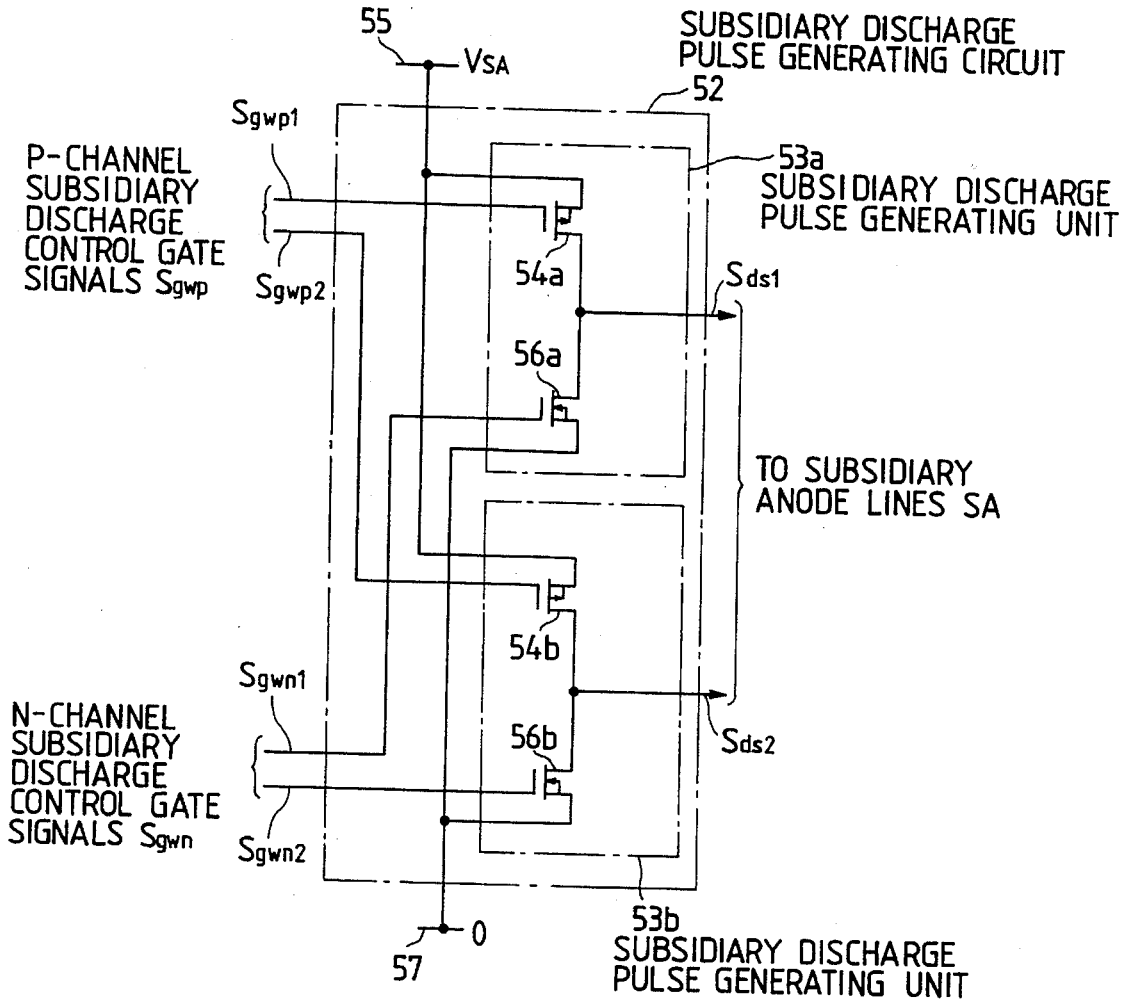
FIG. 14 is a circuit diagram of the subsidiary discharge pulse generating circuit shown in FIG. 6.

FIG. 14 is a circuit diagram of the subsidiary discharge pulse generating circuit 52 shown in FIG. 6.

As shown in FIG. 14, the subsidiary discharge pulse generating circuit 52 comprises two subsidiary discharge pulse generation units 53 (53*a*, 53*b*) for selectively generating the subsidiary discharge pulse signals Sds according to the n-channel and p-channel subsidiary discharge control gate signals Sgwn, Sgwp.

Each of the subsidiary discharge pulse generation units 53 comprises a p-channel field effect transistor (FET) 54 (54*a*, 54*b*) of which a source is connected to an electric source line 55 applied to a voltage $V_{SA}$ and a gate is connected to one of p-channel output terminals to receive the p-channel subsidiary discharge control gate signal Sgsp ($Sgsp_1$, $Sgsp_2$) from the subsidiary discharge control gate signal generating circuit 51, and an n-channel field effect transistor (FET) 56 (56*a*, 56*b*) of which a source is connected to a grounded line 57 maintained at a voltage 0 v, a gate is connected to one of n-channel output terminals to receive the n-channel scanning-maintaining control gate signal Sgsn ($Sgsn_1$, $Sgsn_2$) from the subsidiary discharge control gate signal generating circuit 51, and a drain is connected to a drain of the p-channel FET 54.

In the above configuration of the subsidiary discharge pulse generating circuit 52, the n-channel and p-channel subsidiary discharge control gate signals Sgsn, Sgsp generated in the subsidiary control gate signal generating circuit 51 are output to the subsidiary discharge pulse generating circuit 52 to control the subsidiary discharge pulse signals Sds transferred from the subsidiary discharge pulse generation units 53 to the subsidiary anode lines SA. That is, the subsidiary discharge pulse signals Sds are produced in synchronism with the n-channel and p-channel subsidiary discharge control gate signals Sgsn, Sgsp. Also, the subsidiary discharge pulse signals Sds uniformly have the peak voltage $V_{SA}$. Thereafter, as shown in FIG. 7, the subsidiary discharge pulse signals Sds are transmitted on the subsidiary anode lines SA.

Next, an operation performed in the gas discharge display apparatus 11 is described with reference to FIGS. 6, 7.

As shown in FIG. 7, the subsidiary discharge pulse signals Sds are always transmitted on the subsidiary anode lines SA. Also, the writing pulse signals Sw are cyclically transmitted from the display anode driving section 12 to the display anode lines DA in synchronism with the subsidiary discharge pulse signals Sds. In addition, the scanning pulse signals Ssa synchronized with the subsidiary discharge pulse signals Sds and the maintaining pulse signals Sma subsequent to the scanning pulse signals Ssa are transmitted at scanning intervals T1 from the cathode driving section 13 to the cathode lines CL.

For example, when the writing pulse signal $Sw_1$ and the scanning pulse signal $Ssa_1$ at an elapsed time $t_0$, writing gas discharge is produced in a specific display cell 16*a* arranged at the intersection space between the cathode line C1 and the display anode line DA1. Also, because the subsidiary discharge pulse signal $Sds_1$ are always transmitted on the subsidiary anode line SA1 in synchronism with the writing pulse signal $Sw_1$ and the scanning pulse signal $Ssa_1$, subsidiary gas discharge is produced in a specific subsidiary cell 17*a* adjacent to the specific display cell 16*a*. Therefore, the writing gas discharge is produced at high speed because of the generation of excited particles which function as priming.

Thereafter, maintaining gas discharge is produced in the specific display cell 16*a* during the maintaining period because the maintaining pulse signal $Sma_1$ subsequent to the scanning pulse signals $Ssa_1$ is applied on the cathode line C1. Thereafter, when the maintaining period is finished and an erasing period subsequent to the maintaining period is started, the maintaining pulse signal $Sma_1$ is not applied on the cathode line C1 any more. Therefore, the maintaining gas discharge is stopped without any erasing signal because the cathode line C1 is set to a zero voltage.

Accordingly, when the maintaining gas discharge is not required in the erasing period, the maintaining pulse signal is not applied on the cathode line. Therefore, an electric power required to produce the maintaining pulse signal can be effectively consumed to produce the maintaining gas discharge in the maintaining period. In other words, the electric power is not consumed in the erasing period so that all of the electric power can be contributed to the maintaining gas discharge produced in the gas discharge display apparatus 11.

Figure 3:
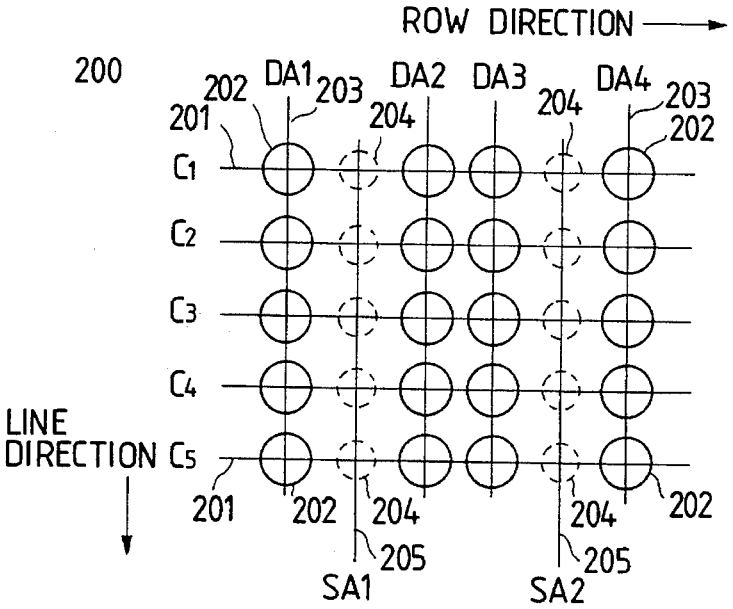
FIG. 3 PRIOR ART
FIG. 3 is a plan view of a matrix type of gas discharge display panel having an electrode structure conventionally utilized.
Figure 4:
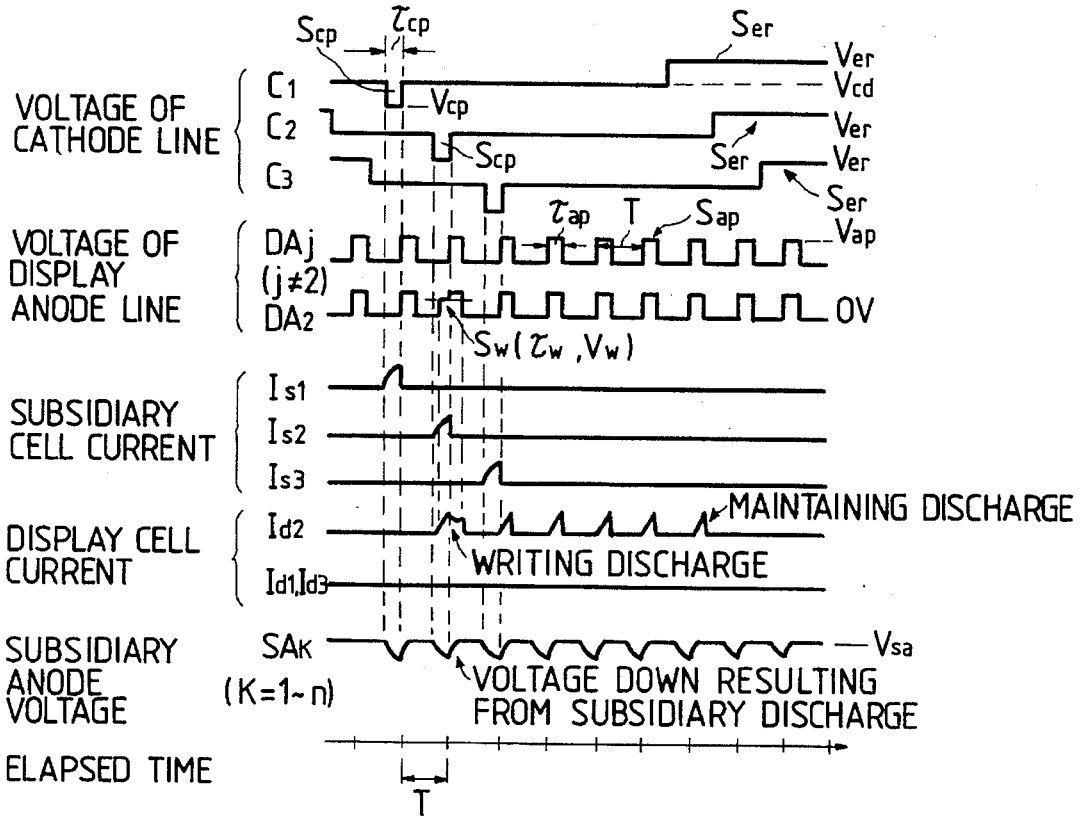
FIG. 4 PRIOR ART
FIG. 4 shows waveforms of various signals transmitted in the display panel shown in FIG. 3.

The reduction of the electric power required to produce the maintaining pulse signal is described as compared with in the gas discharge display panel 100 shown in FIG. 3.

The electric power is proportional to a maximum luminescence time rate RL defined according to an equation (2).

*RL*=(a maintaining period in a main field of a display panel) /(a total period in the main field)

where the total period consists of the maintaining period, a scanning period, and an erasing period.

For example, in cases where the main field consists of eight sub-fields and the number of gradations of color displayed on the display panel is 256, the maximum luminescence time rate RL generally ranges from 1/16 to 1/4. In this case, because the electric power producing the maintaining anode pulse signal is required over the total period in the conventional panel 100, the electric power required to produce the maintaining pulse signal is reduced to a range from 1/16 to 1/4 in the display apparatus 11 as compared with that in the conventional display panel 100. Therefore, an overall driving efficiency including a driving efficiency of the display panel 15 and another driving efficiency of driving circuits 18, 19, 27, 28, 51, and 52 can be greatly improved.

In addition, because only three types of voltages such as the voltage Vw of the writing pulse signals Sw, the voltage Vc of the scanning and maintaining pulse signals Ssa, Sma, and the voltage $V_{SA}$ of the subsidiary discharge pulse signals Sds are required in the display apparatus 11, the driving sections 12, 13, and 14 can be greatly simplified. As a result, the driving sections 12, 13, and 14 can be manufactured in an integrated circuit structure.

Next, a third embodiment according to the present invention is described with reference to drawings.

Constructional elements shown in following drawings which are equivalent to constructional elements shown in preceding drawings are denoted by the same reference numerals as those shown in the preceding drawings.

FIG. 15 is a composite view of a block diagram of driving circuits and the plan view of the gas discharge display panel shown in FIG. 6 according to a third embodiment of the present invention, a gas discharge display apparatus consisting of the driving circuits and the gas discharge display panel.

As shown in FIG. 15, a gas discharge display apparatus 61 comprises the display anode driving section 12, a cathode driving section 62 for generating five types of biased scanning signals Ssb ($Ssb_1$, $Ssb_2$, $Ssb_3$, $Ssb_4$, and $Ssb_5$) cyclically transmitted on the cathode lines CL according to the scanning control information and biased maintaining signals Smb ($Smb_1$, $Smb_2$, $Smb_3$, $Smb_4$, and $Smb_5$) transmitted on each of the cathode lines CL according to the maintaining control information, the subsidiary anode driving section 14, and the gas discharge display panel 15.

The cathode driving section 62 comprises the scanning-maintaining control gate signal generating circuit 27, and a scanning-maintaining pulse generating circuit 63 for generating the biased scanning and maintaining signals Ssb, Smb transmitted on the cathode lines CL according to the scanning-maintaining control gate signals generated in the scanning-maintaining control gate signal generating circuit 27.

Figure 16:
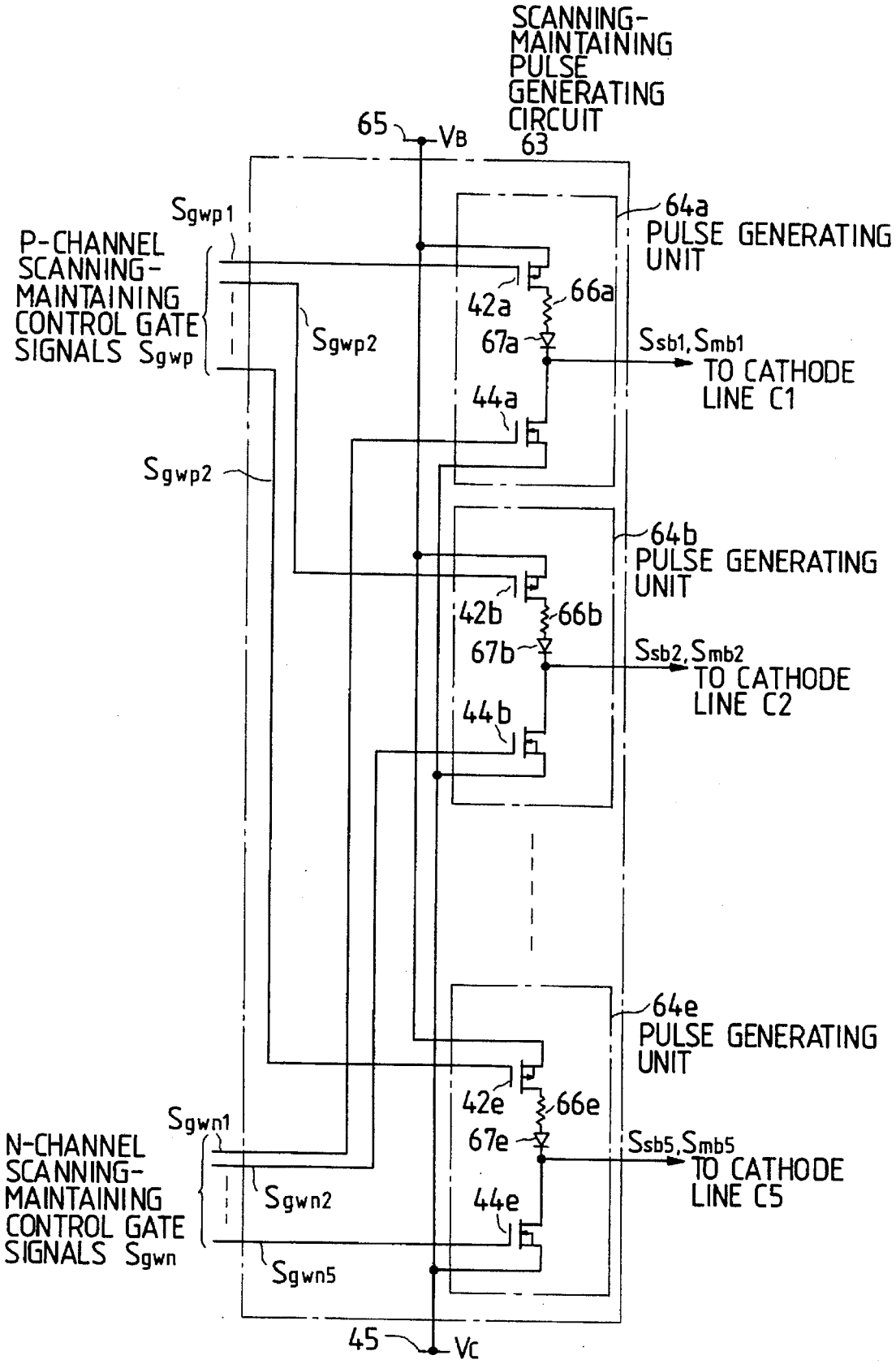
FIG. 16 is a circuit diagram of the scanning-maintaining pulse generating circuit shown in FIG. 15.
Figure 17:
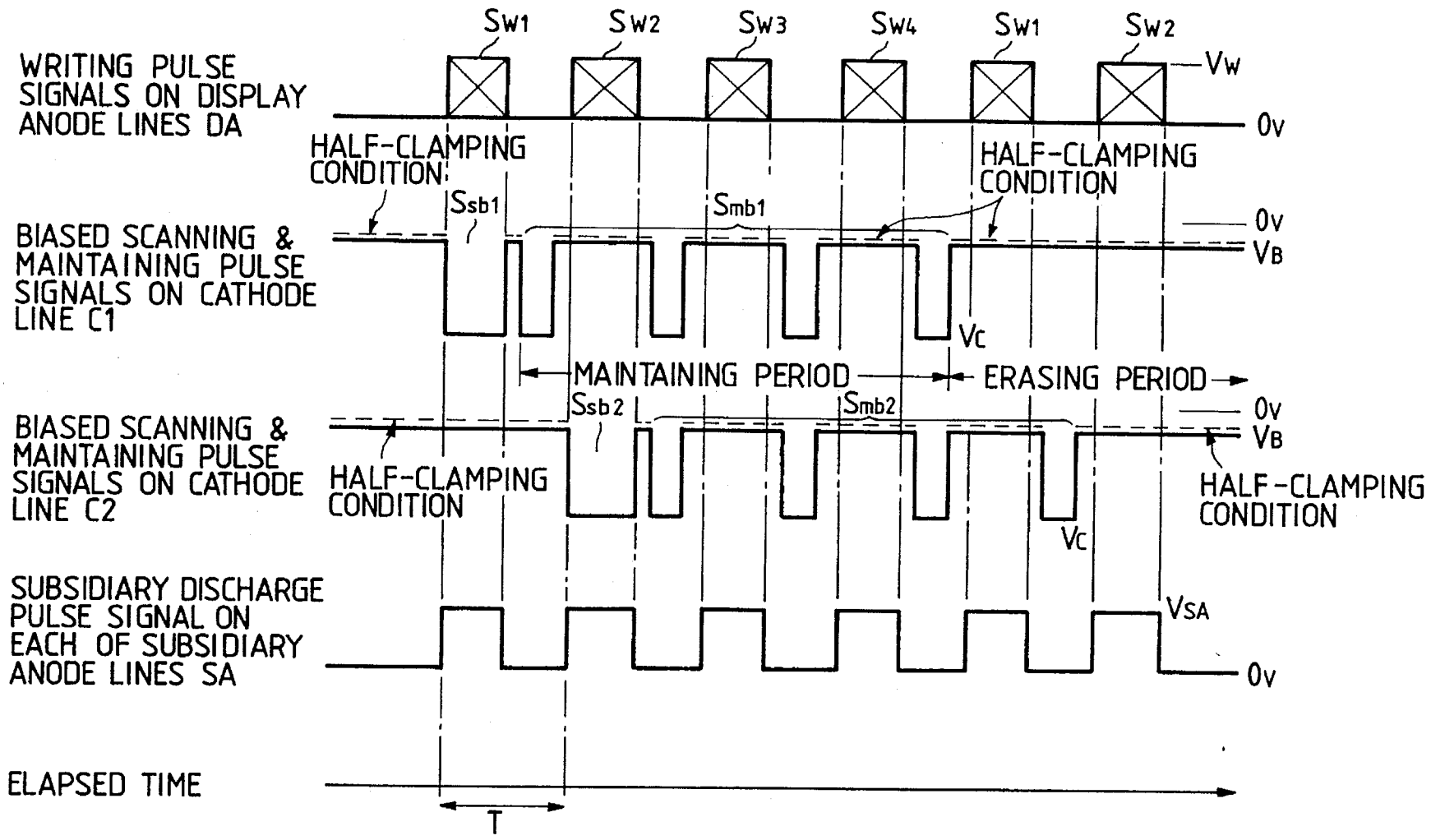
FIG. 17 shows waveforms of various signals transmitted in the gas discharge display apparatus shown in FIG. 16.

FIG. 16 is a circuit diagram of the scanning-maintaining pulse generating circuit 63 shown in FIG. 15. FIG. 17 shows waveforms of various signals transmitted in the gas discharge display apparatus 61 shown in FIG. 15.

As shown in FIG. 16, the scanning-maintaining pulse generating circuit 63 comprises five scanning-maintaining pulse generation units 64 (64*a*, 64*b*, 64*c*, 64*d*, and 64*e*) for selectively generating the scanning signals Ssa and the maintaining signals Sma according to the n-channel scanning-maintaining control gate signals Sgwn and the p-channel scanning-maintaining control gate signals Sgwp.

Each of the scanning-maintaining pulse generation units 64 comprises the p-channel field effect transistor (FET) 42 of which the source is connected to an electric source line 65 applied to a negative bias voltage $V_B$ and the gate is connected to one of p-channel output terminals to receive the p-channel scanning-maintaining control gate signal Sgwp from the scanning-maintaining control gate signal generating circuit 27, a current limiting resister 66 (66*a*, 66*b*, 66*c*, 66*d*, or 66*e*) of which one end is connected to a drain of the p-channel FET 42, a half-clamping diode 67 (67*a*, 67*b*, 67*c*, 67*d*, or 67*e*) of which an anode is connected to another end of the current limiting resister 66, and the n-channel field effect transistor (FET) 44 of which the source is connected to the electric source line 45 applied to the negative voltage Vc, the gate is connected to one of n-channel output terminals to receive the n-channel scanning-maintaining control gate signal Sgwn from the scanning-maintaining control gate signal generating circuit 27, and the drain is connected to a cathode of the half-clamping diode 67.

The negative bias voltage $V_B$ is higher than the negative voltage Vc. That is, an absolute value $|V_B|$ is lower than an absolute value |Vc|. The current limiting resister 66 functions so as to limit an electric current flowing from the electric source line 65 to the cathode line CL when neither the biased scanning signal Ssb nor a maintaining pulse of the biased maintaining signal Smb is applied on the cathode line CL. In cases where the n-channel FET transistor 44 is turned off (or neither the biased scanning signal Ssb nor a maintaining pulse of the biased maintaining signal Smb is applied on the cathode line CL), the voltage of the cathode line CL is almost kept at the negative bias voltage $V_B$ because the p-channel FET transistor 42 is turned on.

In addition, in cases where the voltage $V_B$ is applied on the cathode line CL through the p-channel FET 42, the half-clamping diode 67 functions so as to close an electric line between the p-channel FET 42 and the diode 67 when the voltage of the cathode line CL is increased because an electric current erroneously flows from the display anode line DA to the cathode line CL through the display cell 16. Therefore, the voltage of the cathode line CL is allowed to be increased. In contrast, when the voltage of the cathode line CL is decreased, the half-clamping diode 67 functions so as to open the electric line to promptly recover the voltage of the cathode line CL at the voltage $V_B$. That is, when no pulse is applied on the cathode lines CL, the cathode lines CL are set in a half-clamped condition by the action of the half-clamping diode 67.

In the above configuration of the scanning-maintaining pulse generating circuit 63, the n-channel and p-channel scanning-maintaining control gate signals Sgwn, Sgwp generated in the scanning-maintaining control gate signal generating circuit 27 are output to the scanning-maintaining pulse generating circuit 63 to control the biased scanning signals Ssb and the biased maintaining signals Smb which are transferred from the scanning-maintaining pulse generation units 64 to the cathode lines CL. That is, as shown in FIG. 17, the biased scanning signals $Ssb_1$, $Ssb_2$, $Ssb_3$, $Ssb_4$, and $Ssb_5$ are cyclically output from the scanning-maintaining pulse generation units 64 to the cathode lines CL in synchronism with the n-channel and p-channel scanning-maintaining control gate signals Sgwn, Sgwp. Also, the biased maintaining signals $Smb_1$, $Smb_2$, $Smb_3$, $Smb_4$, and $Smb_5$ subsequent to the biased scanning pulse signals Ssb are output from the scanning-maintaining pulse generation units 64 to the cathode lines CL in synchronism with the n-channel and p-channel scanning-maintaining control gate signals Sgwn, Sgwp.

In this case, the biased scanning signals Ssb and the biased maintaining signals Smb are biased at the negative bias voltage $V_B$. Therefore, an electric potential difference between a peak pulse voltage Vc of the signals and a tail voltage $V_B$ of the signals is reduced while keeping the peak pulse voltage Vc. Accordingly, an electric power required to produce the biased scanning signals Ssb and the biased maintaining signals Smb can be reduced on condition that writing gas discharge and maintaining gas discharge is reliably produced in the display cells 16 with the signals Sab, Smb having the peak pulse voltage Vc.

Also, when the bias voltage $V_B$ is applied on the cathode lines CL, an electric current flowing through each of the cathode lines CL is limited to a minimum value because the current limiting resister 66 prevents the electric current from flowing. Accordingly, even though the biased scanning signals Ssb and the biased maintaining signals Smb are biased at the negative bias voltage $V_B$, an electric power required to bias the biased scanning signals Ssb and the biased maintaining signals Smb can be lowered at the minimum value.

Also, even though an electric current erroneously flows from a display anode line DA to a cathode line CL through a display cell 16 because of erroneous gas discharge when the bias voltage $V_B$ is applied on the cathode line CL, the voltage of the cathode line CL is increased because the cathode line CL is closed by a half-clamping diode 67 and an n-channel FET transistor 44. Therefore, the electric potential difference between the display anode line DA and the cathode line CL is reduced. As a result, the erroneous gas discharge is promptly stopped. Accordingly, the growth from the erroneous gas discharge to arc discharge can be prevented.

Also, when maintaining gas discharge is not required in an erasing period, the biased maintaining signal is not applied on the cathode line. Therefore, an electric power required to produce the biased maintaining signal can be effectively consumed to produce the maintaining gas discharge in the maintaining period. In other words, the electric power is not consumed in the erasing period so that all of the electric power can be contributed to the maintaining gas discharge produced in the gas discharge display apparatus 61.

In addition, because only four types of voltages such as the voltage Vw of the writing pulse signals Sw, the voltage Vc of the biased scanning and maintaining signals Ssb, Smb, the voltage $V_{SA}$ of the subsidiary discharge pulse signals Sds, and the negative bias voltage $V_B$ are required in the display apparatus 61, the driving sections 12, 14, and 62 can be greatly simplified. As a result, the driving sections 12, 14, and 62 can be manufactured in an integrated circuit structure.

Next, a fourth embodiment according to the present invention is described with reference to drawings.

Figure 19:
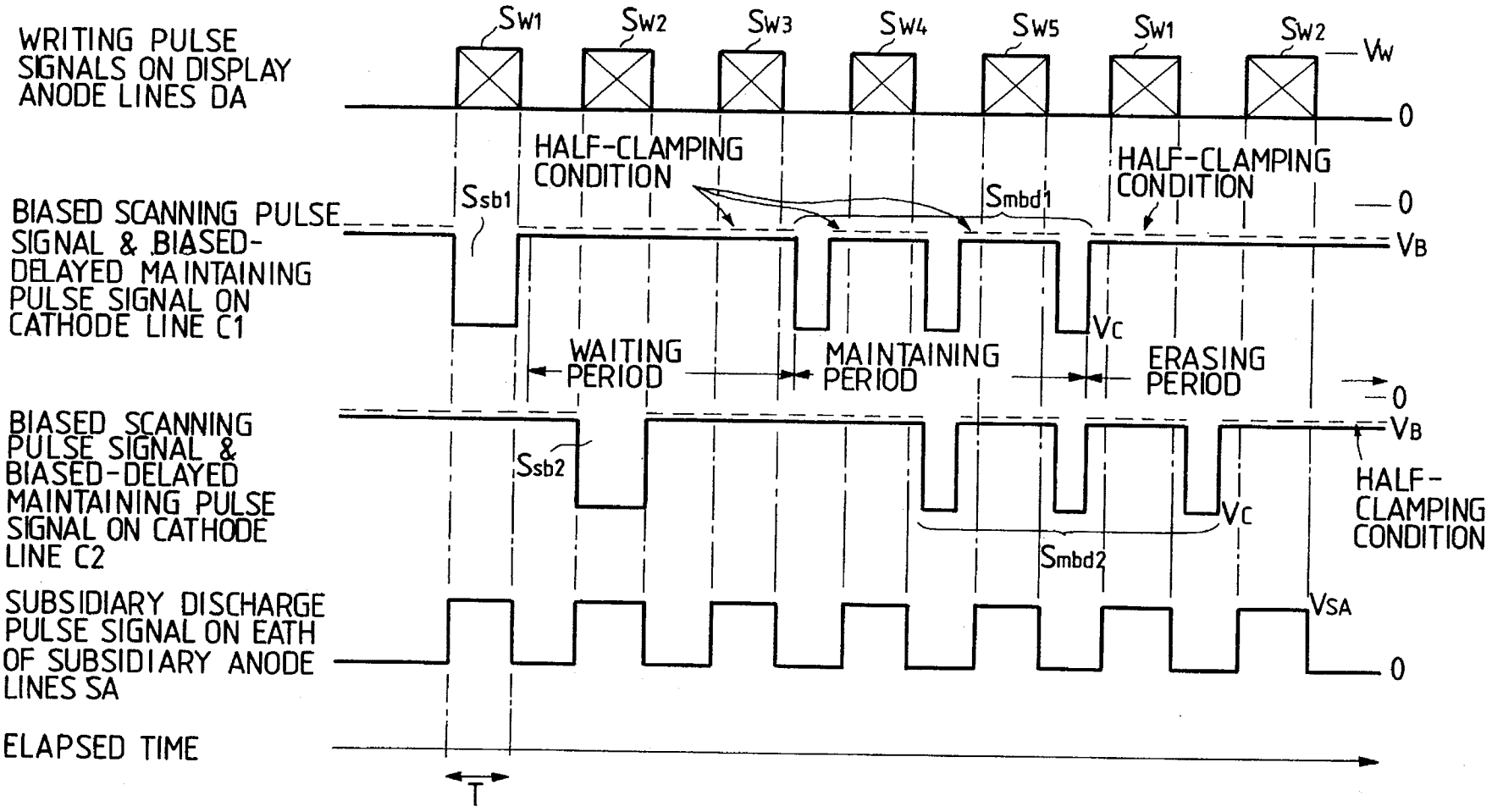
FIG. 19 shows waveforms of various signals transmitted in the gas discharge display apparatus shown in FIG. 18.

FIG. 18 is a composite view of a block diagram of driving circuits and the plan view of the gas discharge display panel shown in FIG. 6 according to a fourth embodiment of the present invention, a gas discharge display apparatus consisting of the driving circuits and the gas discharge display panel. FIG. 19 shows waveforms of various signals transmitted in the gas discharge display apparatus 68 shown in FIG. 18.

As shown in FIG. 18, a gas discharge display apparatus 68 comprises the display anode driving section 12, a cathode driving section 69 for generating the biased scanning signals Ssb cyclically transmitted on the cathode lines CL according to the scanning control information and biased-delayed 4, and $Smbd_5$) transmitted on each of the cathode lines CL according to the maintaining control information, the subsidiary anode driving section 14, and the gas discharge display panel 15. The cathode driving section 69 comprises a scanning-maintaining control gate signal generating circuit 70 for generating n-channel delayed scanning-maintaining control gate signals Sgdn and p-channel delayed scanning-maintaining control gate signals Sgdp according to the scanning and maintaining control information, and the scanning-maintaining pulse generating circuit 63.

Each of the n-channel delayed scanning-maintaining control gate signals Sgdn is formed by multiplexing the scanning gate signal produced in the scanning gate signal generating circuit 31 shown in FIG. 10 and a delayed maintaining gate signal produced in a delayed maintaining gate signal generating circuit manufactured in the same manner as the maintaining gate signal generating circuit 32 shown in FIG. 10. The delayed maintaining gate signal is delayed from the scanning gate signal by a regular interval ranging from a pulse width of the scanning gate signal to ten times as long as the pulse width. A method for delaying the delayed maintaining gate signal is the same as a method which was laid open to public inspection under Provisional Publication No. S63-127290 (Japanese Patent Application No. S61-272919).

Therefore, as shown in FIG. 19, the biased scanning signals Ssb and the biased-delayed maintaining signals Smbd delayed from the biased scanning signals Ssb by a regular interval ranging from a pulse width of the biased scanning signal Ssb to ten times as long as the pulse width.

In this case, writing gas discharge is produced at high speed according to a priming effect in which a display cell 16 and a subsidiary cell 17 is coupled by excited particles to enhance the writing gas discharge. After the writing gas discharge is finished, the excited particles are de-excited during a waiting period prior to a maintaining period. Thereafter, maintaining gas discharge is produced during the maintaining period.

Accordingly, even though the excited particles are produced too many, erroneous gas discharge resulting from excess excited particles can be prevented because the waiting period is set prior to the maintaining period.

Also, when maintaining gas discharge is not required in an erasing period, the biased maintaining signal is not applied on the cathode line. Therefore, an electric power required to produce the biased maintaining signal can be effectively consumed to produce the maintaining gas discharge in the maintaining period. In other words, the electric power is not consumed in the erasing period so that all of the electric power can be contributed to the maintaining gas discharge produced in the gas discharge display apparatus 68.

In addition, because only four types of voltages such as the voltage Vw of the writing pulse signals Sw, the voltage Vc of the biased scanning and maintaining signals Ssb, Smbd, the voltage $V_{SA}$ of the subsidiary discharge pulse signals Sds, and the negative bias voltage $V_B$ are required in the display apparatus 61, the driving sections 12, 14, and 69 can be greatly simplified. As a result, the driving sections 12, 14, and 69 can be manufactured in an integrated circuit structure.

Next, a fifth embodiment according to the present invention is described with reference to drawings.

Figure 20:
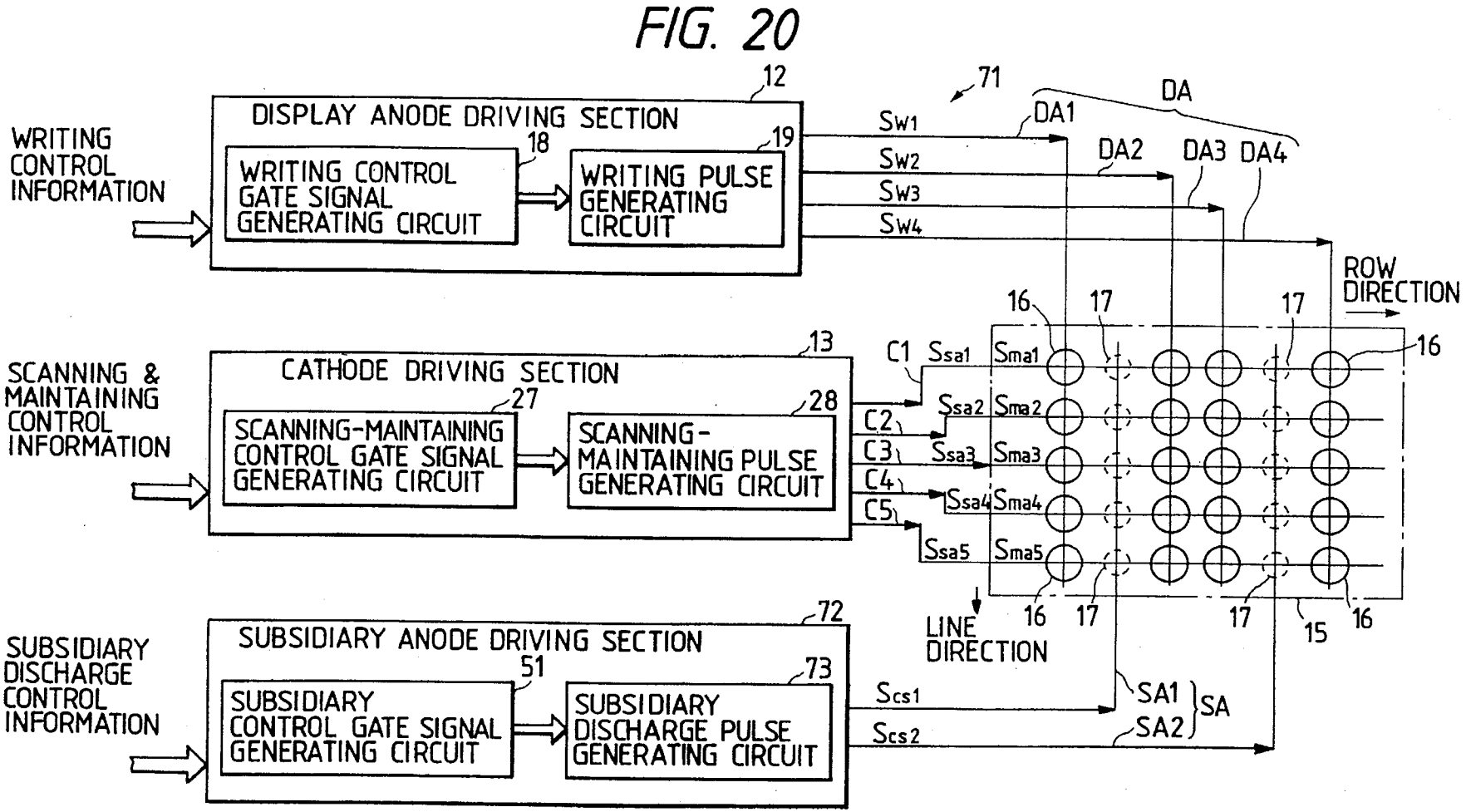
FIG. 20 is a composite view of a block diagram of driving circuits and the plan view of the gas discharge display panel shown in FIG. 6 according to a fifth embodiment of the present invention, a gas discharge display apparatus consisting of the driving circuits and the gas discharge display panel.

FIG. 20 is a composite view of a block diagram of driving circuits and the plan view of the gas discharge display panel shown in FIG. 6 according to a fifth embodiment of the present invention, a gas discharge display apparatus consisting of the driving circuits and the gas discharge display panel.

As shown in FIG. 20, a gas discharge display apparatus 71 comprises the display anode driving section 12, the cathode driving section 13, a subsidiary anode driving section 72 for generating clamped subsidiary discharge signals Scs ($Scs_1$, $Scs_2$) transmitted on each of the subsidiary anode lines SA according to the subsidiary discharge control information, and the gas discharge display panel 15.

The subsidiary anode driving section 72 comprises the subsidiary control gate signal generating circuit 51, and a subsidiary discharge pulse generating circuit 73 for generating the clamped subsidiary discharge signals Scs transmitted on the subsidiary anode lines SA according to the subsidiary control gate signals Sgsn, Sgsp generated in the subsidiary control gate signal generating circuit 51. Each of the clamped subsidiary discharge signals Scs has pulses at the regular cycle T.

In the above configuration of the subsidiary anode driving section 72, the n-channel and p-channel subsidiary discharge control gate signals Sgsn ($Sgsn_1$, $Sgsn_2$), Sgsp ($Sgsp_1$, $Sgsp_2$) are generated according to the subsidiary discharge control information in the subsidiary control gate signal generating circuit 51. Thereafter, the clamped subsidiary discharge signals Scs are generated according to the subsidiary discharge control gate signals Sgsn, Sgsp in the subsidiary discharge pulse generating circuit 73 to transmit the clamped subsidiary discharge signals Sds on the subsidiary anode lines SA.

Figure 21:
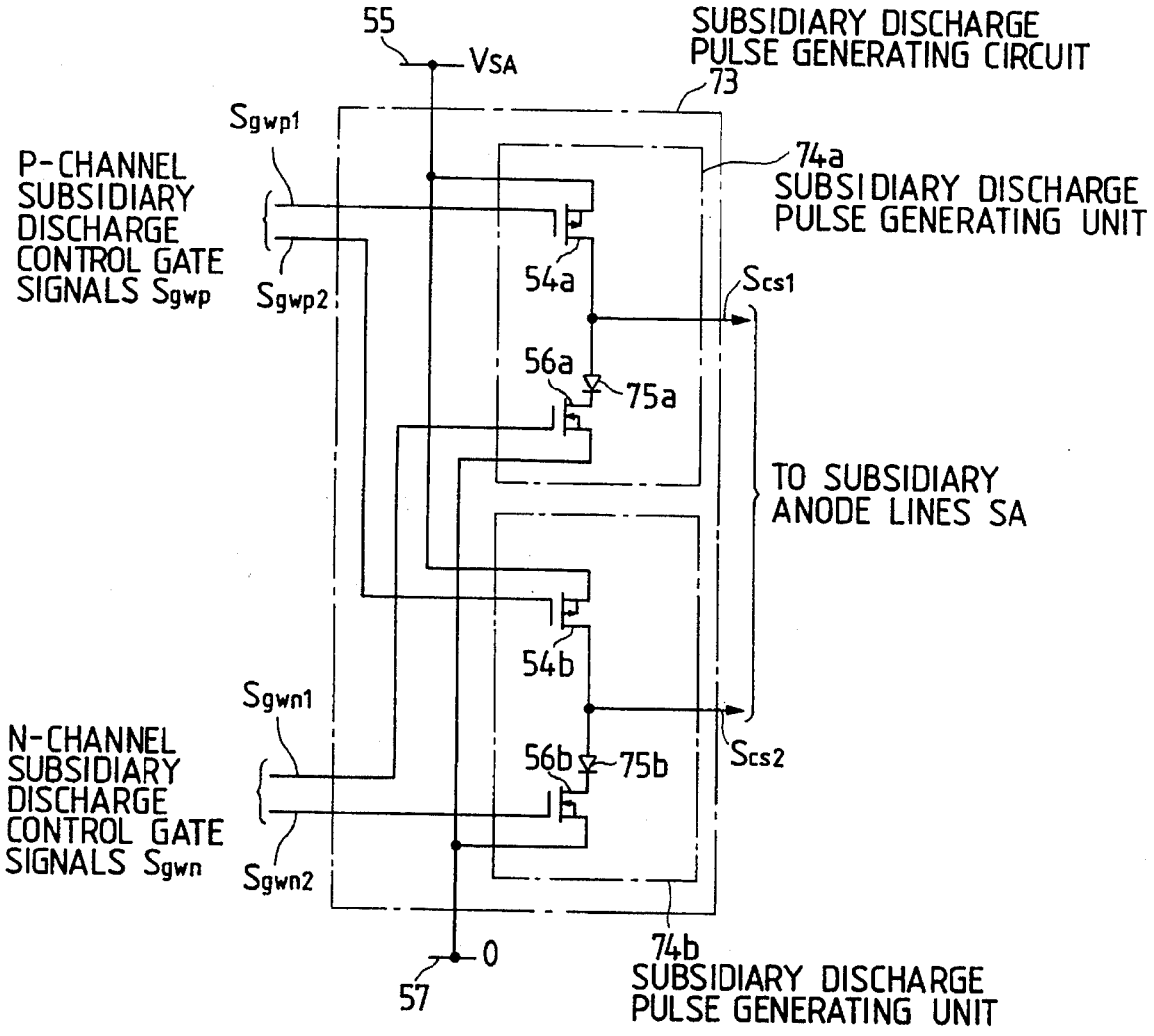
FIG. 21 is a circuit diagram of the subsidiary discharge pulse generating circuit shown in FIG. 20.
Figure 22:
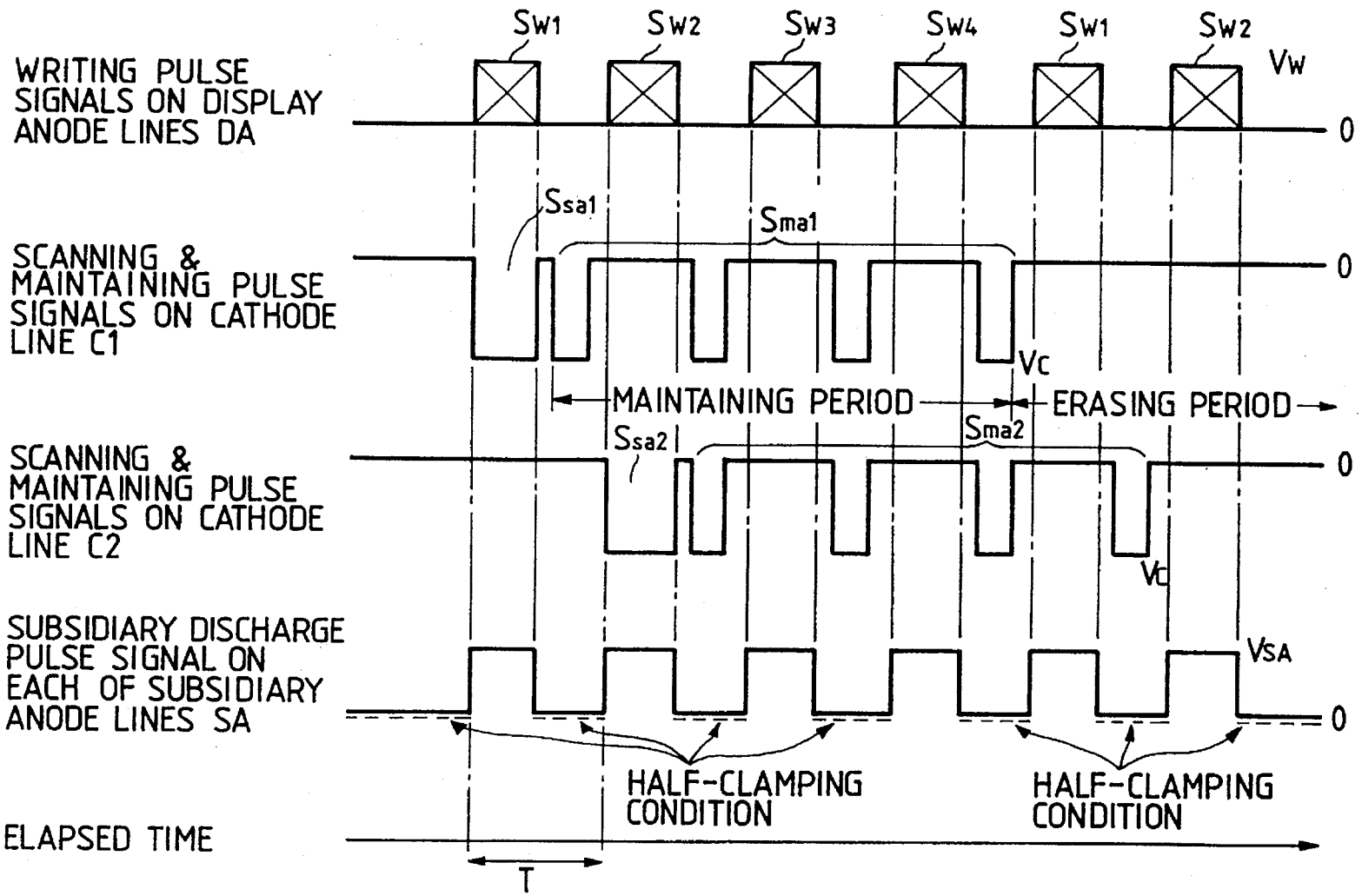
FIG. 22 shows waveforms of various signals transmitted in the gas discharge display apparatus shown in FIG. 20.

FIG. 21 is a circuit diagram of the subsidiary discharge pulse generating circuit 73 shown in FIG. 20. FIG. 22 shows waveforms of various signals transmitted in the gas discharge display apparatus 71 shown in FIG. 20.

As shown in FIG. 21, the subsidiary discharge pulse generating circuit 73 comprises two subsidiary discharge pulse generation units 74 (74*a*, 74*b*) for selectively generating the clamped subsidiary discharge signals Scs according to the n-channel and p-channel subsidiary discharge control gate signals Sgwn, Sgwp.

Each of the subsidiary discharge pulse generation units 74 comprises the p-channel field effect transistor (FET) 54, a half-clamping diode 75 (75*a*, 75*b*) of which an anode is connected to the drain of the p-channel FET 54, and the n-channel field effect transistor (FET) 56 of which the source is connected to the grounded line 57 maintained at a voltage 0 v, the gate is connected to one of n-channel output terminals to receive the n-channel scanning-maintaining control gate signal Sgsn from the subsidiary discharge control gate signal generating circuit 51, and the drain is connected to a cathode of the half-clamping diode 75.

In cases where no pulse is applied on the subsidiary anode lines SA, the n-channel FET 56 is turned on and the p-channel FET 54 is turned off. Therefore, the voltage of the subsidiary anode lines SA is allowed to be reduced by the action of the half-clamping diode 75. However, the voltage of the subsidiary anode lines SA is not allowed to be increased. Therefore, the subsidiary anode lines SA are set in a half-clamped condition in cases where no pulse is applied on the subsidiary anode lines SA.

In the above configuration of the subsidiary discharge pulse generating circuit 73, the n-channel and p-channel subsidiary discharge control gate signals Sgsn, Sgsp generated in the subsidiary control gate signal generating circuit 51 are output to the subsidiary discharge pulse generating circuit 73 to control the clamped subsidiary discharge signals Scs transferred from the subsidiary discharge pulse generation units 74 to the subsidiary anode lines SA. That is, the clamped subsidiary discharge signals Scs are produced in synchronism with the n-channel and p-channel subsidiary discharge control gate signals Sgsn, Sgsp.

Also, as shown FIG. 22, the clamped subsidiary discharge signals Scs uniformly have the peak voltage $V_{SA}$. Thereafter, the clamped subsidiary discharge signals Scs are transmitted on the subsidiary anode lines SA. In cases where the p-channel FET transistor 54 is turned off so that no pulse of the clamped subsidiary discharge signal Scs is applied on the subsidiary anode line SA, the n-channel FET transistor 56 is turned on. Therefore, even though the voltage of the cathode line CL is positive, the voltage of the cathode line is promptly reduced to zero voltage. That is, the voltage of the cathode line CL does not become higher than the zero voltage. Therefore, the electric potential difference between the cathode line CL and the subsidiary anode line SA is minimized when a pulse of the maintaining pulse signal Sma is applied on the cathode line CL. Accordingly, a possibility that subsidiary gas discharge is erroneously produced between the cathode line CL and the subsidiary anode line SA can be reduced.

Nevertheless, in cases where subsidiary gas discharge is erroneously produced between a cathode line CL and a subsidiary anode line SA when a pulse of the maintaining pulse signal Sma is applied on the cathode line CL, an electric current flows from the subsidiary anode line SA to the cathode line CL through the subsidiary cell 17. Also, no electric current flows from the grounded line 57 to the electric line by the action of the half-clamping diode 75. Therefore, the electric line between the p-channel FET 54 and the diode 75 becomes negative. That is, the half-clamping diode 75 functions so as to close the electric line. Therefore, the electric potential difference between the cathode line CL and the subsidiary anode line SA is reduced, so that the subsidiary gas discharge erroneously produced is stopped. Accordingly, an electric power consumed for the subsidiary gas discharge erroneously produced can be saved, and the growth of the subsidiary gas discharge to an arc discharge can be prevented.

Also, when the maintaining gas discharge is not required in an erasing period, the maintaining pulse signal is not applied on the cathode line. Therefore, an electric power required to produce the maintaining pulse signal can be effectively consumed to produce the maintaining gas discharge in the maintaining period. In other words, the electric power is not consumed in the erasing period so that all of the electric power can be contributed to the maintaining gas discharge produced in the gas discharge display apparatus 71.

In addition, because only three types of voltages such as the voltage Vw of the writing pulse signals Sw, the voltage Vc of the scanning and maintaining pulse signals Ssa, Sma, and the voltage $V_{SA}$ of the clamped subsidiary discharge signals Scs are required in the display apparatus 71, the driving sections 12, 13, and 72 can be greatly simplified. As a result, the driving sections 12, 13, and 72 can be manufactured in an integrated circuit structure.

Next, a sixth embodiment according to the present invention is described with reference to drawings.

FIG. 23 is composite view of a block diagram of driving circuits and the plan view of the gas discharge display panel shown in FIG. 6 according to a sixth embodiment of the present invention, a gas discharge display apparatus consisting of the driving circuits and the gas discharge display panel.

As shown in FIG. 23, a gas discharge display apparatus 76 comprises the display anode driving section 12, the cathode driving section 13, a subsidiary anode driving section 77 for generating biased subsidiary discharge signals Sbs ($Sbs_1$, $Sbs_2$) transmitted on each of the subsidiary anode lines SA according to the subsidiary discharge control information, and the gas discharge display panel 15.

The subsidiary anode driving section 77 comprises the subsidiary control gate signal generating circuit 51, and a subsidiary discharge pulse generating circuit 78 for generating the biased subsidiary discharge signals Sbs transmitted on the subsidiary anode lines SA according to the subsidiary control gate signals Sgsn, Sgsp generated in the subsidiary control gate signal generating circuit 51. Each of the biased subsidiary discharge signals Sbs has pulses at the regular cycle T.

In the above configuration of the subsidiary anode driving section 77, the n-channel and p-channel subsidiary discharge control gate signals ($Sgsn_1$, $Sgsn_2$), Sgsp ($Sgsp_1$, $Sgsp_2$) are generated according to the subsidiary discharge control information in the subsidiary control gate signal generating circuit 51. Thereafter, the biased subsidiary discharge signals Sbs are generated according to the subsidiary discharge control gate signals Sgsn, Sgsp in the subsidiary discharge pulse generating circuit 78 to transmit the biased subsidiary discharge signals Sbs on the subsidiary anode lines SA.

Figure 24:
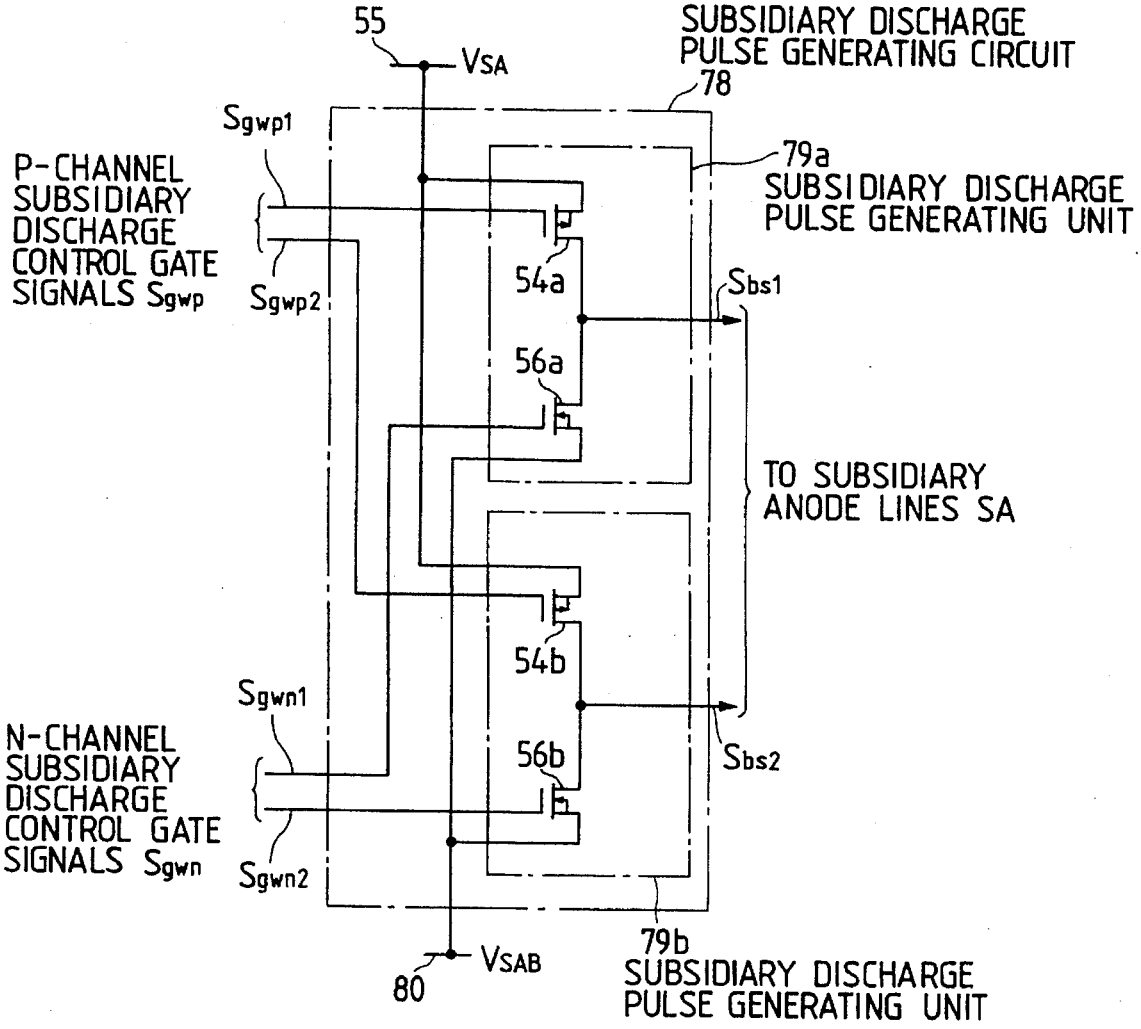
FIG. 24 is a circuit diagram of the subsidiary discharge pulse generating circuit shown in FIG. 23.
Figure 25:
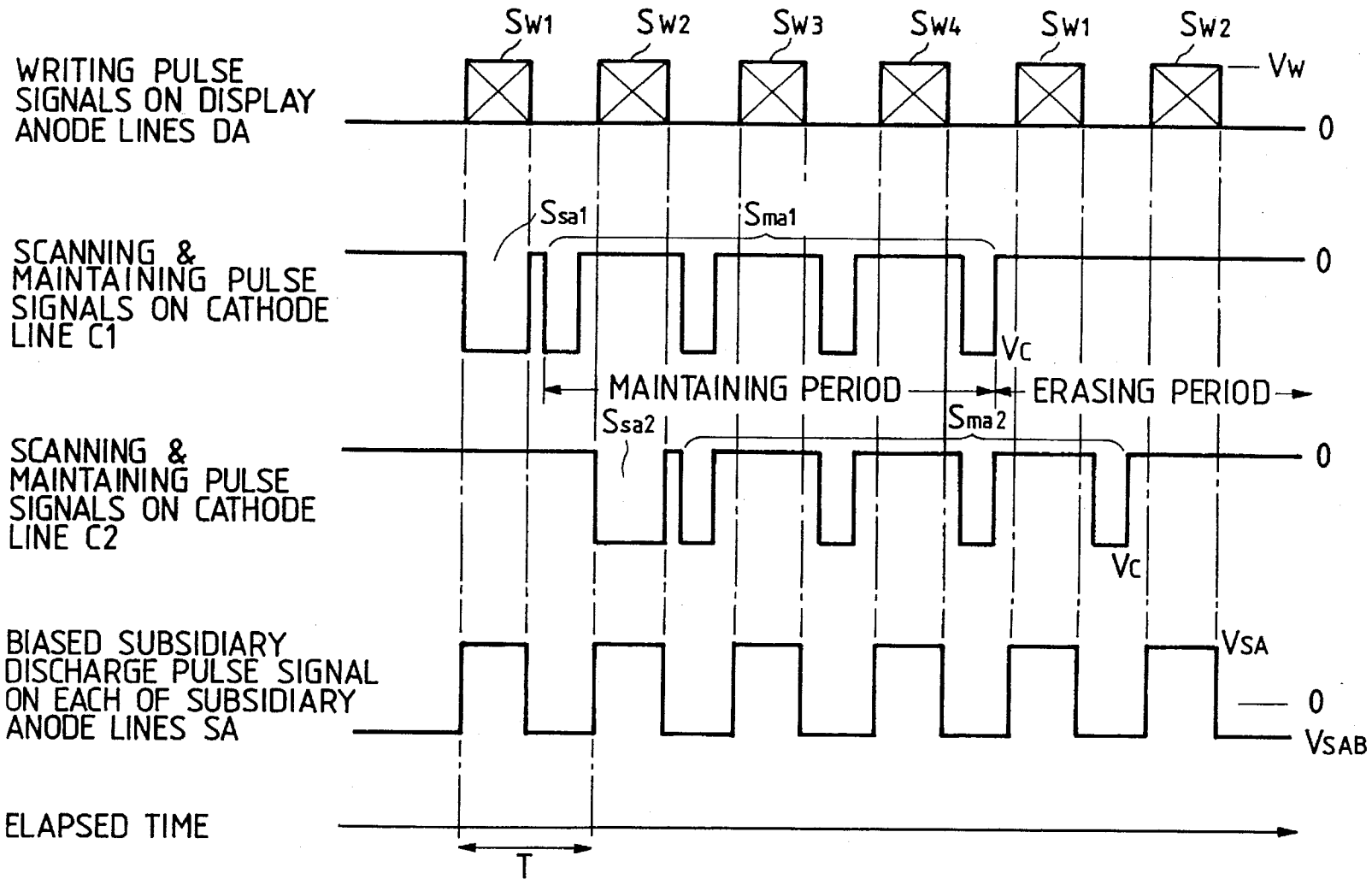
FIG. 25 shows waveforms of various signals transmitted in the gas discharge display apparatus shown in FIG. 23.

FIG. 24 is a circuit diagram of the subsidiary discharge pulse generating 78 shown in FIG. 23. FIG. 25 shows waveforms of various signals transmitted in the gas discharge display apparatus 76 shown in FIG. 23.

As shown in FIG. 24, the subsidiary discharge pulse generating circuit 78 comprises two subsidiary discharge pulse generation units 79 (79*a*, 79*b*) for selectively generating the biased subsidiary discharge signals Sbs according to the n-channel and p-channel subsidiary discharge control gate signals Sgwn, Sgwp.

Each of the subsidiary discharge pulse generation units 79 comprises the p-channel field effect transistor (FET) 54, and the n-channel field effect transistor (FET) 56 of which the source is connected to an electric source line 80 applied at a negative bias voltage $V_{SAB}$, the gate is connected to one of n-channel output terminals to receive the n-channel scanning-maintaining control gate signal Sgsn from the subsidiary discharge control gate signal generating circuit 51, and the drain is connected to the drain of the p-channel FET 54. The negative bias voltage $V_{SAB}$ is higher than the peak voltage Vc of the maintaining pulse signal Sma.

In the above configuration of the subsidiary discharge pulse generating circuit 78, the n-channel and p-channel subsidiary discharge control gate signals Sgsn, Sgsp generated in the subsidiary control gate signal generating circuit 51 are output to the subsidiary discharge pulse generating circuit 78 to control the biased subsidiary discharge signals Sbs transferred from the subsidiary discharge pulse generation units 79 to the subsidiary anode lines SA. That is, the biased subsidiary discharge signals Scs are produced in synchronism with the n-channel and p-channel subsidiary discharge control gate signals Sgsn, Sgsp.

Also, as shown in FIG. 25, the biased subsidiary discharge signals Sbs uniformly have the peak voltage $V_{SA}$ and a trail negative voltage $V_{SAB}$. Thereafter, the biased subsidiary discharge signals Sbs are transmitted on the subsidiary anode lines SA. In this case, maintaining gas discharge is produced by utilizing a first electric potential difference Vw+|Vc| between the display anode line DA and the cathode line CL. When the maintaining gas discharge is produced, the voltage of the subsidiary anode line SA is set to the negative bias voltage $V_{SAB}$. Therefore, a second electric potential difference $|Vc_|-|V_{SAB}|$ between the subsidiary anode line SA and the cathode line CL is greatly lower than the first electric potential difference Vw+|Vc|. As a result, even though the maintaining gas discharge is actively produced, erroneous subsidiary gas discharge produced between the subsidiary anode line SA and the cathode line CL can be reliably prevented because the second electric potential difference $|Vc|-|V_{SAB}|$ is reduced.

Also, when the maintaining gas discharge is not required in an erasing period, the maintaining pulse signal is not applied on the cathode line. Therefore, an electric power required to produce the maintaining pulse signal can be effectively consumed to produce the maintaining gas discharge in the maintaining period. In other words, the electric power is not consumed in the erasing period so that all of the electric power can be contributed to the maintaining gas discharge produced in the gas discharge display apparatus 71.

In addition, because only four types of voltages such as the voltage Vw of the writing pulse signals Sw, the voltage Vc of the scanning and maintaining pulse signals Ssa, Sma, and the voltage $V_{SA}$ and the bias voltage $V_{SAB}$ of the biased subsidiary discharge signals Sbs are required in the display apparatus 76, the driving sections 12, 13, and 77 can be greatly simplified. As a result, the driving sections 12, 13, and 77 can be manufactured in an integrated circuit structure.

Next, a seventh embodiment according to the present invention is described with reference to drawings.

Figure 26:
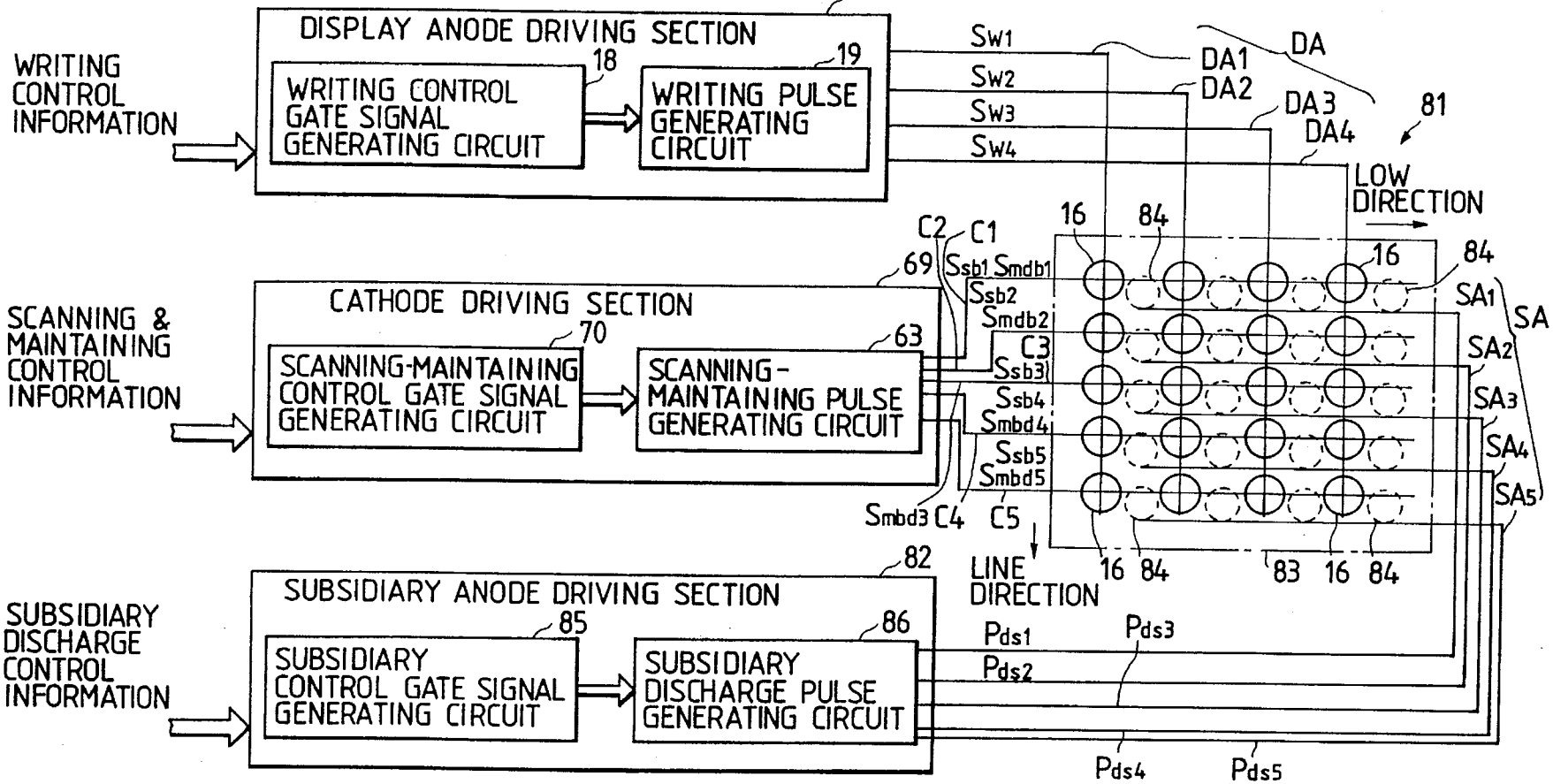
FIG. 26 is a composite view of a block diagram of driving circuits and a plan view of a gas discharge display panel according to a seventh embodiment of the present invention, a gas discharge display apparatus consisting of the driving circuits and the gas discharge display panel.

FIG. 26 is a composite view of a block diagram of driving circuits and a plan view of a gas discharge display panel according to a seventh embodiment of the present invention, a gas discharge display apparatus consisting of the driving circuits and the gas discharge display panel.

As shown in FIG. 26, a gas discharge display apparatus 81 comprises the display anode driving section 12, the cathode driving section 69, a subsidiary anode driving section 82 for generating subsidiary discharge cyclic pulses Pds ($Pds_1$, $Pds_2$, $Pds_3$, $Pds_4$, and $Pds_5$) transmitted on each of subsidiary anode lines SA according to pieces of subsidiary discharge control information, and a gas discharge display panel 83 in which writing gas discharge and maintaining gas discharge subsequent to the writing gas discharge are produced to radiate visible light according to the writing pulse signals Sw generated in the display anode driving section 12, the biased scanning signals Ssb and the biased-delayed maintaining signals Smbd generated in the cathode driving section 69, and the subsidiary discharge cyclic pulses Pds generated in the subsidiary anode driving section 82.

The gas discharge display panel 83 comprises the display anode lines DA, the cathode lines CL, the display cells 16, five subsidiary anode lines SA (SA1, SA2, SA3, SA4, and SA5) which are arranged in parallel to the cathode lines CL and are arranged between the cathode lines CL, and a plurality of subsidiary cells 84 which are arranged between the cathode lines CL and the subsidiary anode lines SA and are arranged between the display anode lines DA. The display panel 83 was laid open to public inspection under Provisional Publication No. H4-6734 (Japanese Patent Application No. H2-107470).

The number of cathode lines is not limited to five, the number of display anode lines is not limited to four, and the number of subsidiary anode lines is not limited to five.

In the above configuration of the gas discharge display panel 83, the subsidiary discharge cyclic pulses Pds are transmitted on the subsidiary anode lines SA at regular intervals. Thereafter, each time the biased scanning signal $Ssb_1$, $Ssb_2$, $Ssb_3$, or $Ssb_4$ is cyclically transmitted on each of the cathode lines C1 to C5 in synchronism with the subsidiary discharge cyclic pulses Pds, subsidiary gas discharge is produced in each of the subsidiary cells 84. The subsidiary cell 84 relating to the subsidiary gas discharge shifts in the line direction. Also, each time the writing pulse signal $Sw_1$, $Sw_2$, $Sw_3$, or $Sw_4$ is cyclically and selectively transmitted on each of the display anode lines DA1 to DA4 in synchronism with the subsidiary discharge cyclic pulses Pds, writing gas discharge is produced in each of the display cells 16. The display cell 16 relating to the writing gas discharge shifts in the line and row directions (in a lower right direction in FIG. 26). Thereafter, maintaining gas discharge is maintained in each of the display cells 16 during a maintaining period by applying the biased-delayed maintaining pulse signals Sma to the display cells 16.

The subsidiary anode driving section 82 comprises a subsidiary control gate signal generating circuit 85 for generating five types of n-channel subsidiary control gate signals Sgsn ($Sgsn_1$, $Sgsn_2$, $Sgsn_3$, $Sgsn_4$, and $Sgsn_5$) and five types of p-channel subsidiary control gate signals Sgsp ($Sgsp_1$, $Sgsp_2$, $Sgsp_3$, $Sgsp_4$, and $Sgsp_5$) according to the subsidiary discharge control information, and a subsidiary discharge pulse generating circuit 86 for generating the subsidiary discharge cyclic pulses Pds ($Pds_1$, $Pds_2$) transmitted on the subsidiary anode lines SA according to the subsidiary control gate signals $Sgsn_5$, $Sgsp_5$ generated in the subsidiary control gate signal generating circuit 85. The subsidiary discharge cyclic pulses Pds are transmitted at the regular cycle T.

In the above configuration of the subsidiary anode driving section 82, the n-channel and p-channel subsidiary discharge control gate signals Sgsn, Sgsp are generated according to the subsidiary discharge control information in the subsidiary control gate signal generating circuit 85. Thereafter, the subsidiary discharge cyclic pulses Pds are generated according to the subsidiary discharge control gate signals Sgsn, Sgsp in the subsidiary discharge pulse generating circuit 86 to transmit the subsidiary discharge cyclic pulses Pds on the subsidiary anode lines SA.

Figure 27:
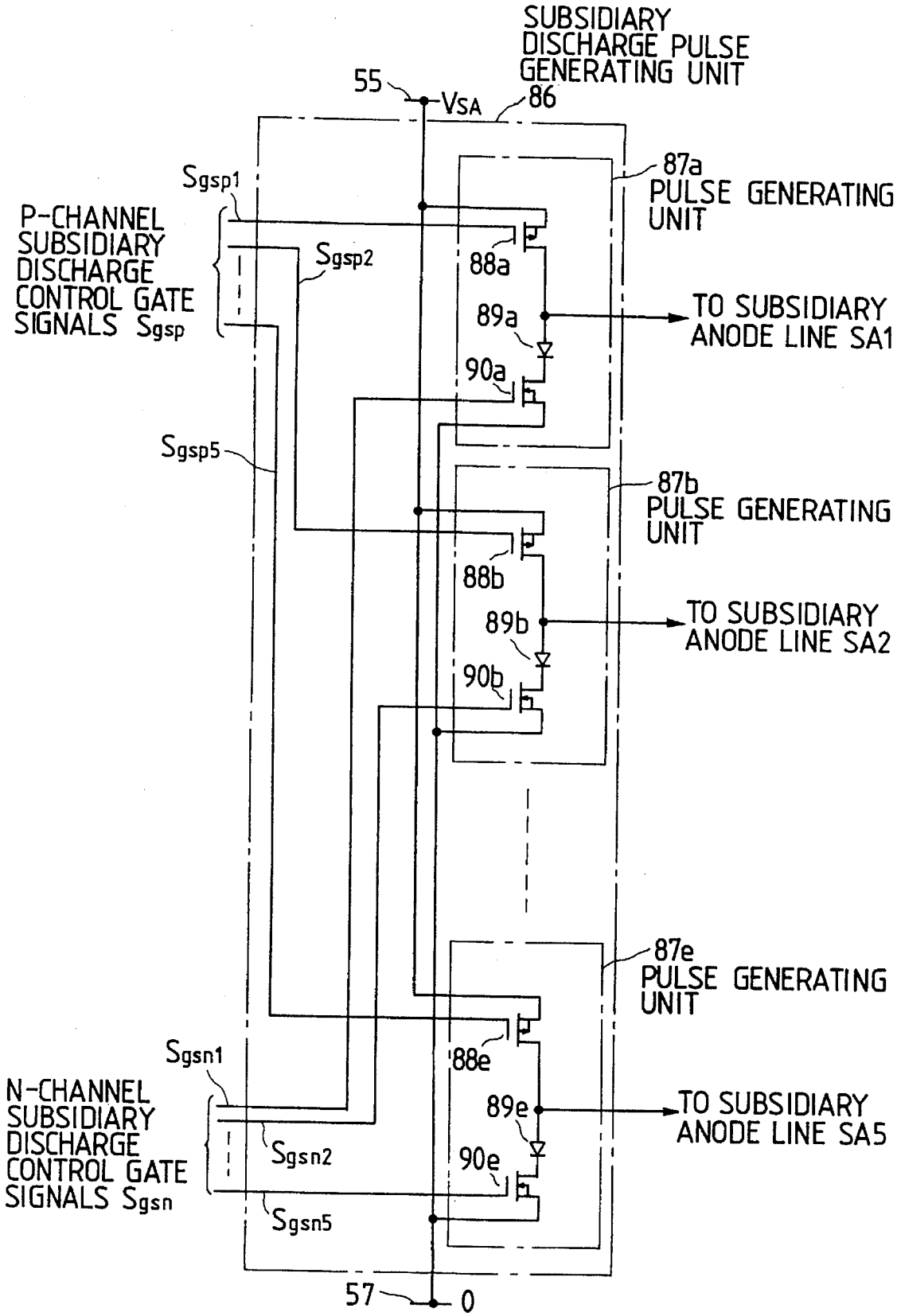
FIG. 27 is a circuit diagram of the subsidiary discharge pulse generating circuit shown in FIG. 26.
Figure 28:
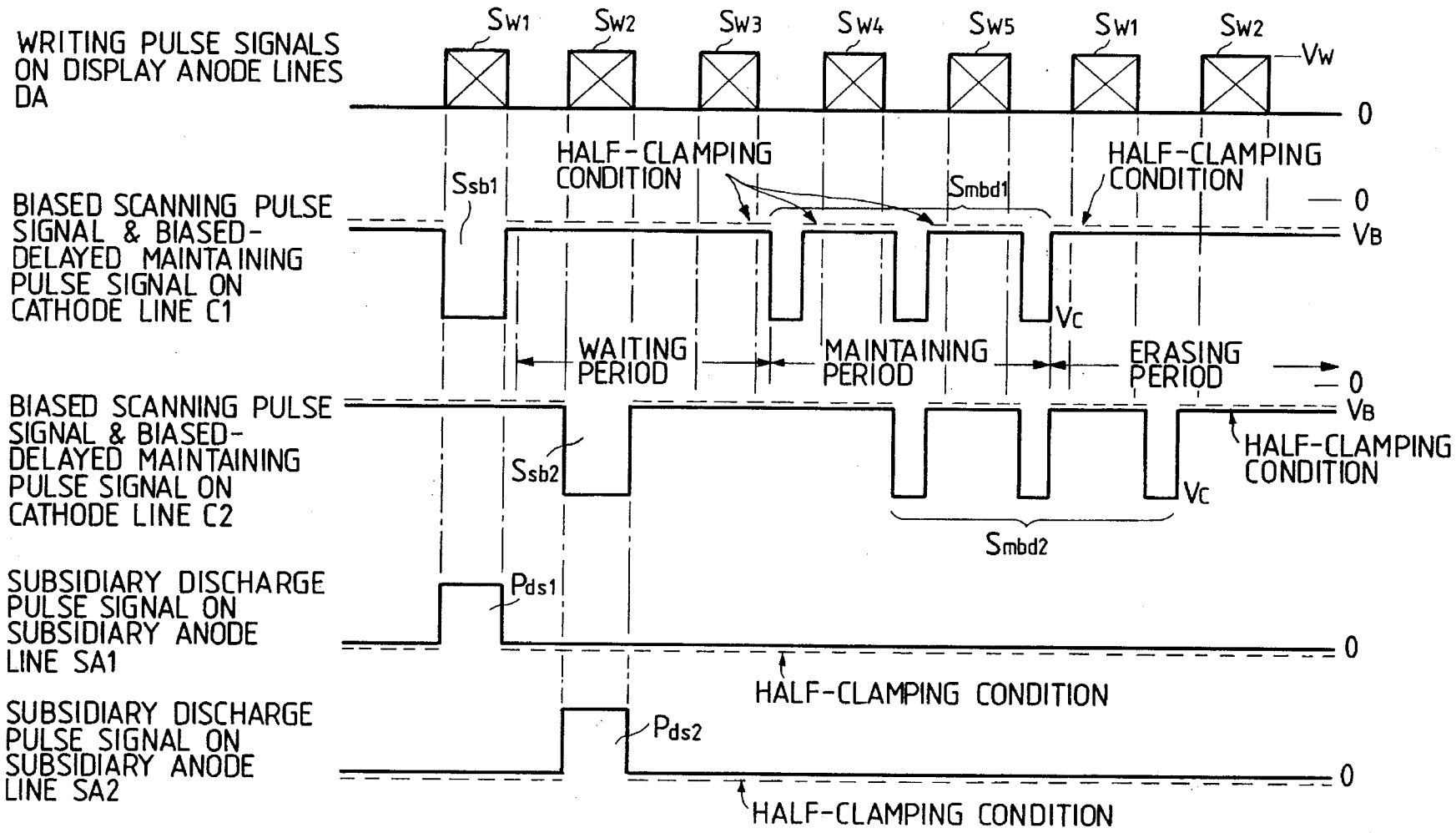
FIG. 28 shows waveforms of various signals transmitted in the gas discharge display apparatus shown in FIG. 26.

FIG. 27 is a circuit diagram of the subsidiary discharge pulse generating circuit 86 shown in FIG. 26. FIG. 28 shows waveforms of various signals transmitted in the gas discharge display apparatus 81 shown in FIG. 26.

As shown in FIG. 27, the subsidiary discharge pulse generating circuit 86 comprises five subsidiary discharge pulse generation units 87 (87*a*, 87*b*, 87*c*, 87*d*, and 87*e*) for selectively generating the subsidiary discharge cyclic pulses Pds according to the n-channel and p-channel subsidiary discharge control gate signals Sgsn, Sgsp.

Each of the subsidiary discharge pulse generation units 87 comprises a p-channel field effect transistor (FET) 88 (88*a*, 88*b*, 88*c*, 88*d*, or 88*e*) of which a source is connected to the electric source line 55 applied to the positive voltage $V_{SA}$ and a gate is connected to one of p-channel output terminals to receive the p-channel subsidiary discharge control gate signal Sgsp from the subsidiary discharge control gate signal generating circuit 85, a half-clamping diode 89 (89*a*, 89*b*, 89*c*, 89*d*, or 89*e*) of which an anode is connected to a drain of the p-channel FET 88, and an n-channel field effect transistor (FET) 90 (90*a*, 90*b*, 90*c*, 90*d*, or 90*e*) of which a source is connected to the grounded line 57 maintained at a voltage 0 v, a gate is connected to one of n-channel output terminals to receive the n-channel scanning-maintaining control gate signal Sgsn from the subsidiary discharge control gate signal generating circuit 85, and a drain is connected to a cathode of the half-clamping diode 89.

In cases where no pulse is applied on the subsidiary anode lines SA, the n-channel FET 90 is turned on and the p-channel FET 88 is turned off. Therefore, the voltage of the subsidiary anode lines SA is allowed to be reduced by the action of the half-clamping diode 89. However, the voltage of the subsidiary anode lines SA is not allowed to be increased. Therefore, the subsidiary anode lines SA are set in a half-clamped condition in cases where no pulse is applied on the subsidiary anode lines SA.

In the above configuration of the subsidiary discharge pulse generating circuit 86, the n-channel and p-channel subsidiary discharge control gate signals Sgsn, Sgsp generated in the subsidiary control gate signal generating circuit 85 are output to the subsidiary discharge pulse generating circuit 86 to control the subsidiary discharge cyclic pulses Pds transferred from the subsidiary discharge pulse generation units 87 to the subsidiary anode lines SA. That is, the subsidiary discharge cyclic pulses Pds are produced in synchronism with the n-channel and p-channel subsidiary discharge control gate signals Sgsn, Sgsp.

Also, as shown in FIG. 28, the subsidiary discharge cyclic pulses Pds uniformly have the peak voltage $V_{SA}$. Thereafter, the subsidiary discharge cyclic pulses Pds are transmitted on the subsidiary anode lines SA. In cases where the p-channel FET transistor 88 is turned off so that no subsidiary discharge cyclic pulse Pds is applied on the subsidiary anode line SA, the n-channel FET transistor 90 is turned on. Therefore, even though the voltage of the cathode line CL is positive, the voltage of the cathode line is promptly reduced to zero voltage. That is, the voltage of the cathode line CL does not become higher than the zero voltage. Therefore, the electric potential difference between the cathode line CL and the subsidiary anode line SA is minimized when a pulse of the biased-delayed maintaining signal Smb is applied on the cathode line CL. Accordingly, a possibility that subsidiary gas discharge is erroneously produced between the cathode line CL and the subsidiary anode line SA can be reduced.

Nevertheless, in cases where subsidiary gas discharge is erroneously produced between a cathode line CL and a subsidiary anode line SA when a pulse of the biased-delayed maintaining signal Smb is applied on the cathode line CL, an electric current flows from the subsidiary anode line SA to the cathode line CL through the subsidiary cell 84. Therefore, an electric line between the n-channel and p-channel FETs 88, 90 becomes negative. Also, no electric current flows from the grounded line 57 to the electric line because of the half-clamping diode 89. That is, the half-clamping diode 89 functions so as to close the electric line. Therefore, the electric potential difference between the cathode line CL and the subsidiary anode line SA is reduced, so that the subsidiary gas discharge erroneously produced is stopped. Accordingly, an electric power consumed for the subsidiary gas discharge erroneously produced can be saved, and the growth of the subsidiary gas discharge to an arc discharge can be prevented.

Also, because the subsidiary discharge cyclic pulses Pds are not always produced, an electric power required to produce the pulses Pds can be greatly reduced.

Also, when the maintaining gas discharge is not required in an erasing period, the biased-delayed maintaining signal is not applied on the cathode line. Therefore, an electric power required to produce the biased-delayed maintaining signal can be effectively consumed to produce the maintaining gas discharge in the maintaining period. In other words, the electric power is not consumed in the erasing period so that all of the electric power can be contributed to the maintaining gas discharge produced in the gas discharge display apparatus 81.

In addition, because only four types of voltages such as the voltage Vw of the writing pulse signals Sw, the voltage Vc of the biased scanning and maintaining signals Ssb, Smbd, the voltage $V_{SA}$ of the subsidiary discharge cyclic pulses Pds, and the negative bias voltage $V_B$ are required in the display apparatus 81, the driving sections 12, 14, and 82 can be greatly simplified. As a result, the driving sections 12, 14, and 82 can be manufactured in an integrated circuit structure.

Next, an eighth embodiment according to the present invention is described with reference to drawings.

Figure 30:
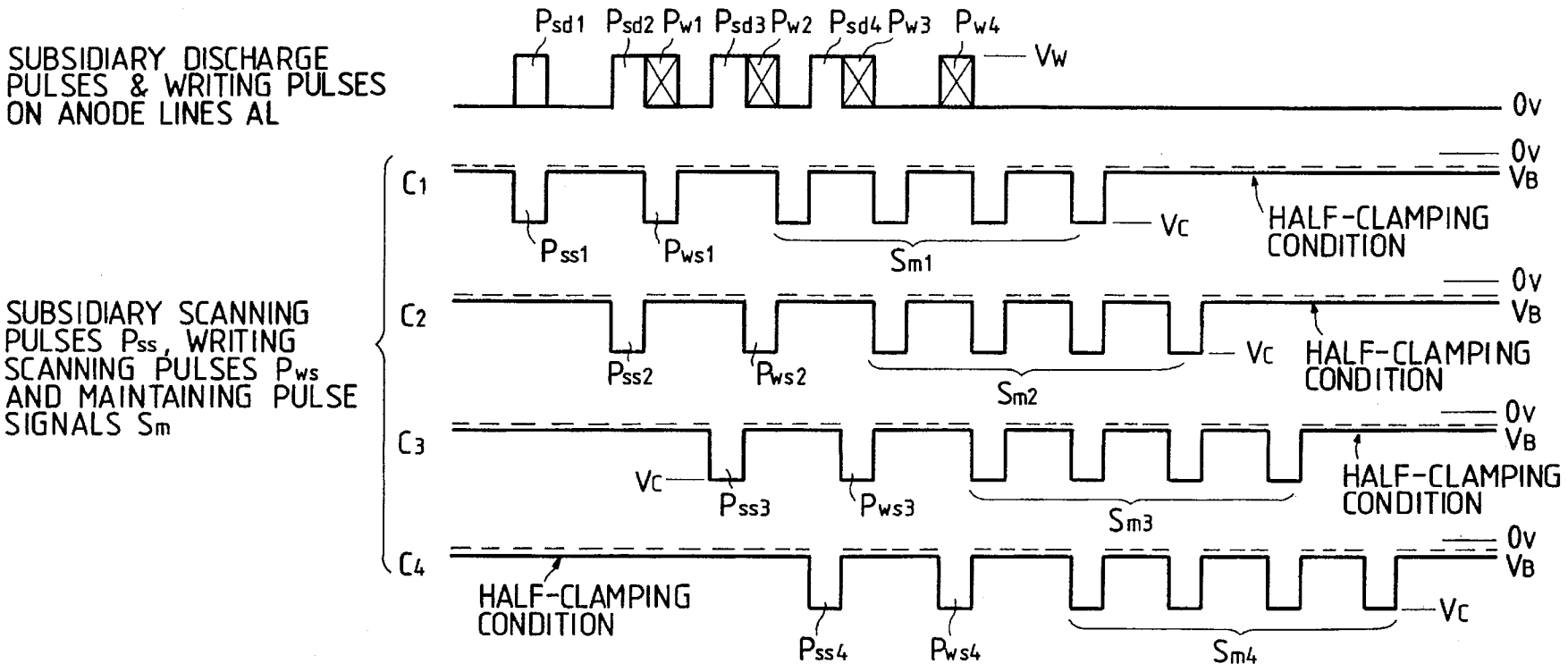
FIG. 30 shows waveforms of various signals transmitted in the gas discharge display apparatus shown in FIG. 29.

FIG. 29 is a composite view of a block diagram of driving circuits and the plan view of a gas discharge display panel according to an eighth embodiment of the present invention, a gas discharge display apparatus consisting of the driving circuits and the gas discharge display panel. FIG. 30 shows waveforms of various signals transmitted in the gas discharge display apparatus shown in FIG. 29.

As shown in FIG. 29, a gas discharge display apparatus 91 comprises a display anode driving section 92 for generating four types of subsidiary discharge pulses Psd ($Psd_1$, $Psd_2$, $Psd_3$, and $Psd_4$) and four types of writing pulses Pw ($Pw_1$, $Pw_2$, $Pw_3$, and $Pw_4$) cyclically transmitted on anode lines AL according to pieces of writing control information and pieces of subsidiary discharge control information, a cathode driving section 93 for generating five types of subsidiary scanning pulses Pss ($Pss_1$, $Pss_2$, $Pss_3$, $Pss_4$, and $Pss_5$), five types of writing scanning pulses Pws ($Pws_1$, $Pws_2$, $Pws_3$, $Pws_4$, and $Pws_5$), five types of maintaining pulse signals Sm ($Sm_1$, $Sm_2$, $Sm_3$, $Sm_4$, and $Sm_5$) cyclically transmitted on cathode lines CL according to pieces of scanning control information and pieces of maintaining control information, and a gas discharge display panel 94 in which subsidiary gas discharge, writing gas discharge, and maintaining gas discharge are produced in that order to radiate visible light.

The display anode driving section 92 comprises a subsidiary-writing control gate signal generating circuit 95 for generating four types of four types of subsidiary control gate signals and four types of writing control gate signals according to the subsidiary discharge control information and the writing control information, and a subsidiary-writing pulse generating circuit 96 for generating the subsidiary discharge pulses Psd and the writing pulses signals Pw cyclically transmitted on the display anode lines AL according to the subsidiary control gate signals and the writing control gate signals generated in the subsidiary-writing control gate signal generating circuit 95.

In the above configuration of the display anode driving section 92, the subsidiary and writing control gate signals are generated according to the subsidiary discharge control information and the writing control information in the subsidiary-writing control gate signal generating circuit 95. Thereafter, as shown in FIG. 30, the subsidiary discharge pulses Psd and the writing pulses Pw are generated according to the subsidiary and writing control gate signals in the subsidiary-writing pulse generating circuit 96 to cyclically transmit the subsidiary discharge pulses Psd and the writing pulse signals Sw on the display anode lines AL.

The cathode driving section 93 comprises a scanning-maintaining control gate signal generating circuit 97 for generating subsidiary scanning gate signals, writing scanning gate signals, and maintaining gate signals according to the scanning and maintaining control information, and a scanning-maintaining pulse generating circuit 98 for generating the subsidiary scanning pulses Pss, the writing scanning pulses Pws, and the maintaining pulse signals Sm transmitted on the cathode lines CL according to the subsidiary scanning gate signals, the writing scanning gate signals, and the maintaining gate signals generated in the scanning-maintaining control gate signal generating circuit 97.

In the above configuration of the cathode driving section 93, the subsidiary scanning gate signals, the writing scanning gate signals, and the maintaining gate signals are generated in the scanning-maintaining control gate signal generating circuit 97 according to the scanning and maintaining control information. Thereafter, as shown in FIG. 30, the subsidiary scanning pulses Pss, the writing scanning pulses Pws, and the maintaining pulse signals Sm are generated according to the subsidiary scanning gate signals in the scanning-maintaining pulse generating circuit 98. In this case, the writing scanning pulses Pws and the maintaining pulse signals Sm are biased at the negative voltage $V_B$ in the same manner as in the scanning-maintaining pulse generating circuit 63 of the third embodiment. Also, the subsidiary scanning pulses Pss are biased at the negative voltage $V_B$ in the same manner.

Thereafter, the subsidiary scanning pulses Pss are cyclically transferred to the anode lines AL. Thereafter, the writing scanning pulses Pws are cyclically transferred to the anode lines AL. The maintaining pulse signals Sm are transferred to the anode lines AL after the writing scanning pulses Pws during a maintaining period.

The gas discharge display panel 94 comprises four anode lines AL (A1, A2, A3, and A4) arranged in a row direction at regular intervals, five cathode lines CL (C1, C2, C3, C4, and C5) arranged in a line direction while crossing over the anode lines AL, a plurality of display cells 99 arranged at intersection spaces between the cathode lines CL and the anode lines AL. The gas discharge display panel 94 is laid open to public inspection under Provisional Publication No. S60-194495.

The number of cathode lines is not limited to five, and the number of anode lines is not limited to four.

In the above configuration of the gas discharge display panel 94, as shown in FIG. 30, when a subsidiary discharge pulse $Psd_1$ is transferred from the display anode driving section 92 to the anode line A1 and a subsidiary scanning pulse $Pss_1$ is transferred from the cathode driving section 93 to the cathode line C1 in synchronism with the subsidiary discharge pulse $Psd_1$, subsidiary gas discharge is produced in a specific display cell 99 arranged at an intersection space between the anode line A1 and the cathode line C1. Therefore, excited particles are generated in the specific display cell 99. After a time, a writing scanning pulse $Pws_1$ is transferred from the display anode driving section 92 to the anode line A1. Also, a writing pulse $Pw_1$ is transferred from the cathode driving section 93 to the cathode line C1 in synchronism with the writing scanning pulse $Pws_1$. At this time, writing gas discharge is produced in the specific display cell 99. In this case, because the excited particles produced by the subsidiary gas discharge remains, the production of the writing gas discharge is performed at high speed while the excited particles function as priming.

Thereafter, a series of pulses of a maintaining pulse signal $Sm_1$ generated in the cathode driving section 93 is applied on the cathode line C1 during a maintaining period. Therefore, maintaining gas discharge is continuously produced in the specific display cell 99.

Accordingly, because any subsidiary anode driving section such as the subsidiary anode driving section 14, 72, 77, or 82 is not required, the driving sections required in the apparatus 91 can be greatly simplified.

Also, when the maintaining gas discharge is not required in an erasing period subsequent to the maintaining period, any maintaining pulse signal is not applied on the cathode line. Therefore, an electric power required to produce the maintaining pulse signal can be effectively consumed to produce the maintaining gas discharge in the maintaining period. In other words, the electric power is not consumed in the erasing period so that all of the electric power can be contributed to the maintaining gas discharge produced in the gas discharge display apparatus 91.

In addition, because only three types of voltages such as the voltage Vw of the subsidiary discharge pulses Psd and the writing pulses Pw, the voltage Vc of the subsidiary and writing scanning pulses Pss, Pws and the maintaining pulse signals Sm, the bias voltage $V_B$ are required in the display apparatus 91, the driving sections 92, 93 can be greatly simplified. As a result, the driving sections 92, 93 can be manufactured in an integrated circuit structure.

Figure 31:
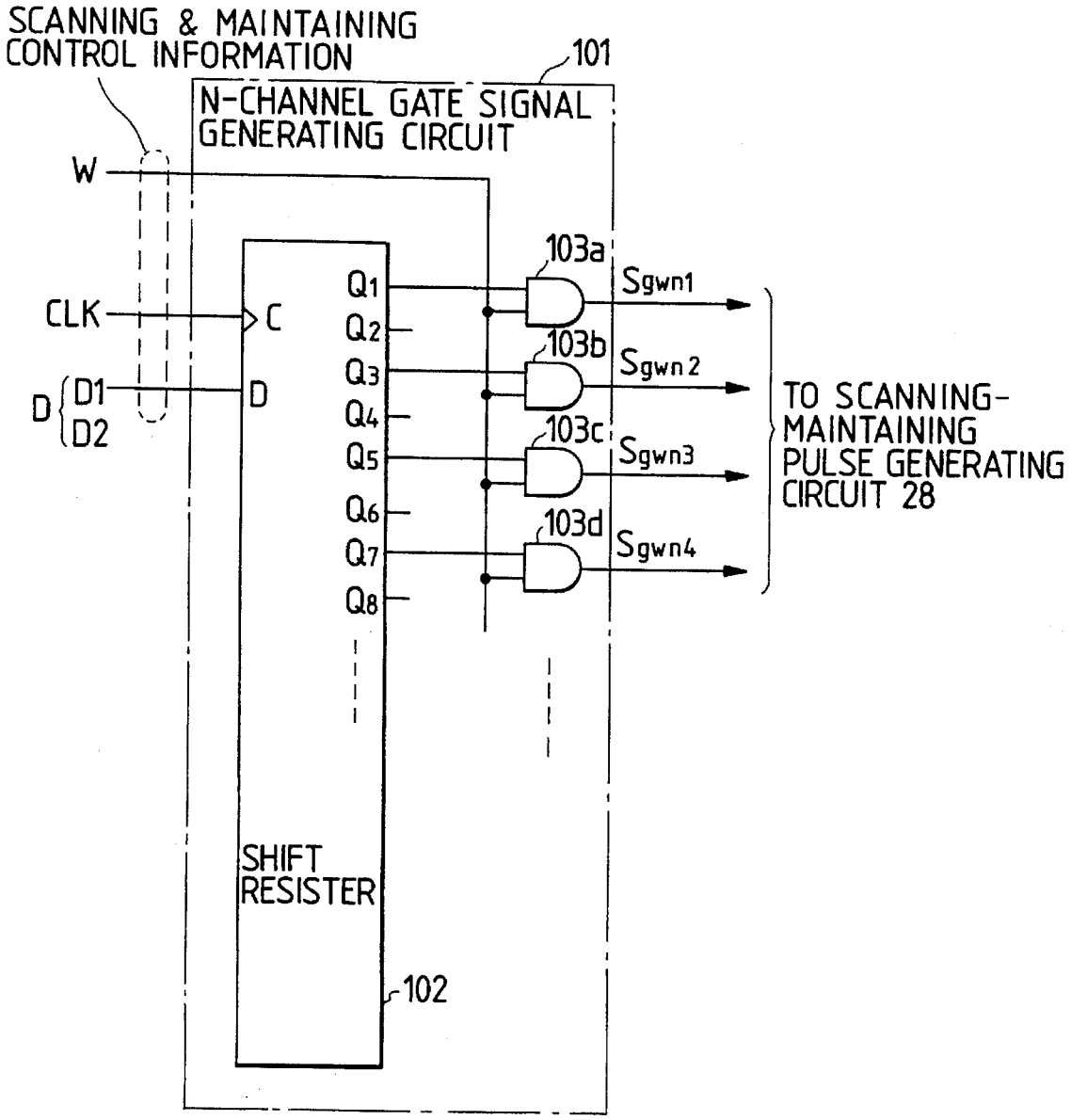
FIG. 31 is another circuit diagram of the n-channel gate signal generating circuit shown in FIG. 9 according to a modification of the second embodiment.
Figure 32:
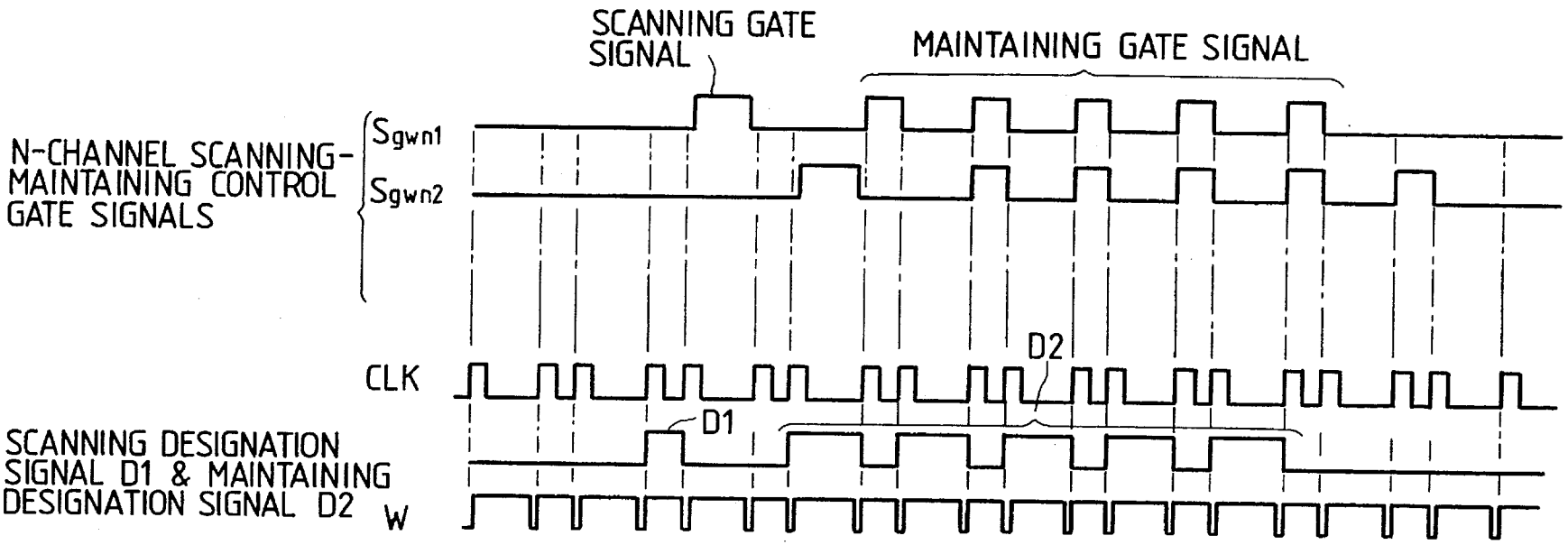
FIG. 32 shows waveforms of various signals transmitted in the n-channel gate signal generating circuit shown in FIG. 31.

FIG. 31 is another circuit diagram of the n-channel gate signal generating circuit 30 shown in FIG. 9 according to a modification of the second embodiment. FIG. 32 shows waveforms of various signals transmitted in the n-channel gate signal generating circuit shown in FIG. 31.

In the second embodiment, the scanning-maintaining control gate signal generating circuit 27 comprises the p-channel gate signal generating circuit 29 and the n-channel gate signal generating circuit 30 as shown in FIGS. 9, 10. However, it is preferred that an n-channel gate signal generating circuit 101 shown in FIG. 31 be utilized in place of the n-channel gate signal generating circuit 30 and a p-channel gate signal generating circuit manufactured in the same manner as the circuit 101 be utilized in place of the p-channel gate signal generating circuit 29.

As shown in FIGS. 31, 32, the n-channel gate signal generating circuit 101 comprises a shift register 102 for fetching a scanning designation signal D1 and a maintaining designation signal D2 in synchronism with a clock signal CLK and shifting the signals D1, D2, and five AND gates 103 (103*a*, 103*b*, 103*c*, 103*d*, and 103*e*) for fetching the signals D1, D2 output from odd number's output terminals of the shift register 102 and outputting a scanning gate signal and a maintaining gate signal in cases where a pulse width designation signal W is in a high level "1". In the above configuration, when the scanning designation signal D1 and the maintaining designation signal D2 are provided to the shift register 102, the signals D1, D2 are fetched into the shift register 102 in synchronism with the clock signal CLK. Thereafter, the signals D1, D2 are shifted and provided to the AND gates 103. Thereafter, when the pulse width designation signal W is in the high level "1", the scanning gate signal and the maintaining gate signal is output from the AND gates 103 to the scanning-maintaining pulse generating circuit 28.

Figure 33:
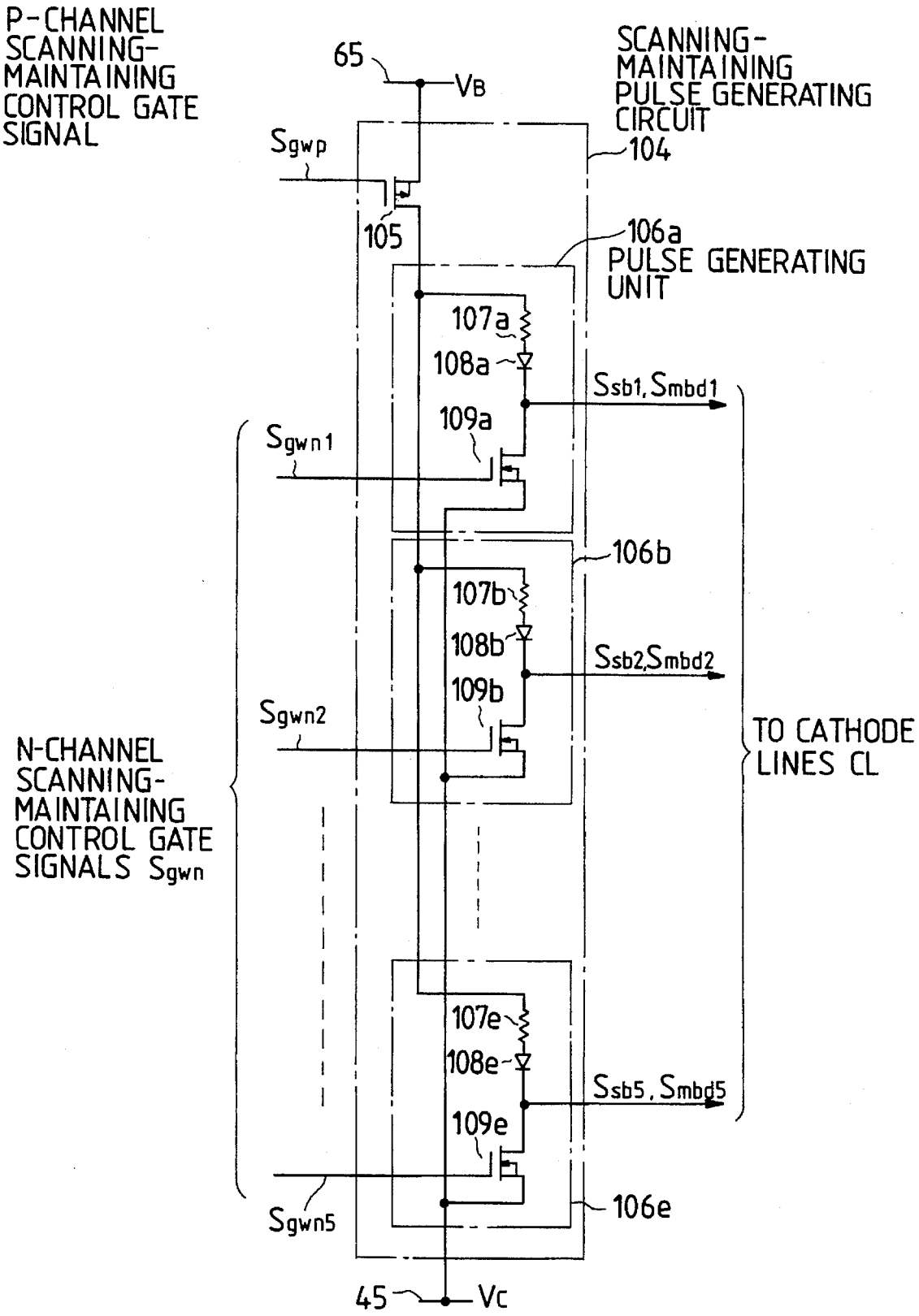
FIG. 33 is another circuit diagram of the scanning-maintaining pulse generating circuit shown in FIG. 15 according to a modification of the second embodiment.
Figure 34:
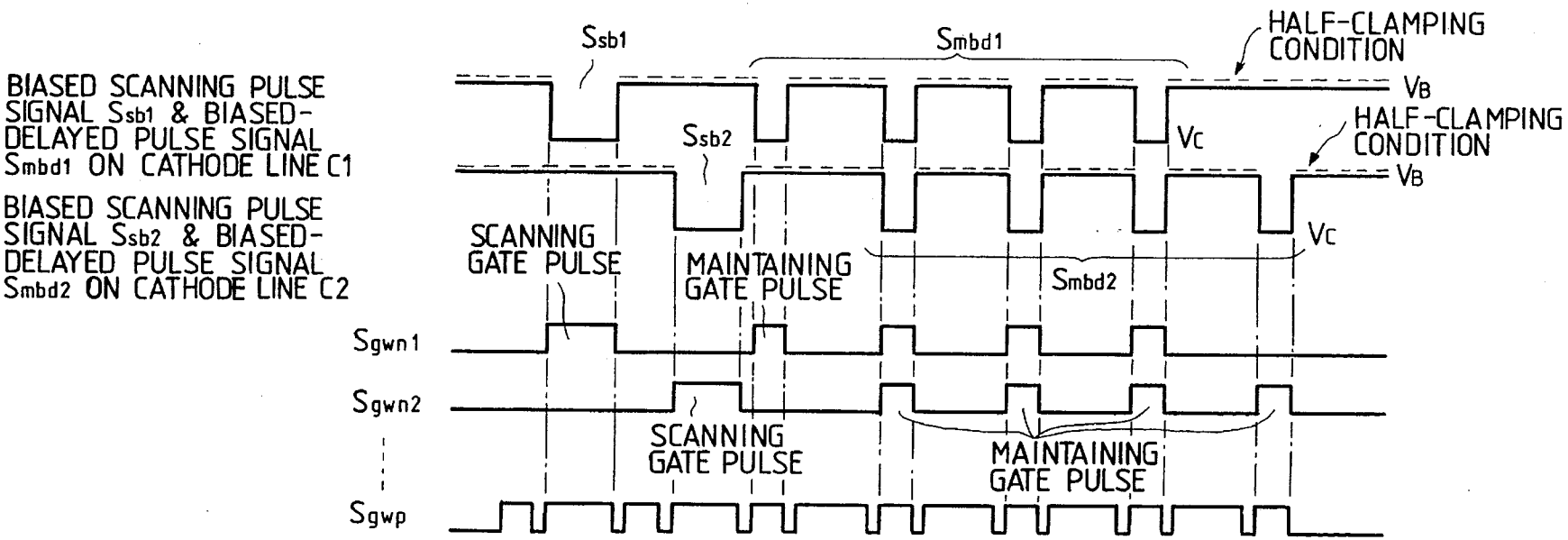
FIG. 34 shows waveforms of various signals transmitted in the scanning-maintaining pulse generating circuit shown in FIG. 33.

FIG. 33 is another circuit diagram of the scanning-maintaining pulse generating circuit 63 shown in FIG. 15 according to a modification of the second embodiment. FIG. 34 shows waveforms of various signals transmitted in the scanning-maintaining pulse generating circuit shown in FIG. 33.

Also, in the third, fourth and seventh embodiments, the biased scanning signals Ssb and the biased maintaining signals Smb, Smbd are produced by utilizing the scanning-maintaining pulse generating circuit 63 shown in FIG. 16. However, it is preferred that a scanning-maintaining pulse generating circuit 104 shown in FIG. 33 be utilized in place of the scanning-maintaining pulse generating circuit 63.

The scanning-maintaining pulse generating circuit 104 comprises a p-channel FET 105 of which a source is connected to the electric source line 65, a drain is connected to the electric source line 45 applied to the negative voltage Vc, and a gate is connected to a p-channel output terminal to receive the p-channel scanning-maintaining control gate signal Sgwp, and five pulse generating units 106 (106*a*, 106*b*, 106*c*, 106*d*, and 106*e*) for generating the biased scanning signals Ssb and the biased maintaining signals Smbd in synchronism with the n-channel scanning-maintaining control gate signals Sgwn generated in the scanning-maintaining control gate signal generating circuit 27.

The p-channel FET 105 is turned on or turned off in synchronism with a p-channel scanning-maintaining control gate signal Sgwp generated in the scanning-maintaining control gate signal generating circuit 27. Therefore, the source voltage $V_s$ is intermittently applied to the pulse generating units 106.

Each of the pulse generating units 106 comprises a current limiting resister 107 (107*a*, 107*b*, 107*c*, 107*d*, or 107*e*) of which one end is connected to a drain of the p-channel FET 105, a half-clamping diode 108 (108*a*, 108*b*, 108*c*, 108*d*, or 108*e*) of which an anode is connected to another end of the current limiting resister 107, and an n-channel FET 109 (109*a*, 109*b*, 109*c*, 109*d*, or 109*e*) of which a source is connected to the electric source line 45 applied to the negative voltage Vc, a gate is connected to one of n-channel output terminals to receive the n-channel scanning-maintaining control gate signal Sgwn from the scanning-maintaining control gate signal generating circuit 27, and a drain is connected to a cathode of the half-clamping diode 108.

In the above configuration of the scanning-maintaining pulse generating circuit 104, as shown in FIG. 34, when the p-channel scanning-maintaining control gate signal Sgwp generated in the scanning-maintaining control gate signal generating circuit 27 is received in the p-channel FET 105, the p-channel FET 105 is turned off. Also, five types of scanning gate pulses of the n-channel scanning-maintaining control gate signal Sgwn generated in the scanning-maintaining control gate signal generating circuit 27 are cyclically received in the n-channel FETs 109 in synchronism with the p-channel scanning-maintaining control gate signal Sgwp to turn on the n-channel FETs 109. Therefore, five types of biased scanning signals Ssb are cyclically transmitted on the cathode lines CL.

Also, when five types of maintaining gate pulses of the n-channel scanning-maintaining control gate signal Sgwn are cyclically received in the n-channel FETs 109 in synchronism with the p-channel scanning-maintaining control gate signal Sgwp to turn on the n-channel FETs 109, five types of biased-delayed maintaining signals Smbd are cyclically transmitted on the cathode lines CL. In this case, a series of maintaining gate pulses are received in each of the n-channel FETs 109 during a maintaining period in synchronism with the p-channel scanning-maintaining control gate signal Sgwp. Therefore, the biased-delayed maintaining signals Smbd are intermittently transmitted on each of the cathode lines CL during the maintaining period.

Accordingly, because the p-channel FET 105 is utilized in common for the pulse generating units 106, the scanning-maintaining pulse generating circuit 104 can be simplified as compared with the scanning-maintaining pulse generating circuit 63 shown in FIG. 16.

Figure 35:
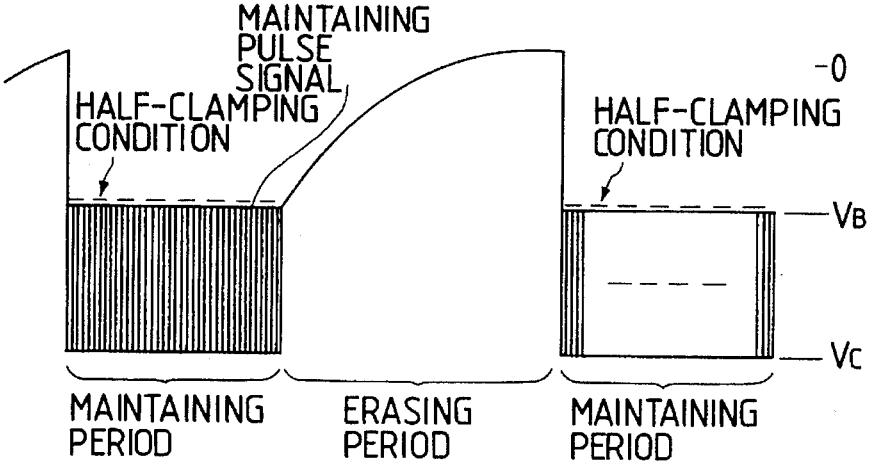
FIG. 35 schematically shows the shift of voltage applied on the cathode lines shown in FIGS. 15, 18, and 26 during a maintaining period and an erasing period.
Figure 36:
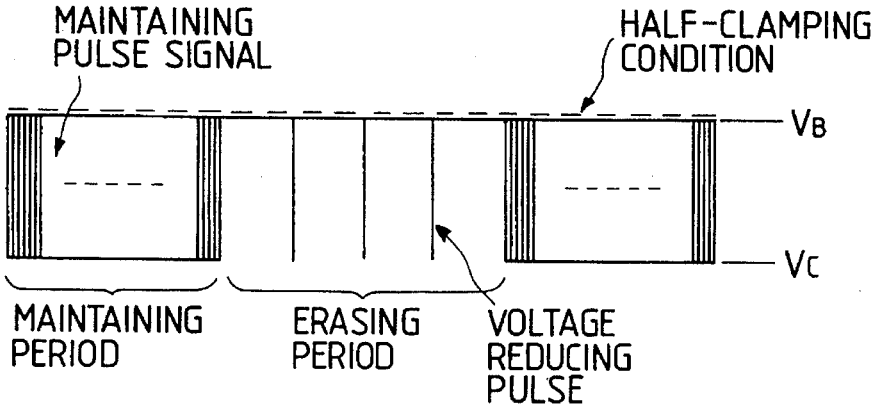
FIG. 36 schematically shows voltage of the cathode lines shown in FIGS. 15, 18, and 26 during a maintaining period and an erasing period in cases where voltage reducing pulses are intermittently applied on the cathode lines during the erasing period.
Figure 37:
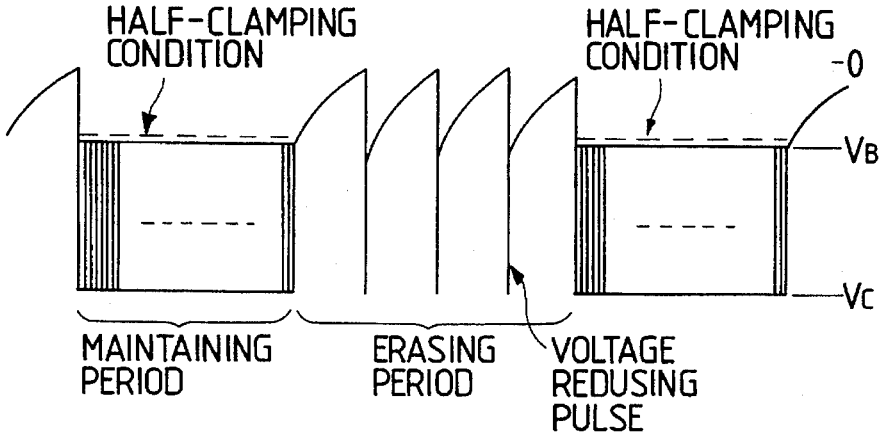
FIG. 37 schematically shows the shift of voltage applied on the cathode lines shown in FIGS. 15, 18, and 26 during a maintaining period and an erasing period in cases where voltage reducing pulses are intermittently applied on the cathode lines during the erasing period.

FIG. 35 schematically shows the shift of voltage applied on the cathode lines shown in FIGS. 15, 18, and 26 during a maintaining period and an erasing period. FIG. 36 schematically shows voltage of the cathode lines shown in FIGS. 15, 18, and 26 during a maintaining period and an erasing period in cases where voltage reducing pulses are intermittently applied on the cathode lines during the erasing period. FIG. 37 schematically shows the shift of voltage applied on the cathode lines shown in FIGS. 15, 18, and 26 during a maintaining period and an erasing period in cases where voltage reducing pulses are intermittently applied on the cathode lines during the erasing period.

Also, in the third, fourth and seventh embodiments, as shown in FIG. 35, the voltage of the cathode lines CL can be gradually increased during the erasing period subsequent to the maintaining period because gas discharge is erroneously produced in the display cells 16. For example, when a biased scanning signal $Ssb_1$ is applied on the cathode line C1 after the voltage of the cathode line C2 adjacent to the cathode line C1 is increased, there is a possibility that an electric current erroneously flows from the cathode line C2 to the cathode line C1. Therefore, as shown in FIG. 36, it is preferred that voltage reducing pulses be intermittently applied on the cathode lines CL during the erasing period in non-synchronous with pulses of the subsidiary discharge pulse signals to reduce the voltage of the cathode lines CL. As a result, as shown in FIG. 37, even though the voltage of a cathode line CL is increased, the voltage of the cathode line CL can be promptly reduced by the voltage reducing pulses. Accordingly, the electric current erroneously flowing between the cathode lines CL can be reliably prevented.

Also, FET elements are utilized as switching elements in the second to eighth embodiments. However, it is preferred that other switching elements normally utilized be utilized in place of the FET elements.

Also, it is preferred that voltage values and pulse widths of various signals and pulses utilized in the second to eighth embodiments be dependent the structure of the gas discharge display panels 15, 83, and 94 or structural materials of the gas discharge display panels 15, 83, and 94.

Also, scanning signals Ssa, Ssb applied on the cathode lines CL are formed of pulses applied to negative voltages in the second to eighth embodiments. However, it is preferred that the scanning signals be formed of pulses applied to positive voltages. In this case, the writing pulse signals and the subsidiary discharge pulse signals are applied to negative voltages.

Also, it is preferred that the subsidiary cells 17, 84 be formed of a direct current type of cells which are directly exposed to discharge space. Also, it is preferred that the subsidiary cells 17, 84 be formed of a semi-alternate current type of cells which are not directly exposed to discharge space.

Also, each of the pulse generating units 53, 74, and 79 shown in FIGS. 14, 21, and 24 are provided for each of the subsidiary anode lines SA. However, because the subsidiary discharge pulse signals generated in the pulse generating units 53, 74, and 79 have the same waveform and phase, it is preferred that only a pulse generating unit 53 be utilized in common for the subsidiary anode lines SA, only a pulse generating unit 74 be utilized in common for the subsidiary anode lines SA, and only a pulse generating unit 79 be utilized in common for the subsidiary anode lines SA.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

What is claimed is:

1. A method for driving a gas discharge display panel comprising a plurality of display electrode lines arranged side by side, a plurality of scanning electrode lines which are arranged side by side and cross the display electrode lines, and a plurality of discharge cells arranged at intersection spaces between the display electrode lines and the scanning electrode lines, comprising the steps of:

applying a writing pulse set at a positive writing voltage of a direct current on a specific display electrode line selected from the display electrode lines according to a piece of display information;

applying a scanning pulse set at a negative scanning voltage of a direct current on a specific scanning electrode line selected from the scanning electrode lines in synchronism with the writing pulse to produce writing gas discharge in cooperation with the writing pulse in a specific discharge cell arranged at an intersection space between the specific display electrode and the specific scanning electrode line;

setting a maintaining period to start from the production of the writing gas discharge and to end with a start of a non-display period; and applying a series of maintaining pulses set at a negative maintaining voltage of a direct current on the specific scanning electrode during only the maintaining period to produce a maintaining gas discharge subsequent to the writing gas discharge in the specific discharge cell, the maintaining gas discharge being intermittently produced in synchronism with the maintaining pulses subsequent to the scanning pulse, and to stop the maintaining gas discharge when the maintaining period is ended.

2. A method according to claim 1, in which the step of applying a series of maintaining pulses includes setting the maintaining pulses at a voltage which is the same as another voltage of the scanning pulse.

* * * * *